US006871622B2

(12) United States Patent
Mandal et al.

(10) Patent No.: US 6,871,622 B2
(45) Date of Patent: Mar. 29, 2005

(54) LEAKDOWN PLUNGER

(75) Inventors: Dhruva Mandal, Vernon Hills, IL (US); Carroll D. Williams, Pocahontas, AR (US)

(73) Assignee: MacLean-Fogg Company, Mundelein, IL (US)

( * ) Notice: Subject to any disclaimer, the term of this patent is extended or adjusted under 35 U.S.C. 154(b) by 2 days.

(21) Appl. No.: 10/274,519

(22) Filed: Oct. 18, 2002

(65) Prior Publication Data

US 2004/0074461 A1 Apr. 22, 2004

(51) Int. Cl.[7] ..... F01L 1/14

(52) U.S. Cl. ..... 123/90.52; 123/90.48; 123/90.45

(58) Field of Search ..... 123/90.48, 90.52, 123/90.55, 90.39, 90.43, 90.45; 403/114, 165

(56) References Cited

U.S. PATENT DOCUMENTS

| | | | |
|---|---|---|---|
| 188,764 | A | 2/1877 | Adams |
| 626,594 | A | 4/1899 | Chapman |
| 703,838 | A | 7/1902 | Scobee |
| 794,683 | A | 7/1905 | Riotte |
| 872,598 | A | 12/1907 | Watts et al. |
| 948,248 | A | 2/1910 | Reaugh |
| 1,001,265 | A | 3/1911 | Graham |
| 1,000,722 | A | 4/1911 | Danver |
| 992,089 | A | 5/1911 | Watt |
| 993,875 | A | 5/1911 | Richards et al. |
| 1,061,700 | A | 5/1913 | Steinbecker |
| 1,066,069 | A | 7/1913 | Willshaw |
| 1,080,733 | A | 12/1913 | Thomson |
| 1,084,514 | A | 1/1914 | Whitlock |

(Continued)

OTHER PUBLICATIONS

"GM Displacement on Demand," Jim Kerr, Canadian Driver, Oct. 25, 2002, 01468–01469.
"Eaton adds variablity to Displacement on Demand," Frank Bokulich, Automotive Engineering International Tech Brief, Jan. 2002, 01471–01473.
"GM Power Train Displaces on Demand" Jean 1. Broge, Automotive Engineering International Online, July 2001, 01474–01476.

(Continued)

*Primary Examiner*—Thomas Denion
*Assistant Examiner*—Ching Chang
(74) *Attorney, Agent, or Firm*—Dana Andrew Alden

(57) ABSTRACT

The present invention relates to a roller follower, comprising an outer surface, enclosing a first cavity and a second cavity, wherein the first cavity includes a first inner surface configured to house a cylindrical insert, the second cavity includes a second inner surface cylindrically shaped, and at least one of the cavities is fabricated through forging.

31 Claims, 52 Drawing Sheets

U.S. PATENT DOCUMENTS

| | | | |
|---|---|---|---|
| 1,101,935 | A | 6/1914 | Jacobs et al. |
| 1,129,555 | A | 2/1915 | Curran |
| 1,198,115 | A | 9/1916 | De La Bar |
| 1,210,871 | A | 1/1917 | Suffa |
| 1,220,380 | A | 3/1917 | Turner |
| 1,245,552 | A | 11/1917 | Becket |
| 1,246,343 | A | 11/1917 | Snadecki |
| 1,247,366 | A | 11/1917 | Brockway |
| 1,252,692 | A | 1/1918 | Harris |
| 1,254,227 | A | 1/1918 | Huber |
| 1,292,312 | A | 1/1919 | Gronkwist |
| 1,331,787 | A | 2/1920 | Schlatter |
| 1,336,447 | A | 4/1920 | Suffa |
| 1,345,942 | A | 7/1920 | McCain |
| 1,350,989 | A | 8/1920 | Cox |
| 1,354,852 | A | 10/1920 | Schneider |
| 1,358,459 | A | 11/1920 | Pache |
| 1,363,398 | A | 12/1920 | Davids |
| 1,374,059 | A | 4/1921 | Church |
| 1,377,866 | A | 5/1921 | White |
| 1,399,839 | A | 12/1921 | Alborn |
| 1,409,625 | A | 3/1922 | Vosbrink |
| 1,409,878 | A | 3/1922 | Mainland |
| 1,410,771 | A | 3/1922 | Strohl |
| 1,422,698 | A | 7/1922 | Grossman |
| 1,427,111 | A | 8/1922 | Knudsen |
| 1,461,560 | A | 7/1923 | Rich |
| 1,464,082 | A | 8/1923 | Leo |
| 1,475,557 | A | 9/1923 | Albrecht |
| 1,479,735 | A | 1/1924 | Page |
| 1,515,201 | A | 3/1924 | Hewitt |
| 1,537,529 | A | 5/1925 | Enberg |
| 1,543,438 | A | 6/1925 | Hutt |
| 1,565,223 | A | 12/1925 | Church |
| 1,566,923 | A | 12/1925 | Roberts |
| 1,573,962 | A | 2/1926 | Charnock |
| 1,582,883 | A | 4/1926 | Rich |
| 1,594,471 | A | 8/1926 | Short |
| 1,605,494 | A | 11/1926 | Anderson |
| 1,607,128 | A | 11/1926 | Johansen |
| 1,613,012 | A | 1/1927 | Baker |
| 1,623,826 | A | 4/1927 | Burleson |
| 1,674,310 | A | 6/1928 | Topping |
| 1,682,821 | A | 9/1928 | Woolson |
| 1,696,866 | A | 12/1928 | Seaman |
| 1,728,149 | A | 9/1929 | Berne |
| 1,735,695 | A | 11/1929 | Rich |
| 1,741,093 | A | 12/1929 | Briggs |
| 1,741,230 | A | 12/1929 | Goodwin |
| 1,748,086 | A | 2/1930 | Small |
| 1,784,257 | A | 12/1930 | Thomas |
| 1,797,105 | A | 3/1931 | Shoblom |
| 1,798,738 | A | 3/1931 | Hoern |
| 1,798,938 | A | 3/1931 | Hallet |
| 1,802,330 | A | 4/1931 | Boland |
| 1,820,299 | A | 8/1931 | Church |
| 1,834,285 | A | 12/1931 | Loeffler |
| 1,835,622 | A | 12/1931 | Willgoos |
| 1,840,633 | A | 1/1932 | Morehouse |
| 1,844,021 | A | 2/1932 | Stewart |
| 1,847,312 | A | 3/1932 | Seufert |
| 1,848,083 | A | 3/1932 | Wetherald |
| 1,874,471 | A | 8/1932 | Du Bois |
| 1,899,251 | A | 2/1933 | Zerk |
| 1,907,506 | A | 5/1933 | Coburn |
| 1,915,867 | A | 6/1933 | Penick |
| 1,930,261 | A | 10/1933 | Berry |
| 1,930,368 | A | 10/1933 | Nelson |
| 1,930,568 | A | 10/1933 | Short |
| 1,971,083 | A | 2/1934 | Im Schlaa |
| 1,955,844 | A | 4/1934 | Woolman |
| 1,956,014 | A | 4/1934 | Fink et al. |
| 1,962,057 | A | 6/1934 | Clutterbuck |
| 1,968,982 | A | 8/1934 | Baranaby et al. |
| 1,977,778 | A | 10/1934 | Rice |
| 1,985,447 | A | 12/1934 | Grubbs |
| 2,000,635 | A | 5/1935 | Edwards |
| 2,002,196 | A | 5/1935 | Ucko |
| 2,015,991 | A | 10/1935 | Breeler |
| 2,019,138 | A | 10/1935 | Kliesrath et al. |
| 2,019,252 | A | 10/1935 | Cottingham |
| 2,027,406 | A | 1/1936 | Spatta |
| 2,036,936 | A | 4/1936 | Halford |
| 2,051,415 | A | 8/1936 | Payson |
| 2,053,743 | A | 9/1936 | Russell |
| 2,055,341 | A | 9/1936 | Dyer |
| 2,067,114 | A | 1/1937 | Ashton |
| 2,071,051 | A | 2/1937 | Van Ranst |
| 2,071,719 | A | 2/1937 | Wurtele |
| 2,073,178 | A | 3/1937 | Rich |
| 2,081,390 | A | 5/1937 | Trapp |
| 2,089,478 | A | 8/1937 | Heiss |
| 2,091,451 | A | 8/1937 | Phillips |
| 2,091,674 | A | 8/1937 | Dostal |
| 2,097,413 | A | 10/1937 | Hurst et al. |
| 2,098,115 | A | 11/1937 | Voorhies |
| 2,107,456 | A | 2/1938 | Trapp |
| 2,109,815 | A | 3/1938 | Best |
| 2,114,655 | A | 4/1938 | Leibing |
| 2,116,749 | A | 5/1938 | Daisley |
| 2,117,434 | A | 5/1938 | Krebs |
| 2,120,389 | A | 6/1938 | Bettison |
| 2,127,245 | A | 8/1938 | Breeler |
| 2,131,948 | A | 10/1938 | Graham |
| 2,142,224 | A | 1/1939 | Turlay |
| 2,151,832 | A | 3/1939 | Bugatti |
| 2,154,494 | A | 4/1939 | Corlett |
| 2,163,969 | A | 6/1939 | Whalen |
| 2,166,968 | A | 7/1939 | Rohlin |
| 2,174,526 | A | 10/1939 | Parker |
| 2,175,466 | A | 10/1939 | Johnson |
| 2,179,354 | A | 11/1939 | Scott |
| 2,185,991 | A | 1/1940 | Voorhies et al. |
| 2,187,008 | A | 1/1940 | Baxter |
| 2,199,096 | A | 4/1940 | Berglund |
| 2,207,324 | A | 7/1940 | L 'Orange |
| 2,209,479 | A | 7/1940 | Spencer |
| 2,227,127 | A | 12/1940 | Dillström |
| 2,247,278 | A | 6/1941 | Daisley |
| 2,247,299 | A | 6/1941 | Klavik |
| 2,250,011 | A | 7/1941 | Dayton |
| 2,250,814 | A | 7/1941 | Rohlin |
| 2,272,074 | A | 2/1942 | Voorhies |
| 2,280,753 | A | 4/1942 | Essl |
| 2,308,858 | A | 1/1943 | Burkhardt |
| 2,309,740 | A | 2/1943 | Voorhies |
| 2,319,546 | A | 5/1943 | Insley et al. |
| 2,322,172 | A | 6/1943 | Spencer |
| 2,322,173 | A | 6/1943 | Spencer |
| 2,322,174 | A | 6/1943 | Spencer |
| 2,322,195 | A | 6/1943 | Mock |
| 2,324,322 | A | 7/1943 | Reese et al. |
| 2,339,238 | A | 1/1944 | Buckley |
| 2,344,285 | A | 1/1944 | Cormode |
| 2,346,737 | A | 4/1944 | Essl |
| 2,349,203 | A | 5/1944 | Spencer |
| 2,356,900 | A | 8/1944 | Voorhies |
| 2,381,339 | A | 8/1945 | Doman |
| 2,385,309 | A | 9/1945 | Spencer |
| 2,386,317 | A | 10/1945 | Jenny et al. |
| 2,392,933 | A | 1/1946 | Mallory |

2,394,738 A 2/1946 Anthony
2,405,927 A 8/1946 Tornblom
2,408,325 A 9/1946 Luce et al.
2,410,411 A 11/1946 Gregory
2,434,386 A 1/1948 Bradshaw
2,435,727 A 2/1948 Spencer
2,438,631 A 3/1948 Bergmann
2,443,999 A 6/1948 Wright
2,451,395 A 10/1948 Klukan
2,483,779 A 10/1949 Mucher
2,485,760 A 10/1949 Millis et al.
2,494,128 A 1/1950 Holmquist et al.
2,508,557 A 5/1950 Wood, Jr.
2,516,775 A 7/1950 Johansen
2,518,272 A 8/1950 Beckwith
2,522,326 A 9/1950 Winter, Jr.
2,526,239 A 10/1950 Kincaid, Jr.
2,527,604 A 10/1950 Walk
2,528,983 A 11/1950 Weiss
2,542,036 A 2/1951 Knaggs
2,548,342 A 4/1951 Brook et al.
2,563,699 A 8/1951 Winter, Jr.
2,564,902 A 8/1951 Houser et al.
2,572,968 A 10/1951 Bachle
2,595,583 A 5/1952 Johnson
2,618,297 A 11/1952 Gosselin
2,619,946 A 12/1952 Michelich
2,629,639 A 2/1953 Johansen
2,631,576 A 3/1953 Schowalter
2,642,051 A 6/1953 Russell
2,665,669 A 1/1954 Ellis
2,688,319 A 9/1954 Humphreys
2,694,389 A 11/1954 Turkish
2,705,482 A 4/1955 Randol
2,733,619 A 2/1956 Smith
2,735,313 A 2/1956 Dickson
2,737,934 A 3/1956 Banker
2,739,580 A 3/1956 Brown
2,743,712 A 5/1956 Hulsing
2,743,713 A 5/1956 Russell
2,745,391 A 5/1956 Winkler, Jr.
2,763,250 A 9/1956 Bensinger
2,765,783 A 10/1956 Randol
2,773,761 A 12/1956 Fuqua et al.
2,781,868 A 2/1957 House
2,784,707 A 3/1957 Skinner
2,795,217 A 6/1957 Ware
2,797,673 A 7/1957 Black
2,797,701 A 7/1957 Nurkiewicz
2,807,251 A 9/1957 Peras
2,808,818 A 10/1957 Sampietro
2,815,740 A 12/1957 Slater
2,818,050 A 12/1957 Papenguth
2,818,844 A 1/1958 Wood
2,821,970 A 2/1958 Line
2,827,887 A 3/1958 Van Slooten
2,829,540 A 4/1958 Niemeyer
2,840,063 A 6/1958 Purchas, Jr.
2,842,111 A 7/1958 Braun
2,845,914 A 8/1958 Cobo
2,846,988 A 8/1958 Iskenderian
2,849,997 A 9/1958 Kravits
2,853,984 A 9/1958 Sampietro
2,857,895 A 10/1958 Scheibe
2,859,510 A 11/1958 Baxa
2,863,430 A 12/1958 Sampietro
2,863,432 A 12/1958 O'Brien
2,865,352 A 12/1958 Thompson
2,874,685 A 2/1959 Line
2,875,742 A 3/1959 Dolza
2,882,876 A 4/1959 Bergmann
2,887,098 A 5/1959 Thompson
2,891,525 A 6/1959 Moore
2,908,260 A 10/1959 Bergmann, Sr.
2,918,047 A 12/1959 Mick
2,919,686 A 1/1960 Mick
2,925,074 A 2/1960 Dadd
2,925,808 A 2/1960 Baumann
2,926,884 A 3/1960 Clinkenbeard
2,932,290 A 4/1960 Christensen
2,934,051 A 4/1960 Drew
2,934,052 A 4/1960 Longenecker
2,935,059 A 5/1960 Thompson
2,935,878 A 5/1960 Wirsching
2,937,632 A 5/1960 Voorhies
2,938,508 A 5/1960 Papenguth
2,942,595 A 6/1960 Bergmann, Sr. et al.
2,947,298 A 8/1960 Dolza
2,948,270 A 8/1960 Bergmann
2,948,274 A 8/1960 Wood
2,954,015 A 9/1960 Line
2,956,557 A 10/1960 Dadd
2,962,012 A 11/1960 Howson
2,963,012 A 12/1960 Kolbe
2,964,027 A 12/1960 Dadd
2,983,991 A 5/1961 Carlson
2,988,805 A 6/1961 Thompson
2,997,991 A 8/1961 Roan
3,009,450 A 11/1961 Engemann
3,016,887 A 1/1962 Streit et al.
3,021,593 A 2/1962 Cousino
3,021,826 A 2/1962 De Fezzy et al.
RE25,154 E 4/1962 Bergmann
3,028,479 A 4/1962 Tauschek
3,029,832 A 4/1962 Tischler et al.
3,054,392 A 9/1962 Thompson
3,070,080 A 12/1962 Van Slooten
3,078,194 A 2/1963 Thompson
3,079,903 A 3/1963 Humphreys
3,086,507 A 4/1963 Mooney, Jr.
3,089,472 A 5/1963 Thompson
3,090,367 A 5/1963 Ayres
3,101,077 A 8/1963 Engle
3,101,402 A 8/1963 Gondek
3,108,580 A 10/1963 Crane, Jr.
3,109,418 A 11/1963 Exline et al.
3,111,118 A 11/1963 Weiman
3,111,119 A 11/1963 Bergmann
3,114,361 A 12/1963 Mullen
3,124,114 A 3/1964 Voorhies
3,124,115 A 3/1964 Voorhies
3,128,749 A 4/1964 Dadd
3,137,282 A 6/1964 Voorhies
3,137,283 A 6/1964 Sampietro
3,138,146 A 6/1964 Hutchison
3,139,076 A 6/1964 Flaherty
3,139,078 A 6/1964 Van Slooten
3,139,872 A 7/1964 Thompson
3,144,010 A 8/1964 Van Slooten
3,147,745 A 9/1964 Kilgore
3,151,603 A 10/1964 Schumm
3,153,404 A 10/1964 Van Slooten
3,166,057 A 1/1965 Konrad et al.
3,169,515 A 2/1965 Kilgore et al.
3,176,669 A 4/1965 Kuchen et al.
3,177,857 A 4/1965 Kuchen et al.
3,180,328 A 4/1965 Engle
3,194,439 A 7/1965 Beduerftig
3,200,801 A 8/1965 Dornbos
3,220,393 A 11/1965 Schlink
3,224,243 A 12/1965 Van Deberg
3,225,752 A 12/1965 Robinson 3,234,815 A 2/1966 Line
RE25,974 E 3/1966 Dadd
3,240,195 A 3/1966 Sossna
3,255,513 A 6/1966 Robinson et al.
3,267,918 A 8/1966 Ayres
3,267,919 A 8/1966 Wortman
3,270,724 A 9/1966 Dolza
3,273,514 A 9/1966 Bender
3,273,546 A 9/1966 Von Arx
3,273,547 A 9/1966 Lesher
3,273,548 A 9/1966 Hoffman
3,273,998 A 9/1966 Knoth et al.
3,277,874 A 10/1966 Wagner
3,280,806 A 10/1966 Iskenderian
3,280,807 A 10/1966 Bardy
3,291,107 A 12/1966 Cornell
3,299,869 A 1/1967 Sicklesteel
3,299,986 A 1/1967 Briggs et al.
3,301,239 A 1/1967 Thauer
3,301,241 A 1/1967 Iskenderian
3,303,833 A 2/1967 Melling
3,304,925 A 2/1967 Rhoads
3,314,303 A 4/1967 Maat
3,314,404 A 4/1967 Thompson
3,322,104 A 5/1967 Abell, Jr.
3,332,405 A 7/1967 Haviland
3,354,898 A 11/1967 Barnes
3,365,979 A 1/1968 Ericson
3,367,312 A 2/1968 Jonsson
3,379,180 A 4/1968 Kabel et al.
3,385,274 A 5/1968 Shunta et al.
3,400,696 A 9/1968 Thompson
3,405,699 A 10/1968 Laas
3,410,366 A 11/1968 Winter, Jr.
3,413,965 A 12/1968 Gavasso
3,422,803 A 1/1969 Stivender
3,426,651 A 2/1969 Arendarski
3,430,613 A 3/1969 Barnes
3,437,080 A 4/1969 Abell, Jr.
3,439,659 A 4/1969 Bouwkamp
3,439,660 A 4/1969 Lesher
3,439,662 A 4/1969 Jones et al.
3,448,730 A 6/1969 Abell, Jr.
3,450,228 A 6/1969 Wortman et al.
3,455,346 A 7/1969 Stork
3,463,131 A 8/1969 Dolby
3,470,857 A 10/1969 Stivender
3,470,983 A 10/1969 Briggs
3,476,093 A 11/1969 Line
3,490,423 A 1/1970 Shunta et al.
3,502,058 A 3/1970 Thompson
3,518,976 A 7/1970 Thuesen
3,520,287 A 7/1970 Calvin
3,521,633 A 7/1970 Yahner
3,523,459 A 8/1970 Mowbray
3,528,451 A 9/1970 Hansen
3,542,001 A 11/1970 Line
3,547,087 A 12/1970 Siegler
3,549,430 A 12/1970 Kies et al.
3,549,431 A 12/1970 Gäetan de Coye de Ca
3,572,300 A 3/1971 Stager et al.
3,587,539 A 6/1971 Dadd
3,590,796 A 7/1971 Harkness
3,598,095 A 8/1971 Ayres
3,630,179 A 12/1971 Dadd
3,633,555 A 1/1972 Raggi
3,641,988 A 2/1972 Torazza et al.
3,650,251 A 3/1972 Pellzzoni
3,662,725 A 5/1972 Dragon et al.
3,664,312 A 5/1972 Miller, Jr.
3,665,156 A 5/1972 Lee
3,668,945 A 6/1972 Hofmann
3,690,959 A 9/1972 Thompson
3,716,036 A 2/1973 Kruger
3,717,134 A 2/1973 Cornell
3,722,484 A 3/1973 Gordini
3,741,240 A 6/1973 Berriman
3,742,921 A 7/1973 Rendine
3,782,345 A 1/1974 Erickson et al.
3,786,792 A 1/1974 Pelizzoni et al.
3,795,229 A 3/1974 Weber
3,799,129 A 3/1974 Cornell
3,799,186 A 3/1974 Bulin
3,805,753 A 4/1974 Bergmann et al.
3,822,683 A 7/1974 Clouse
3,831,457 A 8/1974 Kerm
3,838,669 A 10/1974 Dadd
3,848,188 A 11/1974 Ardezzone et al.
3,855,981 A 12/1974 Loon
3,859,969 A 1/1975 Davis, Jr.
3,860,457 A 1/1975 Vourinen et al.
3,870,024 A 3/1975 Ridgeway
3,875,908 A 4/1975 Ayres
3,875,911 A 4/1975 Joseph
3,877,445 A 4/1975 Barnes
3,877,446 A 4/1975 Morgan
3,879,023 A 4/1975 Pearce et al.
3,880,127 A 4/1975 Abell, Jr.
3,886,808 A 6/1975 Weber
3,893,873 A 7/1975 Hanai et al.
3,902,467 A 9/1975 Cornell
3,911,879 A 10/1975 Altmann
3,915,129 A 10/1975 Rust et al.
3,921,609 A 11/1975 Rhoads
3,945,367 A 3/1976 Turner, Jr.
3,958,900 A 5/1976 Ueno
3,964,455 A 6/1976 Brown
3,967,602 A 7/1976 Brown
3,977,370 A 8/1976 Humphreys
3,992,663 A 11/1976 Seddick
3,998,190 A 12/1976 Keske
4,004,558 A 1/1977 Scheibe
4,007,716 A 2/1977 Jones
4,009,695 A 3/1977 Ule
4,009,696 A 3/1977 Cornell
4,050,435 A 9/1977 Fuller, Jr. et al.
4,061,123 A 12/1977 Janes
4,064,844 A 12/1977 Matsumoto et al.
4,064,861 A 12/1977 Schulz
4,080,941 A 3/1978 Bertrand
4,086,887 A 5/1978 Schoonover et al.
4,089,234 A 5/1978 Henson et al.
4,094,279 A 6/1978 Kueny
4,098,240 A 7/1978 Abell, Jr.
4,104,991 A 8/1978 Abdoo
4,104,996 A 8/1978 Hosono et al.
4,105,267 A 8/1978 Mori
4,107,921 A 8/1978 Iizuka
4,114,588 A 9/1978 Jordan
4,114,643 A 9/1978 Aoyama et al.
4,133,332 A 1/1979 Benson et al.
4,141,333 A 2/1979 Gilbert
4,151,817 A 5/1979 Mueller
4,152,953 A 5/1979 Headley
4,164,917 A 8/1979 Glasson
4,167,931 A 9/1979 Iizuka
4,173,209 A 11/1979 Jordan
4,173,954 A 11/1979 Speckhart
4,175,534 A 11/1979 Jordan
4,184,464 A 1/1980 Svihlik
4,188,933 A 2/1980 Iizuka
4,191,142 A 3/1980 Kodama 4,192,263 A 3/1980 Kitagawa et al.
4,200,081 A 4/1980 Meyer et al.
4,203,397 A 5/1980 Soeters, Jr.
4,204,814 A 5/1980 Matzen
4,206,734 A 6/1980 Perr et al.
4,207,775 A 6/1980 Lintott
4,213,442 A 7/1980 Mihalic
4,221,199 A 9/1980 Buuck et al.
4,221,200 A 9/1980 Soeters, Jr.
4,221,201 A 9/1980 Soeters, Jr.
4,222,354 A 9/1980 Uitvlugt
4,222,793 A 9/1980 Grindahl
4,227,149 A 10/1980 Faure et al.
4,227,494 A 10/1980 Uitvlugt
4,227,495 A 10/1980 Krieg
4,228,771 A 10/1980 Krieg
4,230,076 A 10/1980 Mueller
4,231,267 A 11/1980 Van Slooten
4,237,832 A 12/1980 Hartig et al.
4,245,596 A 1/1981 Bruder et al.
4,249,488 A 2/1981 Siegla
4,249,489 A 2/1981 Bruder et al.
4,252,093 A 2/1981 Hazelrigg
4,256,070 A 3/1981 Mueller
4,258,671 A 3/1981 Takizawa et al.
4,258,673 A 3/1981 Stoody, Jr. et al.
4,262,640 A 4/1981 Clark
4,284,042 A 8/1981 Springer
4,285,310 A 8/1981 Takizawa et al.
4,305,356 A 12/1981 Walsh
4,325,589 A 4/1982 Hirt
4,326,484 A 4/1982 Amrhein
4,335,685 A 6/1982 Clouse
4,336,775 A 6/1982 Meyer
4,337,738 A 7/1982 Bubniak et al.
4,338,894 A 7/1982 Kodama
4,356,799 A 11/1982 Clark
4,361,120 A 11/1982 Kueny
4,362,991 A 12/1982 Carbine
4,363,300 A 12/1982 Honda
4,367,701 A 1/1983 Buente
4,369,627 A 1/1983 Kasting et al.
4,380,219 A 4/1983 Walsh
4,385,599 A 5/1983 Hori et al.
4,387,674 A 6/1983 Connell
4,387,675 A 6/1983 Hori et al.
4,387,680 A 6/1983 Tsunetomi et al.
4,397,270 A 8/1983 Aoyama
4,401,064 A 8/1983 Nakamura et al.
4,402,285 A 9/1983 Arai et al.
4,406,257 A 9/1983 Keske et al.
4,408,580 A 10/1983 Kosuda et al.
4,411,229 A 10/1983 Curtis et al.
4,414,935 A 11/1983 Curtis et al.
4,437,439 A 3/1984 Speil
4,437,738 A 3/1984 Headley et al.
4,438,736 A 3/1984 Hara et al.
4,440,121 A 4/1984 Clancy et al.
4,442,806 A 4/1984 Matsuura et al.
4,448,155 A 5/1984 Hillebrand et al.
4,448,156 A 5/1984 Henault
4,452,187 A 6/1984 Kosuda et al.
4,457,270 A 7/1984 Kodama et al.
4,459,946 A 7/1984 Burandt
4,462,353 A 7/1984 Arai et al.
4,462,364 A 7/1984 Kodama
4,463,714 A 8/1984 Nakamura
4,465,038 A 8/1984 Speil
4,466,390 A 8/1984 Babitzka et al.
4,469,061 A 9/1984 Ajiki et al.
4,475,489 A 10/1984 Honda
4,475,497 A 10/1984 Honda et al.
4,480,617 A 11/1984 Nakano et al.
4,481,913 A 11/1984 Wirth
4,481,919 A 11/1984 Honda et al.
4,483,281 A 11/1984 Black
4,484,546 A 11/1984 Burandt
4,488,520 A 12/1984 Almor
4,498,432 A 2/1985 Hara et al.
4,499,870 A 2/1985 Aoyama
4,502,425 A 3/1985 Wride
4,502,428 A 3/1985 Paar
4,503,818 A 3/1985 Hara et al.
4,506,635 A 3/1985 van Rinsum
4,509,467 A 4/1985 Arai et al.
4,515,121 A 5/1985 Matsuura et al.
4,515,346 A 5/1985 Gaterman, III
4,517,936 A 5/1985 Burgio di Aragona
4,519,345 A 5/1985 Walter
4,523,550 A 6/1985 Matsuura
4,524,731 A 6/1985 Rhoads
4,526,142 A 7/1985 Hara et al.
4,534,323 A 8/1985 Kato et al.
4,535,732 A 8/1985 Nakano et al.
4,537,164 A 8/1985 Ajiki et al.
4,537,165 A 8/1985 Honda et al.
4,539,951 A 9/1985 Hara et al.
4,541,878 A 9/1985 Mühlberger et al.
4,545,342 A 10/1985 Nakano et al.
4,546,734 A 10/1985 Kodama
4,549,509 A 10/1985 Burtchell
4,556,025 A 12/1985 Morita
4,559,909 A 12/1985 Honda et al.
4,561,393 A 12/1985 Kopel
4,567,861 A 2/1986 Hara et al.
4,570,582 A 2/1986 Speil
4,576,128 A 3/1986 Kenichi
4,579,094 A 4/1986 Döppling et al.
4,584,974 A 4/1986 Aoyama et al.
4,584,976 A 4/1986 Hillebrand
4,587,936 A 5/1986 Matsuura et al.
4,589,383 A 5/1986 Showalter
4,589,387 A 5/1986 Miura et al.
4,590,898 A 5/1986 Buente et al.
RE32,167 E 6/1986 Buente
4,596,213 A 6/1986 Hillebrand
4,602,409 A 7/1986 Schaeffler
4,607,599 A 8/1986 Buente et al.
4,611,558 A 9/1986 Yoshizaki et al.
4,612,884 A 9/1986 Ajiki et al.
4,614,171 A 9/1986 Malhotra
4,615,306 A 10/1986 Wakeman
4,615,307 A 10/1986 Kodam et al.
4,624,223 A 11/1986 Wherry et al.
4,628,874 A 12/1986 Barlow
4,633,827 A 1/1987 Buente
4,635,593 A 1/1987 Kodama
4,637,357 A 1/1987 Ohmi
4,638,773 A 1/1987 Bonvallet
4,643,141 A 2/1987 Bledsoe
4,648,360 A 3/1987 Schaeffler
4,653,441 A 3/1987 Belsanti
4,655,176 A 4/1987 Sheehan
4,656,977 A 4/1987 Nagahiro et al.
4,671,221 A 6/1987 Geringer et al.
4,674,451 A 6/1987 Rembold et al.
4,677,723 A 7/1987 Greene, Sr.
4,690,110 A 9/1987 Nishimura et al.
4,693,214 A 9/1987 Titolo
4,694,788 A 9/1987 Craig
4,696,265 A 9/1987 Nohira
4,697,473 A 10/1987 Patel 4,699,094 A 10/1987 Stegeman
4,704,995 A 11/1987 Soeters, Jr.
4,708,102 A 11/1987 Schmid
4,711,202 A 12/1987 Baker
4,711,207 A 12/1987 Bonvallet
4,716,863 A 1/1988 Pruzan
4,718,379 A 1/1988 Clark
4,724,802 A 2/1988 Ishii
4,724,804 A 2/1988 Wirth
4,724,822 A 2/1988 Bonvallet
4,726,332 A 2/1988 Nishimura et al.
4,727,830 A 3/1988 Nagahiro et al.
4,727,831 A 3/1988 Nagahiro et al.
4,738,231 A 4/1988 Patel et al.
4,741,297 A 5/1988 Nagahiro et al.
4,741,298 A 5/1988 Rhoads
4,745,888 A 5/1988 Kapp
4,747,376 A 5/1988 Speil et al.
4,756,282 A 7/1988 Kunz et al.
4,759,321 A 7/1988 Matsumoto et al.
4,759,322 A 7/1988 Konno
4,762,096 A 8/1988 Kamm et al.
4,765,288 A 8/1988 Linder et al.
4,765,289 A 8/1988 Masuda et al.
4,768,467 A 9/1988 Yamada et al.
4,768,475 A 9/1988 Ikemura
4,771,741 A 9/1988 Leer
4,771,742 A 9/1988 Nelson et al.
4,773,359 A 9/1988 Titolo
4,779,583 A 10/1988 Laffter et al.
4,779,589 A 10/1988 Matsuura et al.
4,782,799 A 11/1988 Goppelt et al.
4,784,095 A 11/1988 Golding et al.
4,787,347 A 11/1988 Schaeffler
4,790,274 A 12/1988 Inoue et al.
4,791,895 A 12/1988 Tittizer
4,793,295 A 12/1988 Downing
4,793,296 A 12/1988 Inoue et al.
4,796,483 A 1/1989 Patel et al.
4,796,573 A 1/1989 Wakeman et al.
4,799,463 A 1/1989 Konno
4,800,850 A 1/1989 Yoshida et al.
4,802,448 A 2/1989 Ableitner
4,803,334 A 2/1989 Burke et al.
4,805,567 A 2/1989 Heimburg
4,809,651 A 3/1989 Gerchow et al.
4,815,424 A 3/1989 Buuck et al.
4,825,717 A 5/1989 Mills
4,825,823 A 5/1989 Schaeffler
4,829,948 A 5/1989 Yoshida et al.
4,840,153 A 6/1989 Aida et al.
4,844,022 A 7/1989 Konno
4,844,023 A 7/1989 Konno et al.
4,848,180 A 7/1989 Mills
4,848,285 A 7/1989 Konno
4,850,311 A 7/1989 Shon
4,858,574 A 8/1989 Fukuo et al.
4,867,114 A 9/1989 Schaeffler
4,869,214 A 9/1989 Inoue et al.
4,872,429 A 10/1989 Anderson et al.
4,876,944 A 10/1989 Wilson et al.
4,876,994 A 10/1989 Speil et al.
4,876,997 A 10/1989 Zorn et al.
4,883,027 A 11/1989 Oikawa et al.
4,887,561 A 12/1989 Kishi
4,887,563 A 12/1989 Ishida et al.
4,887,566 A 12/1989 Shida
4,896,635 A 1/1990 Willermet et al.
4,899,701 A 2/1990 Inoue et al.
4,905,639 A 3/1990 Konno
4,909,195 A 3/1990 Hasebe et al.
4,909,197 A 3/1990 Perr
4,917,056 A 4/1990 Yagi et al.
4,917,059 A 4/1990 Umeda
4,919,089 A 4/1990 Fujiyoshi et al.
4,920,935 A 5/1990 Shida
4,921,064 A 5/1990 Wazaki et al.
4,924,821 A 5/1990 Teerman
4,926,804 A 5/1990 Fukuo
4,930,465 A 6/1990 Wakeman et al.
4,940,048 A 7/1990 Mills
4,944,257 A 7/1990 Mills
4,951,619 A 8/1990 Schaeffler
4,957,076 A 9/1990 Inoue et al.
4,959,794 A 9/1990 Shiraishi et al.
RE33,411 E 10/1990 Inoue et al.
4,969,102 A 11/1990 Tamura et al.
4,971,164 A 11/1990 Fujita et al.
4,977,867 A * 12/1990 Rhoads ..... 123/90.49
4,986,166 A * 1/1991 Shida ..... 92/52
4,986,227 A 1/1991 Dewey, III
4,993,150 A 2/1991 Reinhardt et al.
4,995,281 A 2/1991 Allor et al.
5,003,939 A 4/1991 King
5,010,856 A 4/1991 Ojala
5,010,857 A 4/1991 Hempelmann et al.
5,018,487 A 5/1991 Shinkai
5,022,356 A 6/1991 Morel, Jr. et al.
5,025,761 A 6/1991 Chen
5,028,281 A 7/1991 Hayes et al.
5,033,420 A 7/1991 Mayayoshi et al.
5,036,807 A 8/1991 Kaneko
5,040,651 A 8/1991 Hampton et al.
5,042,436 A 8/1991 Yamamoto et al.
5,042,437 A 8/1991 Sakuragi et al.
5,046,462 A 9/1991 Matayoshi et al.
5,048,475 A 9/1991 Mills
5,069,173 A 12/1991 Mallas
5,070,827 A 12/1991 Krieg et al.
5,074,260 A 12/1991 Yagi et al.
5,074,261 A 12/1991 Hamburg et al.
5,080,053 A 1/1992 Parsons
5,088,455 A 2/1992 Moretz
5,090,364 A 2/1992 McCarroll et al.
5,099,806 A 3/1992 Murata et al.
5,099,807 A 3/1992 Devine
5,107,806 A 4/1992 Döhring et al.
5,113,813 A 5/1992 Rosa
RE33,967 E 6/1992 Honda et al.
5,119,774 A 6/1992 Krieg et al.
5,127,374 A 7/1992 Morel, Jr. et al.
5,129,373 A 7/1992 Cuatt et al.
5,148,783 A 9/1992 Shinkai et al.
5,150,672 A 9/1992 Fischer et al.
5,161,493 A 11/1992 Ma
5,163,389 A 11/1992 Fujikawa et al.
5,178,107 A 1/1993 Morel, Jr. et al.
5,181,485 A 1/1993 Hirose et al.
5,184,581 A 2/1993 Aoyama et al.
5,186,130 A 2/1993 Melchior
5,188,067 A 2/1993 Fontichiaro et al.
5,188,068 A 2/1993 Gaterman, III et al.
5,189,997 A 3/1993 Schneider
5,193,496 A 3/1993 Kruger
5,199,393 A 4/1993 Baldassini
5,239,951 A 8/1993 Rao et al.
5,247,913 A 9/1993 Manolis
5,253,621 A 10/1993 Dopson et al.
5,259,346 A 11/1993 Mills
5,261,361 A 11/1993 Speil
5,263,386 A 11/1993 Campbell et al.
5,273,005 A 12/1993 Philo et al.

5,287,830 A 2/1994 Dopson et al.
5,301,636 A 4/1994 Nakamura
5,307,769 A 5/1994 Meagher et al.
5,320,082 A 6/1994 Murata et al.
5,343,833 A 9/1994 Shirai
5,345,898 A 9/1994 Krebs
5,347,965 A 9/1994 Decuir
5,351,662 A 10/1994 Dopson et al.
5,353,756 A 10/1994 Murata et al.
5,357,916 A 10/1994 Matterazzo
5,361,733 A 11/1994 Spath et al.
5,365,896 A 11/1994 Hara et al.
5,379,730 A 1/1995 Schaeffler
5,385,124 A 1/1995 Hillebrand et al.
5,386,806 A 2/1995 Allen et al.
5,394,843 A 3/1995 Decuir
5,398,648 A 3/1995 Spath et al.
5,402,756 A 4/1995 Bohme et al.
5,419,290 A 5/1995 Hurr et al.
5,429,079 A 7/1995 Murata et al.
5,430,934 A 7/1995 Groh et al.
5,431,133 A 7/1995 Spath et al.
5,454,353 A 10/1995 Elendt et al.
5,501,186 A 3/1996 Hara et al.
5,509,385 A 4/1996 LaVieri
5,520,144 A 5/1996 Philo et al.
5,544,626 A 8/1996 Diggs et al.
5,546,899 A 8/1996 Sperling et al.
5,549,081 A 8/1996 Ohlendorf et al.
5,553,584 A 9/1996 Konno
5,555,861 A 9/1996 Mayr et al.
5,560,265 A 10/1996 Miller
5,560,329 A 10/1996 Hayman
5,566,652 A 10/1996 Deppe
5,584,268 A 12/1996 Natkin et al.
5,592,907 A 1/1997 Hasebe et al.
5,603,294 A 2/1997 Kawai
5,613,469 A 3/1997 Rygiel
5,642,694 A 7/1997 Dura et al.
5,651,335 A 7/1997 Elendt et al.
5,653,198 A 8/1997 Diggs
5,655,487 A 8/1997 Maas et al.
5,655,488 A 8/1997 Hampton et al.
5,660,153 A 8/1997 Hampton et al.
5,673,661 A 10/1997 Jesel
5,678,514 A 10/1997 Mazzella et al.
5,697,333 A 12/1997 Church et al.
5,706,773 A 1/1998 Dura et al.
5,746,165 A 5/1998 Speil et al.
5,775,275 A 7/1998 Philio
5,797,364 A 8/1998 Meek et al.
5,806,475 A 9/1998 Hausknecht
5,875,748 A 3/1999 Haas et al.
5,893,344 A 4/1999 Church
5,901,676 A * 5/1999 Edelmayer ..... 123/90.35
5,908,015 A 6/1999 Kreuter
5,924,396 A 7/1999 Ochiai et al.
5,934,232 A 8/1999 Greene et al.
5,960,756 A 10/1999 Miyachi et al.
5,983,848 A 11/1999 Calka
6,006,706 A 12/1999 Kanzaki
6,032,624 A 3/2000 Tsuruta et al.
6,058,895 A 5/2000 Hermsen
6,092,497 A 7/2000 Preston et al.
6,186,101 B1 2/2001 Kreuter
6,196,175 B1 3/2001 Church
6,273,039 B1 8/2001 Church
6,318,325 B1 * 11/2001 Lechner ..... 123/90.55
6,321,704 B1 11/2001 Church et al.
6,321,705 B1 11/2001 Fernandez et al.
6,325,030 B1 12/2001 Spath et al.
6,325,034 B1 * 12/2001 Edelmayer ..... 123/90.43
6,328,009 B1 12/2001 Brothers
6,418,904 B2 7/2002 Hannon
6,439,179 B2 8/2002 Hendriksma et al.
6,513,470 B1 2/2003 Hendriksma et al.
2003/0196620 A1 10/2003 Spath

OTHER PUBLICATIONS

"GM Technology," Daniel J. Heft, Service Tech Magazine, July 2001, 01477–01479.
"Eaton adds variability to Displacement on Demand", Frank Bokulich, Automotive Engineering International Tech Brief, January 2002, 01480–01483.
Prints, Mar. 14, 2000, 01484–01485.
Prints, Nov. 30, 2000, 01486–01494.
Print, Feb. 25, 2000, 01495.
Confidentiality Agreement. Jul. 8, 2003, 01496–01499.
E–mail communications, Jan. 3, 2002 to Apr. 4, 2002, 01500–01510.
"Hydraulic Valve Lifter," Delphi, Jul. 2, 2002, 01511–01513.
E–mail communications, Oct. 23, 2001 to Oct. 25, 2001, 01514.
Interoffice Memorandum. Nov. 6, 2001, 01515–01516.
Interoffice Memorandum, Aug. 27, 2001, 01517–01528.
Correspondence, Fred Wasco. Jul. 16, 2001, 01529–01530.
Interoffice Memorandum, Undated, 01531–01534.
Correspondence, Dhruva Mandal, Aug. 3, 2001, 01535–01543.
Correspondence, Regis J. Leonard, Nov. 1,2000, 01544.
E–mail communications, Sep. 28, 2001, 01545.
E–mail communication, Jerry Giessinger, Nov. 29, 2001, 01546.
E–mail communcation, Fred Wasco, Jul. 24, 2001, 01547.
Meeting Agenda, Aug. 2, 2001, 01548.
E–mail communication, Jerry Giessinger, Jun. 25, 2001, 01549.
Handwritten notes, Undated, 01550–01551.
E–mail communications, Kojo Annan, Feb. 8, 2002, 01555.
Handwritten Notes, Undated, 01550–01551.
Calendar, Jul. 2001–Dec. 2001, 0157–01562.
Prints, Jul. 16, 2001, 01563–01565.
PrInts, Aug. 24, 2001, 01566.
Prints, Jul. 16, 2001, 01567.
Prints, Aug. 24, 2001, 01568.
Report, Undated, 01569.
Notes, Undated, 01570.
Cost Estimate, Undated, 01571.
PrInts, Jul. 17, 2001, 01572–01573.
E–mail communications, Feb. 27, 2002 –Apr. 4, 2002, 01574–01578.
E–mail communications, Jerry Giessinger, Jun. 25, 2001, 01579–01580.
E–mail communications, Fred Wasco, Jul. 24, 2001, 01581.
Inspection Report, Feb. 2002, 01582–01609.
Prints, Jan. 16, 2002, 01610.
Inspection Report. Jan. 30, 2002, 01611.
E–mail communications, Ed Spangler, Feb. 3, 2002, 01612.
Inspection Report, Jan. 31, 2002, 01613–01617.
E–mail communications. Jerry Giessinger, Jun. 29, 2001, 01618.
E–mail communications, Fred Wasco, Feb. 5, 2002, 01619.
Document relating to dimensions, Jan. 30, 2002, 01621–01624.

E–mail communications, Nalin Patel, Jan. 31, 2002, 01625.
Document relating to dimensions, Jan. 30, 2002, 01621–01624.
Handwritten notes, Feb. 4, 2002, 01631.
E–mail communications, Fred Wasco, Jun. 29, 2001, 01632.
E–mail communications, Kojo Annan, Feb. 27, 2002, 01633.
E–mail communications, Dhruva Mandal, Jul. 18, 2001, 01634.
Correspondence, Dhruva Mandal, Jun. 15, 2001, 01635–01638.
E–mail communications, Jerry Giessinger, Jan.28, 2002, 01639.
Prints, Aug. 24, 2001, 01640.
Prints, Jul. 16, 2001, 01641.
Prints, Jun. 7, 2001, 01641.
Prints, Jun. 17, 2000, 01642.
Prints, Jan. 16, 2002, 01644.
Prints, Jul. 17, 2000, 01645–01646.
E–mail communications, Kojo Annan, Mar. 19, 2002, 01647–01650.
E–mail communications, Dhruva Mandal, Feb. 27, 2002, 01651–01652.
E–mail communications, Jerry Glesslnger, Jan. 9, 2002, 01653.
E–mail communications, Jerry Giessinger, Oct. 25, 2001, 01654.
Interoffice communication, Undated, 01655.
Purchase Order, Oct.18. 2001, 01656–01658.
Purchase Order, Feb. 7, 2002, 01659–01661.
Correspondence, Jerry Giessinger, Sep. 11, 2001, 01662–01701.
MacLean–Fogg Quotation Cover, 01702.
Prints, Jun. 17, 2000, 01703.
Prints, May 30, 2001, 01704.
Drawings, Undated, 01705.
MacLean–Fogg Quotation Cover, Jul. 30, 2001, 01706–01707.
Correspondence, Karen Allread, Jul. 27, 2001, 01708.
Interoffice correspondence, Aug. 6, 2001, 01709.
Prints, Jun. 21, 1999, 01710.
Meeting Minutes, Aug. 21, 2001, 01711.
Interoffice Memorandum, Jerry Giessinger, Aug. 22, 2001, 01712–01713.
Cost Estimate, Undated, 01714.
Notes, Undated, 01715.
Estimates, Aug. 17, 2001, 01716.
Draft correspondence, Aug. 17, 2001, 01717.
E–mail communications, Mike Fallow, Aug. 10, 2001, 01718.
Interoffice correspondence, Dean Williams, Aug.15, 2001, 01719.
Interoffice correspondence, Aug. 30, 2001, 01720.
Prints, Jun. 21, 1999, 01721.
Handwritten notes, Undated, 01722.
Interoffice correspondence, Aug. 17, 2001, 01723.
Cost Estimate, Aug. 17, 2001, 01724.
Prints, Jun. 21, 1999, 01725.
Prints, Sep. 5, 2001, 01726.
Prints, Nov. 22, 2000, 01727.
Handwritten notes, Undated, 01728.
Notes, July 26, 2001, 01729.
Interoffice correspondence, Aug. 17, 2001, 01730.
Cost Estimate, Undated, 01731.
Prints, Jul. 16, 2001, 01732.
Notes, Jul. 26, 2001, 01733.
Interoffice correspondence, Aug. 17, 2001, 01734–01750.
Correspondence, Jerry Giessenger, Sep. 11,2001, 01751–01764.
Interoffice correspondence, Undated, 01765.
Meeting Summary, Undated, 01766.
Prints, Aug. 24, 2001, 01767.
Prints, Jul.17, 2001, 01768.
Prints, Sep. 5, 2001, 01769.
Prints, Jul.16, 2001, 01770.
Prints, Jun. 21, 1999, 01771.
Handwritten notes, 01772–01774.
Correspondence. Jerry Giessinger, Sep. 11, 2001, 01775–01788.
Prints, Sep. 9, 2001, 01789–01792.
E–mail communications. Karen Allread, Oct. 4, 2001, 01793–01794.
Interoffice Memorandum. Oct. 4, 2001, 01795.
E–mail communications. Jerry Giessinger. Oct. 3, 2001, 01796–01797.
E–mail communications, David Britton, Aug. 27, 2001, 01798–1799.
Draft correspondence, Jerry Giessinger, Undated, 01800.
E–mail communications, Jerry Giessinger, Aug. 27, 2001, 01801 –01802.
Mactean–Fogg Quotation Cover, Jul. 30, 2001, 01803–01804.
Cost Estimate, Aug. 6, 2001, 01805.
Correspondence, Karen Allread, Jul. 27, 2001, 01806.
Prints, Nov. 22, 2000, 01807.
MacLean–Fogg Quotation Cover, Jul. 30, 2001, 01808 – 01809.
Cost Estimate, Aug. 6, 2001, 01810.
Correspondence, Karen Allread, Jul. 30, 2001, 01811.
Prints, Jul. 16, 2001, 01812.
MacLean–Fogg Quotation Cover, Jul. 30, 2001, 01813–01814.
Cost Estimate, Aug. 6, 2001, 01815.
Correspondence, Karen Allread, Jul. 30, 2001, 01816.
Prints, Jul. 16, 2001, 01817.
MacLean–Fogg Quotation Cover, Jul. 30, 2001, 01818–01819.
Cost Estimate, Aug. 6, 2001, 01820.
Correspondence, Karen Allread, Jul. 27, 2001, 01821.
PrInts, Jul. 17, 2001, 01822.
Deact Program Quote, Undated, 01823.
Notes, Undated, 01824.
Cost Estimate, Aug. 17, 2001, 01825 –01826.
Interoffice communications, Undated, 01827–01828.
Dead Program Quote, Undated, 01829 –01830.
Report, Jul. 1, 2002, 01831.
Meeting Minutes, Ed Spangler, Nov. 30. 2001, 01832–01833.
Meeting Minutes, Jerry Glessenger. Nov. 30, 2001, 01834.
Meeting Agenda, Nov. 30, 2001, 01835.
Prints, Aug. 1, 2OO1, 01836.
Prints, Jul. 25, 2001, 01837.
Prints, Aug. 20, 2001, 01838.
Rofler Lifter Body Powerpoint, Feb. 6, 2002, 01839–01843.
Prints, Aug. 20, 2001, 01844–01849.
Flyer, Undated, 01850–01851.
Engineering Change Notice, Feb. 2, 1989, 01852.
Prints, Jan. 26, 1989, 01853–01854.

Purchase Order, Nov. 13, 1989, 01855.
Prints, Oct. 7, 1985, 01858.
Prints, May 1,1985, 01857.
Correspondence, Herb Earl, Feb. 6,1986, 01858.
Prints, May 31, 1985, 01859.
Prints, Mar. 6, 1986, 01860.
Interoffice Memorandum, Mar. 5, 1986, 01861.
Prints, Oct. 7, 1985, 01862–01863.
Prints, Feb. 20, 1989, 01884.
Prints, Jan. 29,1986, 01865.
Prints, Mar. 6, 1986, 01866.
Production Order Schedule, Jul. 19, 1993, 01867–01868.
Correspondence, Jerry Giesslnger, Feb. 7, 2002, 01869–01870.
Correspondence, Fred Wasco, Jul. 16, 2001, 01871–01872.
E–mail communications, Fred Wasco, Sep. 7, 2001, 01873.
E–mail communications, Jerry Giessinger, Jan. 3, 2002, 01874.
E–mail communications. Jerry Giessinger. Jan. 4, 2002, 01875.
E–mail communications, Jerry Giessinger, Jan. 3, 2002, 01876–01877.
Summary of MacLean–Fogg Tooling Issues, Undated , 01878.
Cost Estimate, May 31, 2001, 01879.
Interoffice Communications, Oct. 12. 2001, 01880.
Machine Rates, Undated, 01881.
Interoffice Communications, Oct. 12, 2001, 01882.
Cost Estimate, Oct.12, 2001, 01883.
E–mail communications, Jerry Giessinger, Jun. 29, 2001, 01884.
Cost Estimate, Undated, 01885.
E–mail communications, Free Markets Inc., May 30, 2001, 01886.
Cost Estimate. Undated, 01887.
Self Assessment Checklist, Feb. 1, 2000, 01888.
Cost Breakdown, Jun. 6, 2001, 01889–01890.
Automatic Screw Machine, Undated, 01891.
Cost Breakdown, Jun. 6, 2001, 01892.
Free Markets Documents, May 10, 2001, 01893–01899.
Self Assessment Checklist, Undated, 01900.
E–mail communications, Jun. 7, 2001, 01901–01902.
Free Markets Documents, May 31.2001 01903–01913
E–mail communications, David Howes, May 25, 2001, 01914.
Free Markets Documents, May 15, 2001, 01915–01916.
E–mail communications, David Howes, May 31, 2001, 01917.
Cost Estimate, May 31, 2001, 01918.
Worksheet, Undated, 01919.
MacLean–Fogg Quotation Cover, May 30, 2001, 01920.
Prints, May 30, 2001, 01921.
Prints, Mar. 14, 2000, 01922.
Free Markest Documents, May 31, 2001, 01923–01925.
Correspondence, Nov. 2, 2001, 01926–01927.
E–mail communications, Jerry Giessinger, Dec. 2, 2001, 01928.
Correspondence, Oct. 17, 2001, 01929.
Handwritten notes, Nov. 6, 2001, 01930.
Correspondence, Oct. 17, 2001, 01931.
Correspondence, Oct. 23, 2001, 01932–01934.
Correspondence, Oct. 17, 2001, 01935.
Cost Estimate, May 31, 2001, 01936–01940.
Handwritten notes, Undated, 01941.
Cost Estimate, May 31, 2001, 01942–01944.
MacLean–Fogg Quotation Cover, May 30, 2001, 01945.
Prints, Jul. 17, 2000, 01946.
Prints, May 30, 2001, 01947.
Worksheet, Undated, 01948.
E–mail communications, Tom Richardson, May 31, 2001, 01949.
Prints, Jul. 17, 2000, 01950.
Line Item Details, Undated, 01951.
Prints, Mar. 14, 2000, 01952.
Prints, Nov. 30, 2000, 01953–01961.
Prints, Feb. 25, 2000, 01962.
Handwritten notes, Undated, 01963.
Free Markets Documents, Feb. 6, 2002, 01964–01965.
Prints, Jun. 21, 1999, 01966–01967.
Cost Estimate, Undated, 01968–01973.
E–mail communications, Jaime Steele, Feb. 4, 2002, 01974.
Free Markets Documents, Feb. 7, 2002, 01975 –01985.
Free Markets Documents, Jan. 31, 2002, 01986.
Free Markets Documents, Feb. 6, 2002, 01987.
Free Markets Documents, Jan. 9, 2002, 01988–02010.
Correspondence, Jan. 31, 2002, 02011–02014.
Cost Estimate, Aug.17, 2001, 02015–02018.
Free Markets Documents, Jan. 31, 2002, 02019.
Material Specification, Mar. 17, 1999, 02020–02024.
Purchase Order Terms and Conditions, Undated, 02025 – 02032.
Free Market Documents, Undated, 02033–02034.
Prints, Dec. 12, 2001, 02035.
Free Market Documents, Undated, 02036.
Pnnts, Dec. 17, 2001, 02037.
Free Market Documents, Undated, 02038.
Prints, Jun. 21, 1999, 02039.
Free Market Documents, Undated, 02040.
Prints, Jun. 21, 1999, 02041.
Free Markets Documents, Undated, 02042.
Prints, Dec. 10, 2001, 02043.
Free Markets Documents, Undated, 02044.
Prints, Dec. 7, 2001, 02045.
Free Markets Documents, Undated, 02046.
Prints, Dec. 10, 2001, 02047.
Pnnts, Dec. 7, 2001, 02048.
E–mail communications, Jaime Steele, Jan. 29, 2002, 02049.
E–mail communications. Rudy Lang, Sep. 19, 2001, 02050.
Correspondence, Aug. 30, 2001, 02051.
Quotation Request, Sep. 14, 2001, 02052.
Prints, Jul. 16, 2001, 02053.
Prints, Nov. 22, 2000, 02054.
Prints, Jul. 17, 2001, 02055.
Prints, Jun. 21, 1999, 02956.
Prints, Jul. 16, 2001, 02057.
Quotation, Waltz Brothers Inc., Jan. 31, 2002, 02058–02060.
Quotation, Bodycoat, Sep. 24, 2001, 02061.
Quotation Request, Sep. 14, 2001, 02062.
Prints, Jul. 16, 2001, 02063.
Prints, Nov. 22, 2000, 02064.
Prints, Jul. 17, 2001, 02065.
Prints, Jun. 21, 1999. 02066.
Prints, Jul. 16, 2001, 02067.
Interoffice communications, Sep.14, 2001, 02068.
Quote, Amac Enterprises Inc., Sep. 22, 2001, 02069.
Quotation Request, Sep. 14, 2001, 02070.
Prints, Jul. 16, 2001, 02071.

Prints, Nov. 22, 2000, 02072.
Prints, Jul. 17, 2001, 02073.
Prints, Jun 21, 1999, 02074.
Prints, Jul. 16, 2001, 02075.
Interoffice communication, Sep. 14, 2001, 02076.
Draft correspondence, Jerry Giessinger, Aug. 17, 2001, 02077.
Interoffice communication, Undated, 02078–02079.
Cost Estimate, Aug.17, 2001, 02080.
MacLean–Fogg Quotation Cover, Jul. 31, 2001, 02081.
Prints, Jun. 21, 1999, 02082.
Correspondence, Karen Allready. Jul. 27, 2001, 02083.
MacLean–Fogg Quotation Cover, Jul. 30, 2001, 02084–02085.
Cost Estimate, Aug. 6, 2001, 02086.
Correspondence, Karen Allread, Jul. 27, 2001, 02087.
Prints, Jun. 21, 1999, 02088–02089.
MacLean–Fogg Quotation Cover, Jul. 30, 2001, 02090.
Correspondence, Karen Allread, Jul. 27, 2001, 02091.
Cost Estimate, Aug. 17. 2001, 02092.
MacLean–Fogg Quotation Cover, Jul. 30, 2001, 02093.
Quotation Request and Routing Form, Jul. 30, 2001, 02094.
Cost Estimate, Aug. 6, 2001, 02095.
Correspondence, Jul. 30, 2001, 02096.
Prints, Jul. 16, 2001, 02097–2098.
MacLean–Fogg Quotation Cover, Jul. 30, 2001, 02099.
Correspondence, Karen Allread, Jul. 27, 2001, 02100.
Cost EstImate, Aug. 17, 2001, 02101.
MacLean–Fogg Quotation Cover, Jul. 31, 2001, 02102.
Quotation Request and Routing Form, Jul. 30, 2001, 02103.
Cost Estimate, Aug. 6, 2001, 02104.
Prints, Jul. 17, 2001, 02105.
Correspondence, Karen Allread, Jul. 27, 2001, 02106.
PrInts, Jul. 17, 2001, 02107.
Cost Estimate, Aug. 17, 2001, 02108.
MacLean–Fogg Quotation Cover, Jul. 31, 2001, 02109.
Correspondence, Karen Allread, Jul. 27, 2001, 02110.
MacLean–Fogg Quotation Cover, Jul. 30, 2001, 02111.
Quotation Request and Routing Form, Jul. 30, 2001, 02112.
Cost Estimate. Aug. 6, 2001, 02113.
Correspondence, Karen Allread, Jul. 27, 2001, 02114.
Pnnts, Nov. 22. 2000, 02115–02116.
Cost Estimate, Aug. 17, 2001, 02117.
MacLean–Fogg Quotation Cover, Jul. 30, 2001, 02118.
Correspondence, Karen Allready, Jul. 27, 2001.
MacLean–Fogg Quotation Cover, Jul. 30, 2001, 02120.
Quotation Request and Routing Form, Jul. 30, 2001, 02121.
Cost Estimate, Aug. 6, 2001, 02122.
Correspondence, Karen Allready, Jul. 27, 2001, 02123.
Prints, Jul. 16, 2001, 02124–02125.
Supplier Quality Assurance Spefication, Sep. 1, 1985, 02126–02133.
Correspondence, Precise Metal Forming Products Inc., May 12, 1992, 02134.
Handwritten notes, Undated, 02135.
Correspondence, Joe Paganini, Oct. 17, 1986, 02136.
Correspondence, Dan Berg, Dec. 13, 1989, 02137–02138.
Correspondence, Sep. 7, 1976, 02139.
Handwritten Notes, Feb. 3, 1989, 02140.
Interoffice Memorandum, Herb Earl, May 27,1992, 02141.
Correspondence, W. Lukens Ward, Mar. 13, 1988, 02142.
Correspondence, W. Luken Ward, Mar. 13, 1988, 02143.
Interoffice Correspondence, Dan Berg, Feb. 26, 1988, 02144.
Interoffice Memorandum, Herman Koestring, Jul. 5, 1998, 02145.
Interoffice Correspondence, Dan Berg, Jan. 13, 1998, 02146.
Interoffice Memorandum, Herman Koestrlng, Feb. 24, 1986, 02147.
Correspondence, James E. Shea, Mar. 12, 1987, 02148.
Interoffice Memorandum, Herb Earl, Feb. 27, 1985, 02149–02150.
Capability Analysis, Oct. 25,1986, 02151–02153.
Interoffice Memorandum, Herb Earl, Sep. 20, 1986, 02154.
Correspondence, W. Lukens Ward, Mar. 21, 1986, 02155–02156.
Quality Assurance Finding, Herb Earl, Mar. 21, 1986, 02157–02164.
Correspondence, Ron Frankel, Apr. 10, 1989, 02165.
Prints, Jul. 15, 1988, 02166.
Correspondence, Herb Earl, Jul. 23. 1984, 02167–02168.
Correspondence, Bob McCormIck, May 18, 1990, 02169–02170.
Correspondence, Jul. 17,1990, 02171–02176.
Interoffice Report, Dan Berg, Oct. 2, 1986, 02177–02179.
Correspondence, Dan Berg, Undated, 02180.
Correspondence, Tadao, Undated, 02181.
Note, Dan Berg, Jan.14, 1985, 02182.
Notes, Undated, 02183.
Notes, Dan Berg, Jan. 9, 1984, 02184.
Correspondence, Ron Frankel, Feb. 18, 1985, 02185.
Invoice, Sep. 13, 1984, 02186.
Notes, Jan. 31, 1985, 02187.
Correspondence, Herb Earl, Jan. 4, 1985, 02188.
Notes, Herb Earl, Jan. 4, 1985, 02189.
Invoice, Feb. 18, 1988, 02190–2192.
Interoffice Memorandum, W.B. Hamilton, May 20, 1985, 02193–02194.
Report, Feb. 14, 1990, 02195.
Inspection Report, M. Stewart, Sep. 20, 1986, 02196–02200.
Report, Nov. 5, 1988, 02201.
Report, Feb. 2, 1989, 02202–02204.
Report, Feb. 21, 1989, 02205–2210.
Report, Feb. 2,1989, 02211–02216.
Report, J. Christmas, Apr. 27, 1989, 02217–02222.
Inspection Report, J. Christmas, Apr. 6,1989, 02223–02224.
Report, J. Christmas, April 27. 198902225 02230
Report, J. Christmas, Apr. 5, 1989, 02225–02230.
Correspondence, P.V. Foullon, Jun. 9, 1989, 02133–02134.
Report, Undated, 02235–02240.
Report, Undated, 02241–02242.
Report, Sep. 17, 1985, 02243–02244.
Report, Oct. 25, 1985, 02245–02250.
Form, Undated, 02251–02253.
Report, Undated, 02254.
Inspection Forms, Undated, 02255–02261.
Control Plan, Ron Frankel, Jun. 18, 1999, 02262–02269.
Control Plan, Ron Frankel, Mar. 1, 1999, 02270–02287.
Report, J. Christmas, Dec. 6, 1989, 02288.
Report, J. Christmas, Dec. 8, 1989, 02289–02290.
Notes, Undated, 02291–02298.
Correspondence, Larry Trout, Aug. 15, 1990, 02299–02300.
Interoffice Correspondence, Ron Frankel, Sep, 3, 1988, 02301.
Pnnts, Oct. 2,1985, 02302.
Correspondence, Bob McCormick, Aug. 6, 1986, 02303–02304.
Report, Undated, 02305–02314.

Control Plan, Ron Frankel, Mar. 1, 1989, 02315–02323.
Control Plan, Ron Frankel, Jun. 18, 1990, 02324–02331.
Notes, Undated, 02332.
Report, Undated, 02333.
Control Plan, Ron Frankel, Nov. 5, 1986, 02334–02343.
Prints, Feb. 2, 1986, 02344–02345.
Correspondence, R.E. McCue, Dec. 17, 1985, 02346.
Production Order Schedule, Apr. 10, 1986, 02347.
Control Plan, Ron Frankel, Mar. 19, 1986, 02348–02355.
Control Plan, Ron Frankel, Nov. 5, 1986, 02356–02364.
Reports, Undated, 02365–02420.
Notes, Apr. 8,1985, 02421.
Inspection Forms, Undated, 02422–02423.
Inspection Report, Dan Foss, Sep. 25, 1985, 02424–02425.
Correspondence, Ron Frankel, Oct. 23, 1986, 02426.
Report, Sep. 25, 1985, 02427.
Report, Undated, 02428.
Report, D. Burkeen, May 9, 1985, 02429–02430.
Interoffice Memorandum, Herb Earl, Feb. 7, 1999, 02431.
Correspondence, Bill Hamilton, Sep. 10, 1985, 02432–02433.
Engineering Change Notice, Feb. 12, 1986, 02434.
Interoffice Memorandum, W.B. Hamilton, Jul. 16, 1985, 02435.
Memorandum, W.E. Hamilton, Jul. 17, 1985, 02436–02437.
Notes, W.B. HamIlton, Jan. 12, 1985, 02438.
Correspondence, T.R. Downing, Jan.10, 1984, 02439.
Notes, Undated, 02440–2441.
Notes, W.B. Hamilton, Apr. 7, 1986, 02442.
Memorandum, Herb Earl, Feb. 7,1989, 02443.
Correspondence, Herb Earl, Sep. 22, 1986, 02444.
PrInts, Oct. 7, 1985, 02445.
Prints, Feb. 12, 1986, 02446.
Correspondence, Jim Robinson, Apr. 12, 1990, 02447.
Prints, Jul. 16, 1986, 02448.
Prints, Apr. 11, 1990, 02449.
Notes, Jul. 24, 1992, 02450.
Prints, Jun. 18, 1992, 02451.
Prints, Jan. 26, 1989, 02452.
Notes, Undated, 02453–2454.
Correspondence, Herb Earl, Jun. 3, 1992, 02455.
Notes, Undated, 02456–02457.
Interoffice Memorandum, Oct. 6, 1989, 02458.
Correspondence, Herb Earl, Jan. 19, 1989. 02459–02460.
Memorandum, T.R. Downing, Jan. 10, 1984, 02461.
Prints, Mar. 16, 1984, 02462–02463.
Prints, Jul. 20, 1984, 02464.
Prints, Dec. 10, 1984, 02465.
Correspondence, Herb Earl, Nov. 15, 1986, 02468–02469.
Correspondence, W.B. Hamilton, Oct. 31, 1985, 02470–02471.
Correspondence, Herb Earl, Jul. 12, 1985, 02472–02473.
Prints, Jan. 2, 1985, 02474.
Prints, Feb. 12, 1986, 02475–02478.
Correspondence, Herb Earl, Aug. 17, 1992, 02479–02480.
Correspondence, P.V. Foullon, Mar. 7, 1990, 02481.
Handwritten Notes, Bill Hamilton, Jul. 8, 1985, 02482.
Prints, Jul. 10,1985, 02483.
Prints. Jul. 8, 1985, 02484.
Handwritten Notes, Jun. 19, 1985, 02485.
Print, May 18, 1985, 02486.
Print, Jun. 6, 1985, 02487.
Prints, Jul. 26, 1985, 02488–02489.
Correspondence, Bill Hamilton, Jul. 25, 1985, 02490–02491.
Print, Jan. 2, 1985, 02492.
Print, Dec. 10, 1984, 02493.
Print, Jan. 2, 1995, 02494.
Memorandum, Barry MacLean, Nov. 11, 1986, 02495–02496.
Handwritten Notes, Undated, 02497–02500.
Handwritten Correspondence, Herb Earl, Dec. 5, 1986, 02501.
Handwntten Correspondence, Herb Earl, Dec. 16, 1986, 02502.
Correspondence, Nov. 20, 1986, 02503–02504.
Correspondence, Todd Downing, Oct. 3, 1986, 02505.
Correspondence, Herb EarlSep. 18, 1988, 02506.
Correspondence, Herb Earl, Sep. 17, 1986, 02507–2508.
Print, Undated, 02509.
Correspondence, Luke Ward, Mar. 14, 1986, 02510–02513.
Correspondence, Herb Earl, Feb. 27, 1985, 02514–02515.
Handwritten Notes, Undated, 02516.
Correspondence, William Gardner, Jul. 27, 1984, 02517–02518.
Print, Undated, 02519.
Print, Mar. 6, 1985, 02520.
Prints, Jan. 26, 1989, 02521–02522.
Correspodence, Phil Johnson, Mar. 6, 1989, 02523–02524.
Memorandum, Phil Johnson, Jul. 14, 1989, 02525.
Memorandum, Herb Earl, Jun. 23, 1989, 02526.
Correspondence, Dan Berg, Jun. 15, 1989, 02527–02530.
Handwritten Notes, Undated, 02531.
Correspondence, Herb Earl, Sep. 15, 1986, 02532–02533.
Handwritten Notes, Sep. 23, 1986, 02534.
Correspondence, Herb Earl, Sep. 15, 1986, 02535–02536.
Correspondence, Herb Earl, Sep. 20, 1986, 02537.
Correspondence, Herb Earl, Sep. 18, 1986, 02538–02539.
Memorandum, Barry MacLean, Nov. 11, 1986, 02540–02541.
Correspondence, Herb Earl, Aug. 26, 1976, 02542.
Print, June 23, 1969, 02543.
Prints, Jun. 12, 1967, 02544.
Print, Undated, 02545.
Correpondence, Herb Earl, Dec. 16, 1986, 02546.
Handwritten Notes, Dec.16, 1986, 02547.
Interoffice Correspondence, Barry MacLean, Aug. 31, 1976, 02548–02548.
Correspondence, Herb Earl, Sep. 2, 1976, 02549–02552.
Correspondence, Herb Earl, Aug. 26, 1976, 02553.
Print, Jun. 23, 1969, 02554.
Print, Jun. 12, 1967, 02555.
Print, Undated, 02556.
Interoffice Correspondence, Barry MacLean, Aug. 30, 1976, 02557.
Handwritten Notes, Undated, 02558.
Memorandum, Barry MacLean, Apr. 16, 1985, 02559–02594.
Memorandum, Barry MacLean, Feb. 10, 1989, 02595–02596.
Correspondence, Barry MacLean, Feb. 10, 1989, 02597.
Purchased Steel Descripton, Apr. 30, 1985, 02598.
Chemical Testing Report, Oct. 29, 1986, 02599.
Price Quotes, Mar. 36, 1985, 02600.
Purchased Steel Description, Apr. 3, 1985, 02601.
Handwritten Notes, Apr. 8, 1985, 02602.
Handwritten Notes, Undated, 02603.

Correspondence, Herb Earl, Nov. 5, 1985, 02604.
Load Tally, Oct. 31, 1985, 02605.
Certificate of Tests, Apr. 22, 1985, 02606.
Purchase Order Acceptance Acknowledgement, Apr. 23, 1985, 02607.
Purchase Requisition, Apr. 19, 1985, 02608.
Purchase Order Apr. 22, 1985, 02609.
Shipping Tally, May 25, 1985, 02610.
Purchased Steel Descnption, Apr. 30, 1985, 02611.
Test Report, Jun. 17, 1985, 02612.
Purchased Steel Description, Jan. 30, 1986, 02613.
Purchased Steel Description, Apr. 30, 1985, 02614.
Test Report, Jun. 17,1985, 02615.
Handwritten Notes. Undated, 02616–02619.
Corraspondesice. W. Burke, Mar. 22.1979, 02620.
Correspondence. Bill Hamilton. Jun. 5. 1984 02621.
Certificate of Tests. Dec. 20, 1985, 02622–02623.
Shipping Notice. Jan. 14, 1986, 02624.
Load Tally, Oct. 31. 1985, 02625.
Correspondence. Dan Berg, Oct. 27, 1986, 02626–02628.
Handwritten Notes, Undated, 02629.
Correspondence. Herb Earl, Oct. 30, 1986, 02630.
Chemical Testing Report, Oct. 29, 1986 02631–02632.
Purchase Requisiton, Jun. 3, 1985, 02633.
Purchase Requisition, Dec. 6, 1985, 02634.
Print, Dec. 10, 1984, 02635.
Purchase Order, Feb. 15, 1985, 02636–02637.
Purchase Order. Feb. 14, 1985,02637–02639.
Correspondence, Herb Earl, Feb. 1, 1985, 02640.
Purchase Steel Description, Sep. 13,1984, 02641.
Chemical Testing Report, Jun. 19, 1986, 02642–02643.
Prints, Oct. 7, 1985, 02644–02645.
Print, Jul. 22, 1974, 02646.
Prints, Sep., 1972, 02647.
Purchase Order, Apr. 9, 1985, 02648.
Price Quotes, Mar. 25, 1985, 02649.
Purchased Steel Description, Apr. 3, 1985, 02650.
Handwritten Notes, Apr. 8, 1985, 02651.
Correspondence, Herb Earl, Apr. 19, 1989, 02652.
Correspondence, Herb Earl, May 17,1989, 02653.
Correspondence, Phil Johnson, May 12, 1989, 02654.
Print, Nov. 9, 1982, 02655.
Print, Aug. 21, 1981, 02656.
Print, Sep. 3, 1988, 02657.
Request for Quotation, April 28, 1992, 02658.
Prints, Apr. 19, 1982, 02659–02660.
Request for Quotation, Apr. 28, 1992, 02661.
PrInts, Apr. 19, 1982, 02662–02663.
Print, Jan. 2,1985, 02664.
Print, Sep. 5, 1985, 02665.
Print, Oct. 3, 1985, 02666–02669.
Prints, Sep. 11, 1985, 02670–02671.
Print, Oct. 7, 1985, 02672.
Print, Sep. 23, 1985, 02673.
Print, Jan. 2, 1985, 02674.
Print, Dec. 10, 1984, 02675.
Print, Mar. 4, 1985, 02676.
Print, Jul. 12, 1982, 02677.
Prints, Jan. 6, 1986, 02678–02679.
Print, May 7, 1984, 02680.
Print, Apr. 5, 1985, 02681.
Print, Sep. 17, 1985, 02682.
Print, Sep. 23, 1985, 02683.
Prints, Sep. 17,1985, 02684–02686.
Print, Sep. 5, 1985, 02687.
Print, Dec. 10, 1984, 02688.
Print, Oct. 7, 1985, 02689.
Prints, Feb. 12, 1986, 02690–02691.
Prints, Oct. 7, 1985, 02692–02693.
Print, Feb. 12, 1986, 02694.
Correspondence, Todd Downing, October 3, 1986, 02695.
Correspondence Jun. 18, 1984, 02696.
Print, Mar. 16, 1984, 02697
Prints, May 7, 1981, 02698–02699.
Print, Jul. 11, 1984, 02700.
Print, Jun. 1, 1984, 02701.
Print, Mar. 16, 1954, 02702.
Print, Feb. 25, 1984, 02703.
Print, Mar. 21, 1984, 02704.
Print, Mar. 16, 1984, 02705.
Print, Mar. 27, 1986, 02706.
Prints, Sep. 17, 1985, 02707.
Print, Dec. 10, 1984, 02708.
Print, Jan. 26, 1989, 02709.
Prints, Mar. 23, 1989, 02710–02712.
Print, Sep. 7, 1972, 02713.
Print, Jul. 22, 1974, 02714.
Print, Oct. 7, 1985, 02715.
Print, Dec. 4, 1984, 02716.
Prints, Jan. 6, 1986, 02717–02718.
Print, Sep. 17, 1985, 02719.
Prints, Feb. 12, 1986, 02720–02723.
Prints, Jan. 6, 1986, 02724–02725.
Print, Jul. 15, 1982, 02726.
Prints, May 26, 1982, 02727–02735.
Print, Sep. 7, 1972, 02736.
Handwritten Notes, Undated, 02737.
Print, Jul. 22, 1974, 02738.
Print, Sep. 7, 1972 02739.
Print, Apr. 3, 1982, 02740.
Request for Quotation, Apr. 28, 1982, 02741.
Print, May 16, 1980, 02742.
Print, Aug. 20, 1980, 02743.
Print, May 26, 1982, 02744.
Request for Quotation. Apr. 28, 1982, 02745.
Print, May 16,1980, 02746.
Print, Aug. 20, 1980, 02747.
Prints, Dec. 10. 1984, 02748–02749.
Print, Jul. 16, 1984, 02750.
Print, July 16, 1984 02751
Request for Quotation, Apr. 28, 1982, 02752.
Print, Feb. 18, 1980, 02753.
Print, May 7, 1981, 02754.
Prints, May 7, 1981, 02755–02758.
Pnnt, Oct. 29, 1982, 02759.
Prints, Sep. 26, 1983, 02760–02761.
Print, Oct. 29, 1982, 02762.
Print, Aug. 22, 1985, 02763.
Print, Oct. 7, 1985, 02764.
Print, Mar. 23, 1989, 02765.
Print, Jan. 26,1989, 02766.
Correspondence, Leon Peaslee, Apr. 3, 1989, 02767–02769.
Print, Oct. 7, 1985, 02770.
Print, Apr. 4, 1986, 02771.
Prints, Feb. 12, 1986, 02772–02773.
Print, Oct. 7, 1985, 02774.
Print, Oct. 18, 1985, 02775.
Handwritten Notes, Undated 02776.

Prints, Mar. 23, 1989, 02777–02779.
Prints, Jun. 3, 1982, 02780–02781.
Prints, Undated 02782–02783.
Purchase Order, Jun. 25, 1986, 02784.
Print, Apr. 30, 1986, 02785.
Print, Jun. 23, 1988, 02786.
Print, Apr. 30,1986, 02787.
Print, Jul. 11, 1984, 02788.
Print, Oct. 18, 1985, 02789.
Prints, Jul. 11, 1984, 02790–02791.
Prints, Sep. 16, 1986, 02792 –02793.
Print, Jul. 10, 1984, 02794.
Surface Defects of Tappet Push Rod Seat Inserts, Oct. 4, 1965, 02795–02798.
Print, Apr. 30, 1987, 02797.
Prints, Oct. 4, 1986, 02798–02799.
Handwritten Notes, Undated, 02800–02801.
Print, Oct. 4, 1966, 02802.
Request for Quotation, Apr. 28, 1982, 02803.
Print, Feb. 18,1980, 02804.
Print, May 7, 1981, 02805.
Request for Quotation, Apr. 28, 1982, 02806.
Print, Oct. 4, 1966, 02807.
Print, Mar. 21,1984, 02808.
Request for Quotation, Apr. 28, 1982, 02809.
Print, Feb. 18, 1980, 02810.
Print, May 7, 1981, 02811.
Print, Undated, 02812.
Prints, Apr. 1, 1986, 02813–02815.
Prints, Sep. 9, 1984, 02816.
Prints, Sep. 28, 1984, 02817.
Prints, Sep. 28,1984, 02818.
Prints, Jan. 24, 1988, 02819–02822.
Prints, Sep. 28, 1984, 02823.
Prints, Sep. 26,1984, 02824–02826.
Prints, Dec. 4, 1984, 02827.
Prints, Sep. 28,1984, 02828.
Prints, Feb. 11, 1986, 02829.
Prints, Sep. 28,1984, 02830.
Prints, Sep. 28, 1984, 02831–02833.
Prints, Sep. 26, 1984, 02834–02837.
Prints, Sep. 28, 1984, 02838.
Prints, Sep. 28, 1982, 02839.
Prints, Undated , 02840–02841.
Prints, Dec. 17, 1985, 02842.
Prints, Oct. 5,1985, 02843.
Prints, Oct. 7, 1985, 02844.
Interoffice Correspondence, Ron Frankel, Sep. 3,1986, 02845.
Prints, Oct. 2, 1985, 02846.
Handwritten Notes, Bob McCormick, Aug. 6, 1986, 02847–02948.
Prints, Dec. 6, 1990, 02949.
Prints, Undated, 02950–02951.
Prints, Dec. 12, 1973, 02952.
Prints, Jun. 25,1981, 02953.
Prints, Jun. 10, 1969, 02954.
Prints, Dec. 8, 1965, 02955–02956.
Prints, Jun. 10, 1969, 02957–02960.
Prints. Oct. 2, 1985, 02961.
Prints, Oct. 30, 1985, 02962.
Prints, Oct. 31, 1985, 02963–02964.
Prints, Undated, 02965.
Prints, Apr. 16, 1985, 02966.
Prints, Aug. 8, 1988, 02867.
Print, Feb. 21, 1985, 02868.
Print. Oct. 31, 1985, 02869.
Print, Oct. 30, 1985, 02870.
Print. Oct. 31, 1985, 02871.
Print, Feb. 21, 1985, 02872.
Correspondence, Richard Bizer, Aug. 22, 1984, 02873–02878.
Handwritten Notes, Undated, 02879–02880.
Print, Mar. 21, 1984, 02881.
Print, Sep. 26. 1984, 02882.
Print, Sep. 25, 1984, 02883.
Print, Nov. 9, 1982, 02884.
Print, Sep. 26, 1984, 02885.
Print, Jul. 11, 1984, 02886.
Print, Undated, 02887.
Print, Mar 6, 1985, 02888.
Purchase Order, Jul. 1, 1988, 02889.
Print, Jul. 1, 1988, 02890.
Print, Dec. 9,1988, 02891.
Print, Oct. 31, 1985, 02892.
Print, Undated, 02893.
Print, Undated , 02894–02895.
Prints, Undated, 02896–02898.
Prints, Jul. 24, 1981, 02899–02900.
Print, Oct. 22, 1985, 02901.
Print. Oct. 28, 1985, 02902.
Print, Undated, 02903.
Print, Oct. 30, 1985, 02904.
Print, Undated, 02905.
Prints, Undated, 02906–02911.
Correspondence, Herb Earl, Sep. 17, 1991, 02912–02914.
Handwritten Notes, Jan. 19, 1990, 02915.
Memorandum, Herb Earl, Mar. 5, 1986, 02916.
Production Order Schedule, Mar. 19, 1986, 02917.
Purchase Invoice, Jan. 31, 1986, 02918.
Purchase Invoice, Jan. 30, 1986, 02919.
Purchase Invoice, Jan. 31, 1986, 02920.
Correspondence, Nov.13, 1985, 02921.
Correspondence, John Peterson, Dec. 19, 1985, 02922.
Correspondence, Herb Earl, Jan. 28, 1986, 02923.
Correspondence, Connie K., Aug. 4, 1986, 02924.
Handwritten Notes, Undated, 02925.
Correspondence, Herb Earl, Dec. 16, 1986, 02926.
Correspondence, David Trendler, Feb. 2, 1987, 02927–02928.
Handwritten Notes, Undated, 02929–02931.
Correspondence, John Radziewicz, Nov. 10, 1986, 02932–02947.
Handwritten Notes, Undated, 02948.
Handwritten Notes, Nov. 14,1986, 02949.
Handwritten Notes, Herb Earl, Nov. 6, 1986, 02950.
Packing List, Nov. 6, 1989, 02951.
Shipping Order, Sep. 14, 1989, 02952.
Packing Lists, Sep. 14, 1989, 02953–02955.
Correspondence, Dan B., Nov. 20, 1989, 02956.
Handwritten Notes, Undated, 02957–02958.
Quotations, Sep. 3, 1985, 02959–02960.
Correspondence, Jun. 18, 1984, 02961.
Handwritten Notes, Undated, 02962.
Correspondence, Herb Earl.,Feb. 7, 1989, 02963.
Handwritten Notes.,Undated, 02964–02967.
Shipping Reports.,Undated, 02968–02969.
Schedules, Undated, 02970–02971.

Part Number Inquiries, Sep. 23, 1986, 02972–02973.
Handwritten Notes, Undated, 02974.
Correspondence, Bill Hamilton, Sep. 6, 1985, 02975.
Print, Sep. 5,1985, 02976.
Purchase Order, May 6, 1955, 02977.
Purchase Order, Jun. 25, 1986, 02978.
Print, Apr. 30, 1986, 02979.
Handwritten Notes, Feb.18, 1986, 02980.
Correspondence, John Radziewicz, Feb. 27, 1986, 02981.
Purchase Order, May 5, 1986, 02982.
Prints, Feb. 12, 1986, 02983–02984.
Correspondence, Herb Earl, Mar. 10, 1986, 02985.
Shipping Notice, Oct. 16, 1985, 02986.
Purchase Order, Jan. 7, 1986, 02987.
Cost Estimate, Oct. 4, 1985, 02988.
Correspondence, Herb Earl, Jan. 28, 1988, 02989.
Shipping Reports, Undated, 02990–02996.
Memorandum, Bill Hamilton, Mar. 5, 1986, 02997.
Correspondence, Luke Ward, Mar. 21, 1986, 02998–03007.
Memorandum, Bill Hamilton, Mar. 5, 1986, 03008.
Correspondence, John Radziewicz, Feb. 19, 1986, 03009.
Report, Undated, 03010 –03019.
Correspondence, Bill Hamilton, Jun. 6. 1985, 03021.
Correrspondence, Robert McCue, Oct. 22, 1985, 03021.
Handwritten Notes, Undated, 03022.
Handwritten Notes, Dec. 16,1986, 03023.
Memorandum, Gene Arnistani, Jul. 18, 1990, 03024–03025.
Handwritten Notes, Undated, 03026–03028.
Correspondence, Gene Amistanl, Oct. 4, 1990, 03029.
Handwritten Notes, Undated, 03030.
Correspondence, Larry Trout, Jul. 18, 1989, 03031.
Handwritten Notes, Undated, 03032–03035.
Correspondence, Undated, 03036–03038.
Correspondence, Dan Berg, Jan. 15, 1990, 03039.
Notes, Jan. 19, 1990, 03040.
Handwritten Notes, Jul. 8, 1987, 03041–03045.
Handwritten Notes, Undated, 03046.
Correspondence, Herb Earl, Sep. 2, 1976, 03047–03048.
Interoffice Correspondence, Ernie Majarucon, Sep. 8, 1976, 03049–03050.
Interoffice Correspondence, Roger Northup, Sep. 7, 1976, 03051.
Rejected Material Notification, Oct. 20, 1986, 03052.
Handwritten Notes, Undated, 03053.
Correspondence, Bill HamIlton, Jun. 5, 1984, 03054.
Barry MacLean Stanadyn Visit. Undated, 03055.
Correspondence, Dan Berg. Oct. 3, 1986, 03056–03058.
Quality Assurance Findings, Jan. 6, 1986, 03059–03066.
Correspondence, Bill Hamilton, Undated, 03067.
Correspondence, J. Janda, Nov. 6, 1991, 03068.
Interoffice Correspondence, Ron Frankel, Dec. 2, 1986, 03069.
Quality Assurance Program Audit Report, Jan. 6, 7, 1986, 03070–03077.
Memorandum, Herb Earl, Mar. 5, 1986, 03078–03079.
Handwritten Notes, Undated, 03080–03081.
Handwritten Notes, Undated, 03082.
Correspondence, Jim Shea, Jan. 10, 1986, 03083.
Handwritten Notes, Jan. 20, 1986, 03084.
Correspondence, Dan Berg, Undated, 03085.
Quality Assurance Program Audit Report, Jan. 6,7, 1986, 03086–03095.
Correspondence, John Radziewicz, Apr. 11, 1986, 03096.
Memorandum, Herb Earl, Apr. 10, 1986, 03097.
Correspondence, John Radziewicz, Apr. 11, 1986, 03098.
Correspondence, Herb Earl, Jan. 31, 1985, 03099.
Print, Undated, 03100.
Correspondence, G. Perkins, Sep. 25, 1986, 03101–03102.
Correspondence, P. E. Eller/G. Croh, Sep. 24, 1986, 03103–03105.
Handwritten Notes, Undated, 03106.
Correspondence, Larry Trout, Aug. 15, 1990, 03107–03108.
Handwritten Notes, Feb. 21st, 03109.
Handwritten Notes, Feb. 16th, 03110.
Handwritten Notes, Undated, 03111–03112.
Correspondence, P.V. Foullon, Jun. 5,1989, 03113.
Subgroup Report, May 16, 1989, 03114–03117.
Handwritten Notes, Oct. 23, 1991, 03118.
Memorandum, Larry Trout, Oct. 22, 1991, 03119.
Handwritten Notes, Jan. 19, 1990, 03120.
Correspondence, Pete Faullon, Jan. 25, 1990, 03121.
Handwritten Notes, Jan. 20, 1986, 03122–03123.
Handwritten Notes, Feb. 28, 1990, 03124–03125.
Correspondence, Herb Earl, Oct. 3, 1986, 03126.
Correspondence, Herb Earl, Nov. 7, 1986, 03127–03128.
Correspondence. Ron, Nov. 6, 1986, 03129–03130.
Inspection Report, Nov. 14, 1986, 03131–03132.
Correspondence, Dan Berg, Mar. 19, 1986, 03133–03135.
Correspondence, Dan Berg, Jan. 29, 1990, 03136.
Correspondence, Pete Foullon, Dec. 4, 1989, 03137.
Correspondence, Pete Foullon, Dec. 15, 1987, 03138–03139.
Correspondence, Dan Berg, Nov. 27, 1989, 03140–13141.
Handwritten Notes, Nov. 28, 1989, 03142.
Control Plan, Mar. 19, 1986, 03143–03150.
Handwritten Notes. Undated, 03151–03152.
Ford Motor Company Problem Report Worksheet, Nov. 20, 1989, 03153–03155.
Correspondence, Herb Earl, Sep. 18, 1986, 03156–03157.
Correspondence, J. Janda, Oct. 24, 1991, 03158–03159.
Correspondence, Pete Foullon, Jan. 25, 1990, 03160.
Correspondence, Ron Schuett, May 12, 1992, 03161–03162.
Memorandum, Herb Earl, Apr. 28, 1992, 03163–03164.
Correspondence, Todd Downing, Oct. 20, 1986, 03165.
Handwritten Notes, Apr. 15, 1992, 03166.
Memorandum, Herb Earl, May 1, 1992, 03167.
Memorandum, Larry Trout, Oct. 22, 1991, 03168.
Handwritten Notes, Oct. 23, 1991, 03169.
Correspondence, Dan Berg, Oct. 31, 1986, 03170.
Correspondence, Dan Berg, Oct. 29, 1986, 03171–03180.
Preproduction Qualification, Undated, 03181–03185.
Correspondence, Ron Frenkel, Oct. 21, 1986, 03186.
Memorandum, John Radziewicz, Sep. 24, 1986, 03187.
Preproduction Qualification, Undated, 03188.
Correspondence, Dan Berg, Mar. 19, 1986, 03189–03190.
Correspondence, Herb Earl, Oct. 2, 1986, 03191.
Correspondence, Dan Berg, Oct. 16, 1986, 03192.
Data Sheets, Undated, 03193–03205.
Correspondence, Gene Amistani, May 8, 1990, 03206.
Memorandum, Herb Earl, Apr. 14, 1992, 03207.
Memorandum, Aug. 30, 1990, 03208.
Handwritten Notes, Undated, 03209.
Noncomformance Report, May 7, 1990, 03210.
Print, Mar. 23, 1989, 03211.
Correspondence, Pete Foullon, Undated, 03212–03216.
Correspondence, Pete Foullon, Undated 03217–03218.
Handwritten Notes, Jan. 19, 1990, 03219.

Correspondence, Bob McCormick, Aug. 2, 1990, 03220–03223.
Engineering Change Notice, Jun. 26, 1989, 03224.
Rejected Material Notification, Feb. 28, 1990, 03225.
Correspondence, Bob McCormick, Aug. 17, 1990, 03226–03227.
Print, Mar. 23, 1989, 03228.
Correspondence, Dan Berg, Feb. 6, 1990, 03229.
Report, Jan. 26, 1990, 03230.
Memorandum, Pete Foullon, Jan. 31, 1990, 03231–03231.
Correspondence, Pete Foullon, Jan. 30, 1990, 03234.
Correspondence. Michael Segerson, Jan. 12, 1990, 03235.
Correspondence, Pete Foullon, Feb. 1, 1990, 03236–03238.
Invoice No. S–76328, Feb. 1, 1990, 03239.
Correspondence, Dan Berg, Jan. 26, 1990, 03240–03241.
Handwntten Notes, Undated, 03242–03243.
Correspondence, Gene Amistani, Jul. 31, 1990, 03244.
Correspondence, Undated, 03245.
Plunger Dimensions, Apr. 30, 1990, 03246–03248.
Quality Control Report, Sep. 17, 1985, 03249–03252.
Memorandum, Bob McCormick, Jun. 13, 1990, 03253.
Memorandum, John Radziewicz, Mar. 5, 1988, 03254–03255.
Correspondence, Herb Earl, Mar. 7, 1986, 03256–03257.
Memorandum, John Radziewicz, Feb. 13, 1988, 03258.
Memoradum, Luke Ward, Mar. 14, 1986, 03259–03262.
Correspondence, Ron Frankel, Apr. 10, 1989, 03263–03264.
Noncomformance Report, Apr. 10, 1989, 03265
Correspondence, Dan McMillan, Jul. 14, 1989, 03266.
Correspondence. Pete Foullon, May 24, 1989, 03267–03268.
Correspondence, Ron Frankel, Jun. 7, 1989, 03269–03270.
Correspondence, Larry Trout, Jul. 18, 1989, 03271–03272.
Measured Diameters, Undated, 03273–03275.
Plunger Schedules, Jan. 14, 1985, 03276–03277.
Plunger Schedules, Jul. 27, 1984, 03278–03279.
Handwritten Notes, Undated, 03280–03283.
Correspondence, Jun. 24, 1986, 03284.
Handwritten Notes, Undated, 03285–03289.
Correspondence, W. Dwelly/J. Radziewicz, May 14, 1986, 03290–03291.
Correspondence, Pete Foullon, Feb. 22, 1990, 03292.
Correspondence, Dan Berg, Jan. 26, 1990, 03293–03294.
Memorandum, Dan Berg, Feb. 28, 1990, 03295.
Corresopndence, Pete Foullon, Undated, 03296.
Stanadyne Brainstorming Sessions Notes, Dan Berg, Feb. 28, 1990, 03297–03298.
Correspondence, Gene Amistani, Jul. 31, 1990, 03299.
Correspondence, Larry Trout, Jul. 26, 1990, 03300–03301.
Memoradum, Herb Earl, Jan. 9,1992, 03302–03303.
Handwritten Notes, Undated, 03304.
Handwritten Notes, Dec. 26, 1991, 03305.
Handwritten Notes, Undated, 03306–03308.
Print, Mar. 23, 1989, 03309.
Quality Control Report, Sep. 17, 1985, 03310–03312.
Handwritten Notes, Nov. 1, 1986, 03313.
Correspondence, Herb Earl, Dec. 15, 1986, 03314.
Interoffice Correspondence, Ron Frankel, Jan. 26, 1987, 03315.
Action Request, Jan. 20,1987, 03316.
Correspondence, Dan Berg, Dec. 24, 1986, 03317–03318.
Interoffice Correspondence. Ron Frankel, Jan. 26, 1987, 03319–03320.
Interoffice Correspondence, Ron Frankel, Jan. 26, 1987, 03321.
Rejection Analysis, Nov. 19, 1986, 03322–03323.
Correspondence, Herb Earl, Dec. 16, 1986, 03324.
Correspondence, Gene Amistani, Jul. 30, 1990, 03325.
Correspondence, Gene Amistani, Jul. 30, 1990, 03326.
Correspondence, Gene Amistani, Jul. 30, 1990, 03327.
Correspondence, Gene Amistani, Jul. 30, 1990, 03328.
Correspondence, Gene Amistani, Jul. 30, 1990, 03329.
Correspondence, Larry Trout, Aug. 10, 1989, 03330.
Correspondence, Gene Amistani, Apr. 17, 1990, 03331.
Correspondence, Gene Amistani, May 8, 1990, 03332.
Measured Dimensions, Undated, 03333.
Correspondence, Gene Amistani, May 8,1990, 03334.
Correspondence, Gene Amistani, Jul. 30, 1990, 03335.
Correspondence, Gene Amistani, Jul. 27, 1990, 03336.
Correspondence, Gene Amistani, Jul. 27, 1990, 03337.
Correspondence, Gene Amistani, Jul. 31, 1990, 03338.
Handwritten Notes, Undated, 03339.
Memorandum, Bob McCormick, May 15, 1990, 03340.
Memorandum, Bob McCormick, Apr. 10, 1990, 03341.
Memorandum, Bob McCormick, Jun. 27, 1990, 03342.
Correspondence, Pete Foullon, Dec. 13, 1989, 03343.
Supplier Quality Alert Request for Cause and Corrective Action, Oct. 1, 1991, 03344–03345.
Handwritten Notes, Undated, 03346.
Correspondence, Ron Schutt, May 12, 1992, 03347–03348.
Correspondence, Gene Amastani, Jul. 30, 1990, 03349.
Correspondence, Herb Earl, Sep. 29, 1986, 03350.
Handwritten Notes, Undated, 03351.
Correspondence, Herb Earl, Sep. 22, 1986, 03352.
Inspection Report, Nov. 14, 1986, 03353–03354.
Plunger Deviation Request, Undated, 03355–03356.
Correspondence, Herb Earl, Nov. 20, 1986, 03357–03358.
Correspondence, Dan Berg, Mar. 19, 1986, 03359–03361.
Memorandum, Dan Berg, Feb. 28, 1990, 03362–03363.
Stanadyne Brainstorming Session Notes, Dan Berg, Feb. 28, 1990, 03364–03365.
Correspondence, Pete Foullon, Undated, 03366–03367.
Correspondence, Gene Amastani, Jun. 26, 1990, 03368.
Correspondence, Dan Berg, Jun. 15, 1988, 03369–03372.
Print, Oct. 7, 1985, 03373.
Noncomformance Report, Jul. 5,1987, 03374–03375.
Correspondence, Larry Trout, Jul. 18,1989, 03376–03377.
Tool Life Report, Nov. 1, 1986, 03378–03382.
Correspondence, G. Perkins, Sep. 25, 1986, 03383–03384.
Correspondence, P. E. Ellen/G. Kroh, Sep. 24, 1988, 03385–03387.
Machine Operation Report, Sep.19–21, 1988, 03388–03391.
Kinsbury Machine Down Report, Aug. 17,1986, 03392.
Kinsbury Machine Down Report, Aug. 31,1986, 03393.
Kinsbury Machine Down Report, Sep. 7, 1986, 03394.
Kinsbury Machine Down Report, Sep. 14, 1986, 03395.
Kinsbury Machine Down Report, Sep. 21, 1986, 03396.
Machine Operation Report, Sep. 19–21, 1986, 03397–03400.
Correspondence, Herb Earl, Sep. 18, 1986, 03401–03402.
Correspondence, J. Janda, Oct. 24, 1991, 03403–03404.
Correspondence, G. Perkins, Sep. 25, 1986, 03405–03406.
Correspondence, P.E. Eller/G. Kroh, Sep. 24, 1986, 03407–03409.
Correspondence, Todd Downing, Oct. 3, 1988, 03410.
Correspondence, Herb Earl, Nov. 14, 1986, 03411.
Correspondence, Herb Earl, Nov. 15, 1986, 03412.

Handwritten Notes, Nov. 18, 1986, 03413.
Correspondence, Herb Earl, Nov. 20, 1986, 03414.
Corresponence, G. PerkIns, Sep. 25, 1986, 03415–03416.
Correspondence, P.E. EIIer/G. Kroh, Sep. 24, 1986, 03417–03419.
Correspondence, Gene Amastani, Oct. 4, 1990, 03420.
Correspondence, Gene Amastani, Oct. 4, 1990, 03421.
Correspondence, Gene Amastani, Sep. 4,1990, 03422.
Noncomformance Report, Sep. 10, 1990, 03423.
Noncomformance Report, Aug. 27, 1990, 03424.
Handwritten Notes, Undated, 03425.
Memorandum, Aug. 30, 1990, 03426–03428.
Handwritten Notes, Undated, 03429.
Correspondence, Bob McCormick, Sep. 10, 1990, 03430–03431.
Correspondence, Gene Amastani, Oct. 4, 1990, 03432.
Noncomformance Report, Oct. 27, 1990, 03433–03434.
Noncomformance Report, Sep. 4, 1990, 03435–03437.
Noncomformance Report, Sep. 10, 1990, 03438–03440.
Print, Dec. 4, 1984, 03441.
Wall Thickness Measurements, Undated, 03442.
Print, Dec. 4,1984, 03443.
Wall Thickness Measurements, Undated, 03444.
Quality Control Report, Nov. 5, 1984, 03445.
Memorandum, Bob McCormick, Jun. 13, 1990, 03446.
Correspondence. Herb Earl. March 7, 1986 03447 –03448
Memorandum, Luke Ward, March 14, 19860 3449–03452
Correspondence, Herb Earl, Feb. 27, 1989, 03453–03456.
Piercing Punch Diameters, Undated, 03457.
Report, Feb. 9, 1989, 03458–03469.
Correspondence, Leon Peasley, Apr. 17,1989, 03470–03471.
Correspondence, Leon Peasley, Apr. 14, 1989, 03472.
Correspondence, Larry Trout, Sep. 12, 1989, 03473.
Correspondence, Pete Foullon, Oct. 3, 1989, 03474–03475.
Customer Complaint NotificatIon, Nov. 3, 1988, 03476 –03479.
Correspondence, Jun. 24,1986, 03480.
Handwntten Notes, Sep. 23rd, 03481.
Meeting Notice, Sep. 23, 1986, 03482–03483.
Corrective Action Plan, Sep. 22, 1986, 03484–03487.
Handwritten Notes, Undated, 03488–03491.
Handwritten Notes, Sep. 22, 1986, 03492.
Correspondence, W. Dwelly/J. Radziewicz, May 14, 1986, 03493–03494.
Correspondence, Larry Trout, Jul. 26, 1990, 03495–03496.
Correspondence, Mike Curtis, Undated, 03497.
Print, May 1, 1985, 03498.
Correspondence, Herb Earl, May 2, 1986, 03499.
Correspondence, Bill Hamilton, May 14,1985, 03500.
Correspondence, Bill Hamilton, Apr. 3, 1985, 03501.
Print, Mar. 27, 1984, 03502.
Handwritten Notes, May 3, 1985, 03503–03504.
Correspondence, Gene Amastani, Jul. 30, 1990, 03505.
Invoice, Nov. 3, 1986, 03506.
Correspondence, Gene Amastani, Oct. 4, 1990, 03507–03508.
Correspondence, Gene Amastani, Jul. 9,1990, 03509.
Correspondence, Gene Amastani, Sep. 19, 1990, 03510–03512.
Correspondence, Larry Trout, Aug. 10, 1989, 03513.
Correspondence, Larry Trout, Sep. 12, 1989, 03514.
Correspondence, Larry Trout, Jul. 26,1990, 03515–03516.
Report, Jun. 13, 1990, 03517.
Correspondence, Gene Amastani, Jun. 13, 1990, 03518–03519.
Correspondence, Gene Amastani, Jul. 30, 1990, 03520.
Noncomformance Report, Dec. 13, 1989, 03521–03522.
Correspondence, Jun. 28, 1990, 03523.
Correspondence, Gene Amastani, Sep. 4, 1990, 03524–03526.
Memorandum, Bob McCormick, Jun. 27, 1990, 03527.
Noncomformance Report, Apr. 9, 1990, 03528.
Noncomformance Report, May 14, 1990, 03529.
Noncomformance Report, Jun. 25, 1990, 03530.
Noncomformance Report, May 15, 1990, 03531.
Noncomformance Report, Jun. 25, 1990, 03532.
Noncomformance Report, Mar. 23, 1990, 03533.
Noncomformance Report, Mar. 23, 1990, 03534.
Memorandum, Bob McCormick, May 15, 1990, 03535.
Memorandum, Bob MccormIck, Apr. 10, 1990, 03536.
Supplier Quality Alert Request for Cause and Corrective ActIon, Feb. 19, 1992, 03537–03538.
Correspondence, Dan McMiIIan, Aug. 2, 1990, 03539–03541.
Correspondence, R.E. McCue, Sep. 30, 1985, 03542–03543.
Supplier Quality Assurance Specification, Sep. 1, 1985, 03544–03551.
Correspondence, Bob McCormick, Jun. 8,1990, 03552–03553.
Correspondence, Todd Downing, Sep. 30, 1986, 03554.
Handwntten Notes, Undated, 03555.
Reports, Undated, 03556–03564.
Correspondence, Herb Earl, Nov. 20, 1986 03565–03566.
Handwritten Notes, Undated, 03567.
Deviation Request, Undated, 03568–03569.
Deviation Request, Dec. 22, 1986, 03570.
Deviation Request, Dec. 18, 1986, 03571.
Correspondence, Herb Earl, Dec. 15, 1986, 03572.
Deviation Request, Dec. 15, 1986, 03573.
Devialton Request, Dec. 3, 1986, 03574.
Correspondence, Herb Earl, Dec. 11, 1986, 03575–03582.
Correspondence, Ron Frankel, Jan. 27, 1987, 03583.
Deviation Request, Jan. 27, 1987, 03584.
Deviation Request, Nov. 24, 1986, 03585.
Correspondence, Gene Amastani, Jul. 30, 1990, 03586.
Correspondence, Bob McCormick, Apr. 6, 1996, 03587.
Correspondence, Gene Amastani, Jul. 30, 1990, 03588.
Correspondence Herb Earl, Sep. 22, 1986, 03589.
Deviation Request, Oct. 16, 1986, 03590–03591.
Correspondence, Herb Earl, Sep. 20, 1986, 03592–03593.
Correspondence, Dan Berg, Oct. 16, 1986, 03594–03595.
Correspondence, Herb Earl, Sep. 22, 1986, 03596.
Correspondence, Herb Earl, Sep. 18, 1986, 03597–03598.
Correspondence, Herb Earl, Sep. 18, 1986, 03599.
Deviation Request, Oct.16, 1986, 03600–03601.
Correspondence, Herb Earl, Oct. 2, 1986, 03602.
Measured Dimensions, Undated, 03603.
Correspondence, Herb Earl, Sep. 20, 1986, 03604.
Correspondence, Herb Earl, Sep. 22, 1986, 03605.
Handwritten Notes, Undated, 03606.
Correspondence, Herb Earl, Oct. 3, 1986, 03607.
Handwritten Notes, Oct. 20, 1986, 03608.
Deviation Request, Undated, 03609–03611.
Handwritten Notes, Undated, 03612.
Correspondence, Herb Earl, Nov.7, 1986, 03613–03614.
Correspondence, Ron, Nov. 6, 1986, 03615–03616.
Correspondence, Ron F., Nov. 7, 1986, 03617.

Deviation Request, Undated, 03618–03619.
Correspondence, Ron Frankel, Nov. 20, 1986, 03620–03621.
Deviation Request, Nov. 24, 1986, 03622.
Deviation Request, Undated, 03623–03624.
Correspondence, Herb Earl, Nov. 20, 1986, 03625–03626.
Handwritten Notes, Undated, 03627.
Deviation Request, Undated, 03628–03629.
Deviation Request, Dec. 9, 1986, 03630.
Deviation Request, Dec. 4, 1986, 03631.
Handwritten Notes, Dec. 4, 1986, 03632.
Deviation Request, Dec. 9, 1986, 03633.
Deviation Request, Feb. 20, 1987, 03634.
Deviatson Request, Feb. 25, 1987, 03635.
Deviation Request, Undated, 03636.
Deviation Request, Mar. 11, 1987, 03637.
Correspondence, Ron Frankel, Mar. 10, 1987, 03638.
Correspondence, Herb Earl, Nov. 29,1990, 03639.
Print, Undated, 03640.
Report, Feb. 8, 1990, 03641.
Correspondence, John Lundgren, Mar. 11, 1990, 03642–03643.
Print, Date Stamped Nov. 13, 1989, 03644.
Print, Sep. 28, 1989, 03645.
Print, Date Stamped Feb. 2, 1990, 03646.
Correspondence, John Lundgren, Undated, 03647.
Print, Oct. 22, 1986, 03648.
Print, Oct. 7, 1985, 03649.
Correspondence, John Lundgren, Apr. 6, 1990, 03650.
Print, Date Stamped Dec. 1, 1986, 03651.
Print, Aug. 29, 1985, 03652.
Print, Mar. 6, 1990, 03653–03655.
Handwritten Notes, Undated, 03656.
Print, Date Stamped Jul. 15, 1987, 03657.
Print, Date Stamped, Sep. 1, 1986, 03658.
Print, Date Stamped, Oct. 13, 1989, 03659.
Print, Feb. 6, 1990, 03660–03661.
Print, Date Stamped Feb. 2, 1990, 03662–03665.
Handwritten Notes, Undated, 03666.
Quotation, May 25,1985, 03667.
Memorandum, Herman Koestring, May 22, 1985, 03668.
Quotation, May 28, 1985, 03669.
Correspondence, Herb Earl, May 20, 1985, 03670.
Handwritten Notes, Undated, 03671.
Correspondence, Herb Earl, Feb. 6, 1986, 03672.
Cost Estimate Request, Jan. 13, 1986, 03673–03674.
Handwritten Notes, Undated, 03675.
Print, May 31,1985, 03676.
Memorandum, Herman Koestring, Feb. 10, 1986, 03677.
Memorandum, Jim Peterson, Jul. 9, 1987, 03678.
Report with Handwritten Notes, Undated, 03679–03680.
Memorandum, Jim Peterson, Jul. 9, 1987, 03681.
Handwritten Notes, Undated, 03682.
Quotation, Herb Earl, Sep. 25, 1985, 03683.
Correspondence, Herb Earl, May 20, 1985, 03684.
Quotation, Jim Peterson, Jun. 9, 1987, 03685.
Cost Estimate Request, May 14, 1987, 03686.
Print, Apr. 1, 1986, 03687.
Correspondence, Herb Earl, Mar. 1, 1990, 03688.
Correspondence, Herb Earl, Nov. 29, 1990, 03689–03690.
Correspondence, Herb Earl, Apr. 20, 1990, 03691.
Correspondence, Herb Earl, Jul. 13, 1987, 03692.
Quotation, Linda Johnson, May 28,1985, 03693.
Handwritten Notes, Undated, 03694.
Correspondence, Herb Earl, Jul. 23, 1984, 03695–03697.
Correspondence, Jan. 26, 1989, 03698.
Correspondence, Herb Earl, Feb. 28, 1989, 03699.
Cost Estimate, Sep. 18, 1984, 03700–03701.
Report, Dec. 29, 1988, 03702.
Report, Dec. 12, 1988, 03703.
Report, Undated, 03704.
Handwritten Notes, Sep. 2, 1986, 03705–03706.
Handwritten Notes, Undated, 03707.
Quotation, Linda Johnsen, Feb. 14, 1985, 03708.
Quotation, Linda Johnsen, Feb. 18, 1985, 03709.
Correspondence, Herb Earl, Jul. 13, 1987, 03710.
Interoffice Correspondence, George Pazdirek, May 24, 1985, 03711–03716.
Request for Quotation, Apr. 15, 1985, 03717.
Request for Quotation, Apr. 15, 1985, 03718.
Request for Quotation, Apr. 28, 1982, 03719.
Prints, Sep. 7, 1972, 03720–03721.
Request for Quotation, Apr. 28, 1982, 03722.
Print, Jul. 22, 1974, 03723.
Request for Quotation, Apr. 28, 1982, 03724.
Request for Quotation, Apr. 28, 1982, 03725.
Print, Aug. 21, 1981, 03726.
Print, Feb. 22, 1981, 03727.
Purchase Requisition, Herb Earl, Feb. 10, 1986, 03728–03729.
Chemical Testing Report, Jun. 19, 1986, 03730.
Handwritten Notes, Oct. 8, 1986, 03731.
Engineering Change Notice, Bill Hamilton, Jun. 17, 1985, 03732.
Print, May 1,1985, 03733.
Correspondence, Bill Hamilton, Apr. 9, 1985, 03734.
Correspondence, Bill Hamilton, Apr. 3, 1985, 03735.
Print, Mar. 27, 1984, 03736–03737.
Engineering Change Notice, Bill Hamilton, May 30, 1985, 03738.
Correspodence, Jim Robinson, Apr. 12, 1990, 03739–03741.
Correspondence, Herb Earl, Jun. 3, 1992, 03742.
Correspondence, Herb Earl, Aug. 17, 1992, 03743–03744.
Correspondence, Mike S., Jul. 24, 1992, 03745–03747.
Print with Handwritten Notes, Undated, 03748.
Handwntten Notes, Undated, 03749.
Correspondence, Herb EarI, Jun. 3, 1992, 03750.
Correspondence, Bill Hamilton, Oct.11, 1984, 03751.
Correspondence, Bill Hamilton, Feb. 22, 1985, 03752.
Print, Dec. 10, 1984, 03753.
Purchase Order, Jun. 20, 1985, 03754.
Print, May 1, 1985, 03755–03756.
Print, Dec. 13, 1984, 03757.
Print, Dec. 3, 1985, 03758.
Memorandum, R.B. Rogers, Jan. 8, 1985, 03759.
Correspondence, Larry Trout, Mar. 14, 1989, 03760.
Correspondence, Herb Earl, Sep. 17, 1985, 03761.
Correspondence, Darrell Burkeen, Aug. 20, 1985, 03762.
Document entitled, "Roller Follower Body Blank–Stanadyne Samples." May 7, 1975, 03763.
Document entitled, "Roller Follower Body Blank–Stanadyne Samples," May 7, 1985, 03764–03765.
Document entitled, "Roller Follower Body Blank–Stanadyne Samples," May 7, 1975, 03766.
Document entitled, "Roller Follower Body Blank–Stanadyne Samples," May 7, 1985, 03767–03768.
Correspondence, Herb Earl, Dec. 11, 1986, 03769–03776.

Shipping Notice, Roman Dombrowski, Apr. 11, 1986, 03777.
Memorandum, Bob McCormick, May 2, 1990, 03778–03779.
Measurements, May 4, 1990, 03780.
Shipping Notice, Gene Amastani, May 8, 1990, 03781.
Interoffice Correspondence, George Pazdirek, Mar. 11, 1986, 03782.
Print, Jan. 29, 1986, 03783.
Correspondence, Herb Earl, Jul. 11, 1986, 03784.
Handwritten Notes, Undated, 03785–03790.
Slug Progressions, Undated, 03791–03795.
Handwritten Notes, Undated, 03796.
Control Plan, Ron Frankel, Nov. 5, 1988, 03797–03805.
Correspondence, Herb Earl, Jun. 10, 1985, 03806.
Print, Jan. 2, 1985, 03807.
Handwritten Notes, Undated, 03808.
Print, Jun. 12, 1973, 03809.
Handwritten Notes, A.il 15, 1986, 03810.
Handwritten Specifications, Undated, 03811–03812.
Slug Progressions, Undated, 03813–03814.
Slug Progressions, Undated, 03815–03817.
Print, Nov. 20, 1985, 03818.
Correspondence, Dan McMillan, Aug. 2, 1990, 03819–03821.
Correspondence, R.E. McCue, May 1, 1985, 03822–03823.
Correspondence, Herb Earl, Aug. 26, 1976, 03824.
Print, Oct. 4,1966, 03825.
Print, Jun. 12, 1967, 03826.
Print, Undated, 03827.
Memorandum, Jim Peterson, Jul. 9, 1987, 03828.
Correspondence, Larry Trout, May 9, 1989, 03829.
Correspondence, R.E. McCue, Dec. 17, 1985, 03830.
Handwritten Notes, Undated, 03831.
Print, Undated, 03832.
Handwritten Notes, Undated, 03833.
Print, Undated, 03834.
Correspondence, Herb Earl, Nov. 20, 1986, 03835–03836.
Handwritten Notes, Undated, 03837–03838.
Corrrespondence, Herb Earl, Nov. 20, 1986, 03839.
Handwritten Notes, Undated, 03840–03841.
Correspondence, Bill Hamilton, Mar. 15 1985, 03842.
Print, Dec. 4, 1984, 03843.
Correspondence, Herb Earl, Feb. 27, 1985, 03844–03845.
Purchase Requisition, Undated, 03846.
Quotation, Undated, 03847.
Report, Undated, 03848–03849.
Print, Dec. 4, 1984, 03850.
Inspection Layout, Dec. 13, 1984, 03851.
Report, Undated, 03852.
Slug Progressions, Undated, 03853–03858.
Engineering Change Notice, Jun. 20, 1989, 03859.
Engineering Change Notice, Feb. 17, 1986, 03860.
Production Order Schedule, Mar. 19, 1986, 03861.
Handwritten Notes, Undated, 03862–03863.
Tool Form Purchase Order, Nov. 18, 1985, 03864–03866.
Handwritten Notes, Undated, 03867.
Correspondence, Herb Earl, Sep. 17, 1985, 03868.
Handwritten Notes, Undated, 03869.
Correspondence, John Peterson, Dec. 19, 1985, 03870.
Tool Form Purchase Order, Sep. 26, 1986, 03871–03873.
Tool Description, Undated, 03874–03877.
Correspondence, Herb Earl, Aug. 26, 1976, 03878.
Print, Oct. 4, 1986, 03879.
Print, Jun. 12, 1967, 03880.
Print, Undated, 03881.
Invoice, May 8, 1986, 03882.
Print, May 6, 1986, 03883.
Correspondence, Bill Hamilton, Jun. 19, 1986, 03884.
Correspondence, Connie, Dec. 11, 1986, 03885.
Engineering Change Notice, Dec. 10, 1986, 03886.
Phase II Indexing Jig Information, Undated, 03887.
Charts, Undated, 03888–03889.
Cost Estimates, Undated, 03890.
Handwritten Notes, Undated, 03891.
Interoffice Correspondence, Barry MacLean, Aug. 31, 1976, 03892–03894.
Correspondence, Sep. 2, 1976, 03895–03896.
Correspondence, Herb Earl, Aug. 26, 1976, 03897.
Print, Oct. 4, 1966, 03898.
Print, Jun. 12, 1967, 03899.
Print, Undated, 03900–03901.
Print, Feb. 18, 1967, 03902.
Interoffice Correspondence, Ernie Majarucon, Sep. 8, 1976, 03903–03904.
Interoffice Correspondence, Roger Northup, Sep. 7, 1976, 03905.
Handwritten Notes, Undated, 03906–03908.
Correspondence, Herb Earl, May 7, 1986, 03909.
Purchase Order, Jan. 2, 1985, 03910.
Purchase Order, Jan. 2, 1985, 03911.
Correspondence, Herb Earl, May 6, 1986, 03912.
Correspondence, John Peterson, May 1,1986, 03913.
Correspondence, Jerry Reid, Sep. 20, 1991, 03914.
Handwritten Notes, Undated, 03915.
Handwritten Notes, Jun. 8, 1992, 03916.
Handwritten Notes, Jun. 17, 1992, 03917.
Handwritten Notes, Jun. 8, 1992, 03918.
Handwritten Notes, May 20, 1992, 03919.
Report, Sep. 14, 1988, 03920.
Correspondence, Leon Peasley, Apr. 12, 1989, 03921.
Tool Delivery Order, Mar. 10, 1989, 03922.
Correspondence, Dan B., Mar. 8, 1990, 03923.
Tool Description, Undated, 03924–03925.
Correspondence, Herb Earl, Jul. 13, 1987, 03926.
Handwritten Notes, Apr. 8, 1985, 03927.
Correspondence, Herb Earl, Jun. 10, 1985, 03928–03929.
Slug Progression, Undated, 03930.
Engineering Change Notice, Jan. 14, 1988, 03931.
Slug Progression, Undated, 03932–03932.
Print, Jan. 2, 1985, 03933.
Purchase Order, Sep. 18, 1985, 03934–03936.
Correspondence, Herb Earl, Jul. 23, 1984, 03937–03938.
Handwritten Notes, Apr. 8, 1985, 03939.
Handwritten Notes, Undated, 03940.
Purchase Order, J. Peterson, Jun. 25,1986, 03941.
Print, Apr. 30, 1986, 03942.
Handwritten Notes, Undated, 03943.
Correspondence, Herb Earl, Dec. 9, 1986, 03944.
Correspondence, Gene Amastani, Jul. 30, 1990, 03945.
Correspondence, Herb Earl, Jul. 13, 1987, 03946.
Print, Jun. 12, 1967, 03947.
Print, Undated, 03948–03949.
Print, Dec. 18, 1967, 03950.
Print, Undated, 03951–03952.
Print, Dec. 18, 1967, 03953–03954.
Print, Jun. 12, 1967, 03955–03956.
Engineering Change Notice, Aug. 1, 1991, 03957.

Print, Undated, 03958.
Slug Progression, Undated, 03959.
Engineering Change Notice, Jun. 26, 1989, 03960.
Print, Undated, 03961.
Correspondence, Herb Earl, Jul. 13, 1987, 03962.
Correspondence, M. Curtis, Apr. 1, 1986, 03963.
Handwritten Notes, Undated, 03964–03965.
Correspondence, Herb Earl, Mar. 12,1986, 03966.
Memorandum, Herb Earl, Mar. 5, 1986, 03967.
Memorandum, Herman Koestring, Dec. 13, 1985, 03968.
Memorandum, Herman Koestring, Dec. 10, 1985, 03969.
Handwritten Notes, Undated, 03970.
Correspondence, Herb Earl, Jan. 13, 1988, 03971.
Prints, Sep. 28, 1984, 03972–03974.
Print, Undated, 03975.
Print, Jun. 12, 1967, 03976.
Phase II Indexing Jig Information, Undated, 03977.
Charts, Undated, 03978–03979.
Information regarding Electronic Diesel Fuel Injection Pump, Undated, 03980–03983.
Photographs, Undated, 03984.
Handwritten Notes, Undated, 03985.
Correspondence, David LaVieri, Feb. 24, 1989, 03986–03987.
Print, Dec. 4, 1984, 03988–03991.
Prints, Jan. 29, 1986, 03992–03993.
Print, Dec. 26, 1984, 03994.
Prints, Jan. 6, 1986, 03995–03996.
Print, May 1, 1985, 03997.
Print, Nov. 21,1985, 03998.
Print, Dec. 3, 1985, 03999.
Print, Sep. 23, 1985, 04000.
Print, May 31, 1985, 04001.
Print, Mar. 6, 1988, 04002.
Print, Dec. 4, 1984, 04003.
Prints, May 1, 1985, 04004–04006.
Print, Dec. 4, 1984, 04007.
Print, May 1, 1985, 04008.
Print, Dec. 4, 1984, 04009–04010.
Print, May 1, 1985, 04011.
Print, May 3, 1984, 04012.
Print, Mar. 27,1984, 04013.
Print, May 31,1985, 04014.
Print, Mar. 6, 1986, 04015.
Print, May 1, 1985, 04016.
Correspondence, Dec. 4, 1984, 04017–04019.
Correspondence, Darrell Burkeen, Jul. 25, 1986, 04020–04021.
Print, May 1, 1985, 04022.
Print, May 1, 1985, 04023.
Print, Feb. 20, 1989, 04024.
Print, Feb. 25, 1984, 04025.
Print, Jun. 11, 1984, 04026.
Print, Sep. 27, 1984, 04027.
Print, Jan. 15, 1985, 04028.
Print, Feb. 8, 1985, 04029.
Print, Dec. 3, 1988, 04030.
Print, Jan. 29, 1986, 04031.
Print, Mar. 13, 1985, 04032.
Print, Feb. 20, 1989, 04033.
Print, Feb. 20, 1989, 04034.
Engineering Change Notice, Feb. 5, 1986, 04035.
Print, May 1, 1985, 04036.
Print, Mar. 27, 1984, 04037.
Prints, Dec. 4, 1984, 04038–04043.
Prints, Jan. 6, 1986, 04043–04046.
Print, Jun. 3, 1985, 04047.
Interoffice Correspondence, George Pazdirek. May 24,1985, 04048–04050.
Print, Undated, 04051.
Prints, Date Stamped Oct. 14, 1986, 04052–04054.
Print, Dec. 4, 1984, 04055–04061.
Print, Jul. 12, 1984, 04062.
Print, Jul. 12, 1984, 04063.
Print, Mar. 27, 1984, 04064.
Print, Mar. 27, 1984, 04065.
Print, Mar. 27, 1984, 04066.
Print, Mar. 27, 1984, 04067.
Print, Jul. 12, 1984, 04068.
Print, Mar. 27, 1984, 04069.
Correspondence, Ross Rogers, Undated, 04070.
Print, Mar. 27, 1984, 04071.
Prints, Feb. 20, 1989, 04072–04073.
Print, May 31, 1985, 04074.

* cited by examiner

LEAKDOWN PLUNGER

FIELD OF INVENTION

This invention relates to bodies for leakdown plungers, and particularly to leakdown plungers used in combustion engines.

BACKGROUND OF THE INVENTION

Leakdown plungers are known in the art and are used in camshaft internal combustion engines. Leakdown plungers open and close valves that regulate fuel and air intake. As noted in U.S. Pat. No. 6,273,039 to Church, the disclosure of which is hereby incorporated herein by reference, leakdown plungers are typically fabricated through machining. Col. 8, ll. 1–3. However, machining is inefficient, resulting in increased labor and decreased production.

The present invention is directed to overcoming this and other disadvantages inherent in prior-art lifter bodies.

SUMMARY OF THE INVENTION

The scope of the present invention is defined solely by the appended claims, and is not affected to any degree by the statements within this summary. Briefly stated, a leakdown plunger, comprising an outer surface, enclosing a first cavity and a second cavity, wherein the first cavity includes a first inner surface configured to house a cylindrical insert, the second cavity includes a second inner surface cylindrically shaped, and at least one of the cavities is fabricated through forging.

DETAILED DESCRIPTION OF THE PRESENTLY PREFERRED EMBODIMENTS

Figure 1:
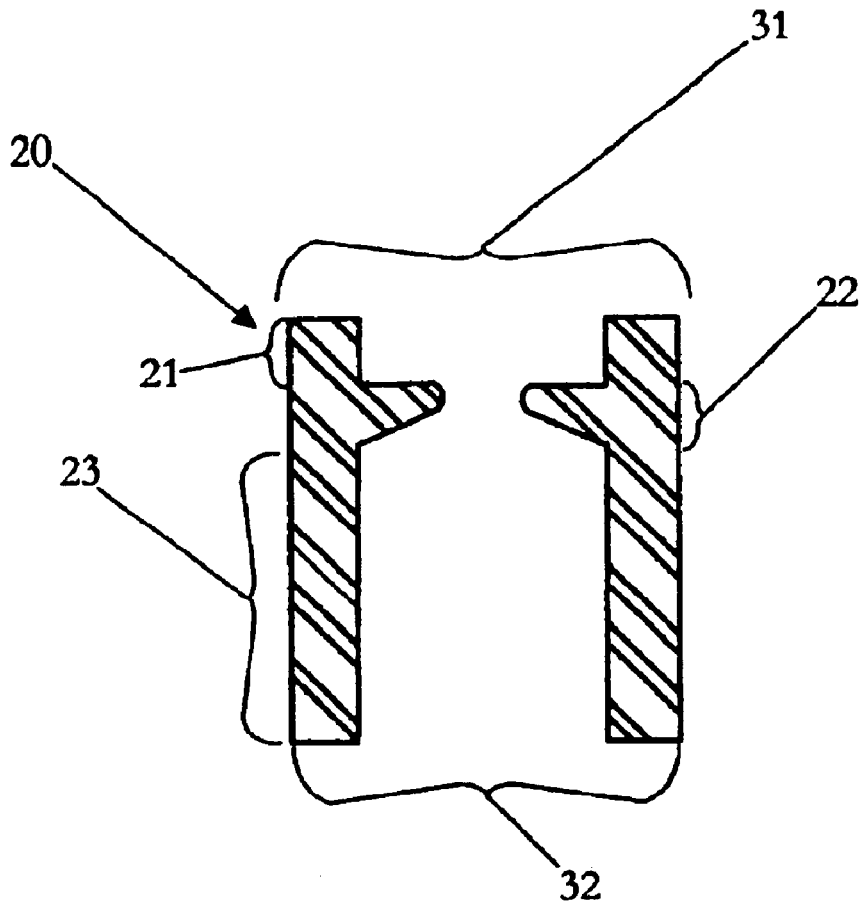
FIG. 1 depicts a preferred embodiment of a leakdown plunger.
Figure 2:
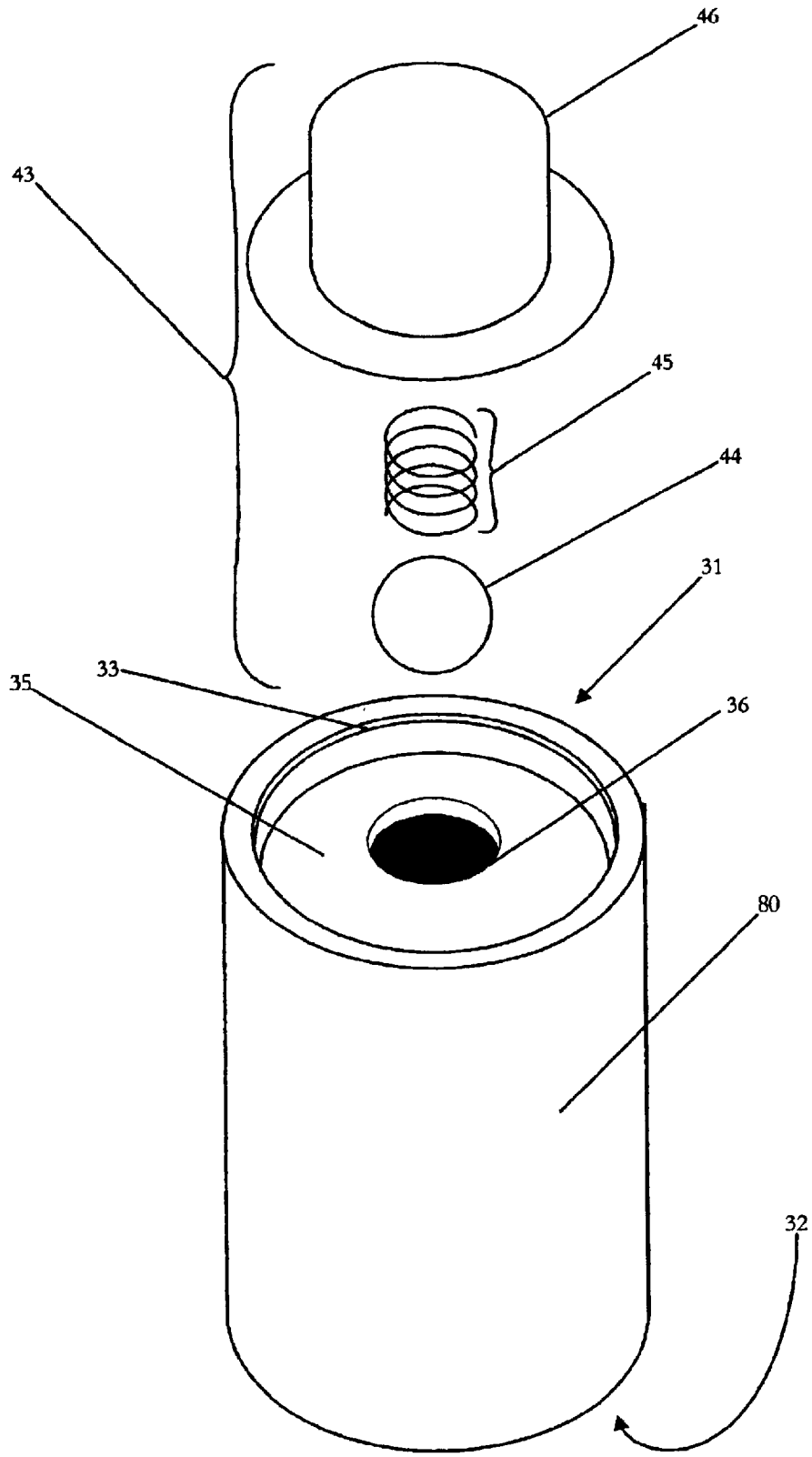
FIG. 2 depicts a preferred embodiment of a leakdown plunger.
Figure 3:
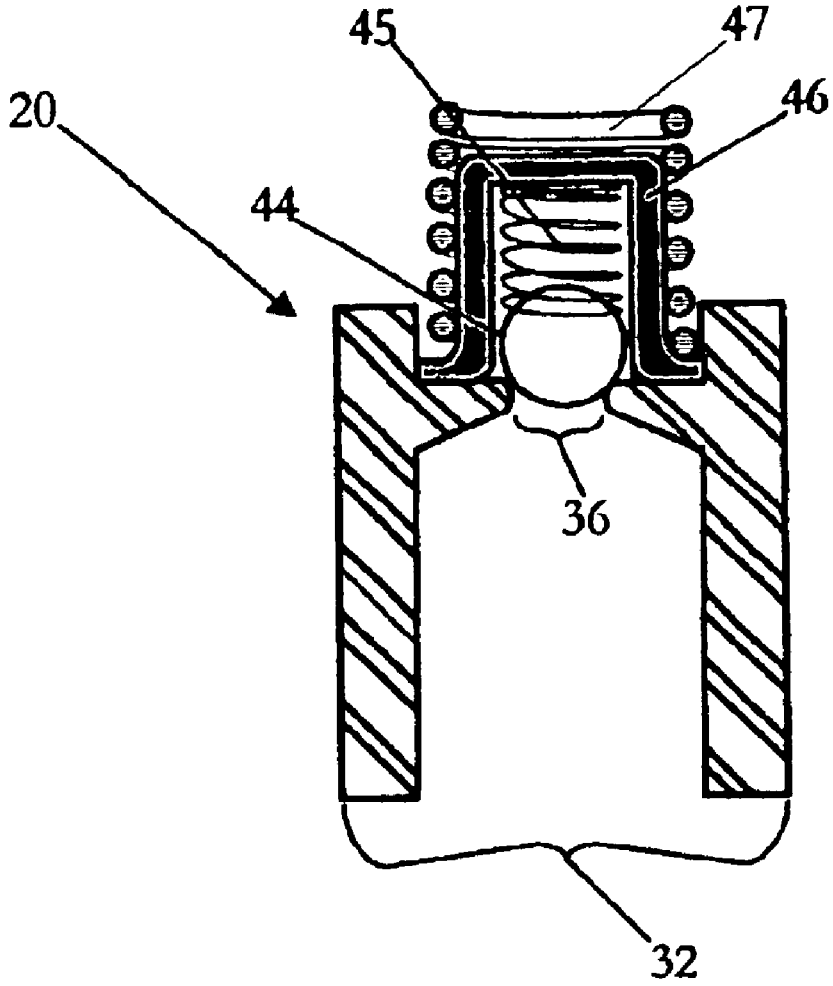
FIG. 3 depicts the cross-sectional view of a preferred embodiment of a leakdown plunger.

Turning now to the drawings, FIGS. 1, 2, and 3 show a preferred embodiment of a leakdown plunger 10. The leakdown plunger 10 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the leakdown plunger 10 is composed of pearlitic material. According to still another aspect of the present invention, the leakdown plunger 10 is composed of austenitic material. According to another aspect of the present invention, the metal is a ferritic material.

The body 20 is composed of a plurality of plunger elements. According to one aspect of the present invention, the plunger element is cylindrical in shape. According to another aspect of the present invention, the plunger element is conical in shape. According to yet another aspect of the present invention, the plunger element is hollow.

FIG. 1 depicts a cross-sectional view of the leakdown plunger 10 of the preferred embodiment of the present invention composed of a plurality of plunger elements. FIG. 1 shows the body, generally designated 20. The body 20 functions to accept a liquid, such as a lubricant and is provided with a first plunger opening 31 and a second plunger opening 32. The first plunger opening 31 functions to accommodate an insert.

The body 20 of the preferred embodiment is fabricated from a single piece of metal wire or rod and is described herein as a plurality of plunger elements. The body 20 includes a first hollow plunger element 21, a second hollow plunger element 23, and an insert-accommodating plunger element 22. As depicted in FIG. 1, the first hollow plunger element 21 is located adjacent to the insert-accommodating plunger element 22. The insert-accommodating plunger element 22 is located adjacent to the second hollow plunger element 23.

The body 20 is provided with a plurality of outer surfaces and inner surfaces. FIG. 2 depicts the first plunger opening 31 of an alternative embodiment. The first plunger opening 31 of the embodiment depicted in FIG. 2 is advantageously provided with a chamfered plunger surface 33, however a chamfered plunger surface 33 is not necessary. When used herein in relation to a surface, the term "chamfered" shall mean a surface that is rounded or angled.

The first plunger opening 31 depicted in FIG. 2 is configured to accommodate an insert. The first plunger opening 31 is shown in FIG. 2 accommodating a valve insert 43. In the embodiment depicted in FIG. 2, the valve insert 43 is shown in an exploded view and includes a generally spherically shaped member 44, a spring 45, and a cap 46. Those skilled in the art will appreciate that valves other than the valve insert 43 shown herein can be used without departing from the scope and spirit of the present invention.

As shown in FIG. 2, the first plunger opening 31 is provided with an annular plunger surface 35 defining a plunger hole 36. The plunger hole 36 is shaped to accommodate an insert. In the embodiment depicted in FIG. 2, the plunger hole 36 is shaped to accommodate the spherical member 44. The spherical member 44 is configured to operate with the spring 45 and the cap 46. The cap 46 is shaped to at least partially cover the spherical member 44 and the spring 45. The cap 46 is preferably fabricated through stamping. However, the cap may be forged or machined without departing from the scope or spirit of the present invention.

FIG. 3 shows a cross-sectional view of the embodiment depicted in FIG. 2 in a semi-assembled state. In FIG. 3 the valve insert 43 is shown in a semi-assembled state. As depicted in FIG. 3, a cross-sectional view of a cap spring 47 is shown around the cap. Those skilled in the art will appreciate that the cap spring 47 and the cap 46 are configured to be inserted into the well of another body. According to one aspect of the present invention, the cap spring 47 and the cap 46 are configured to be inserted into the well of a lash adjuster, such as the lash adjuster disclosed in Applicant's "Lash Adjuster Body," application Ser. No. 10/316,264 filed on Oct. 18, 2002, the disclosure of which is incorporated herein by reference. In the preferred embodiment, the cap spring 47 and the cap 46 are configured to be inserted into the well 150 of a lash adjuster body 110. According to another aspect of the present invention, the cap spring 47 and the cap 46 are configured to be inserted into the well of a valve lifter, such as the valve lifter disclosed in Applicant's "Valve Lifter Body," application Ser. No. 10/316,263, filed on Oct. 18, 2002, the disclosure of which is incorporated herein by reference. In an alternative embodiment, the cap spring 47 and the cap 46 are configured to be inserted into the lifter well 362 of the valve lifter body 310.

The cap 46 is configured to at least partially depress the spring 45. The spring 45 exerts a force on the spherical member 44. The annular plunger surface 35 is shown with the spherical member 44 partially located within the plunger hole 36.

Figure 4:
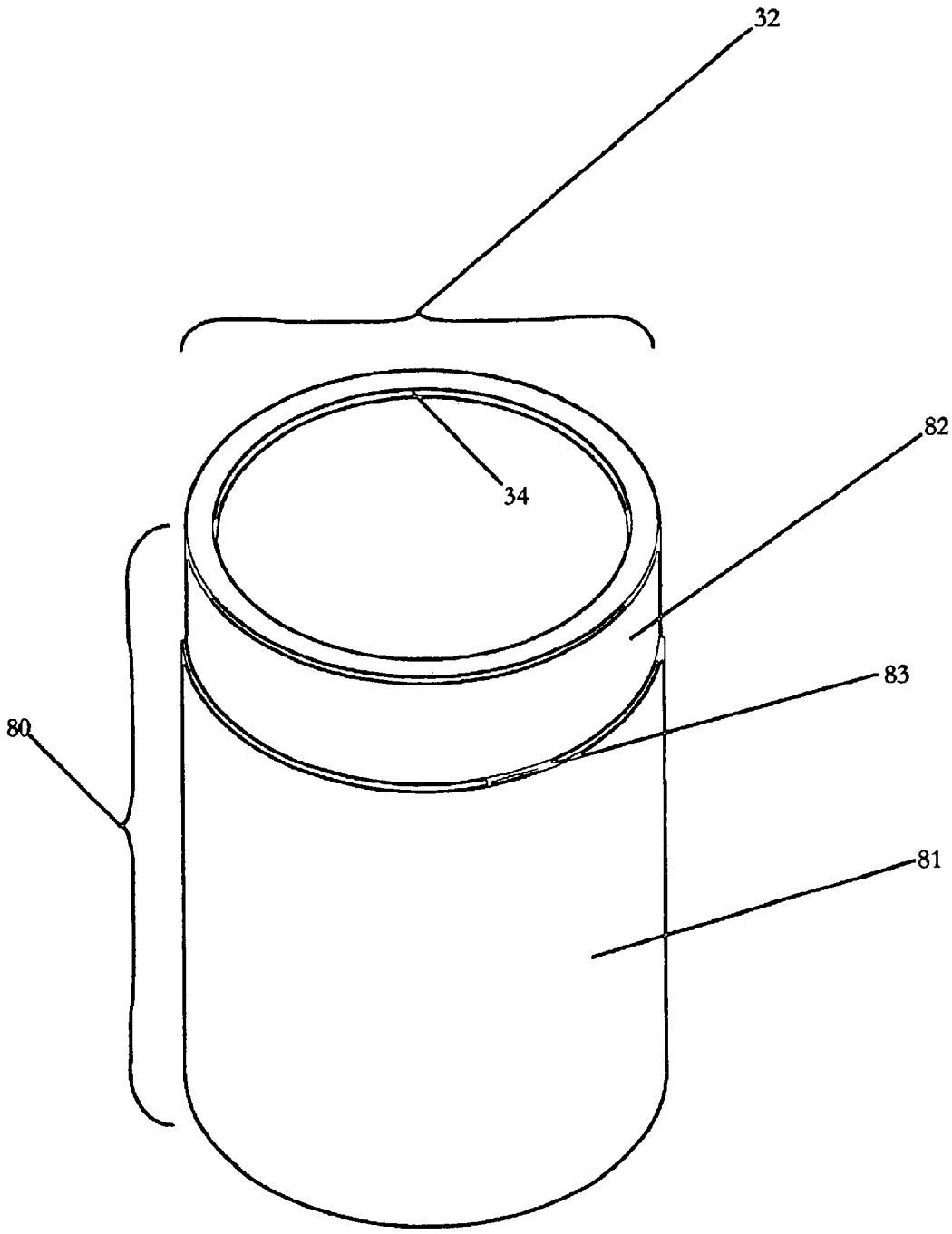
FIG. 4 depicts the top view of another preferred embodiment of a leakdown plunger.
Figure 11:
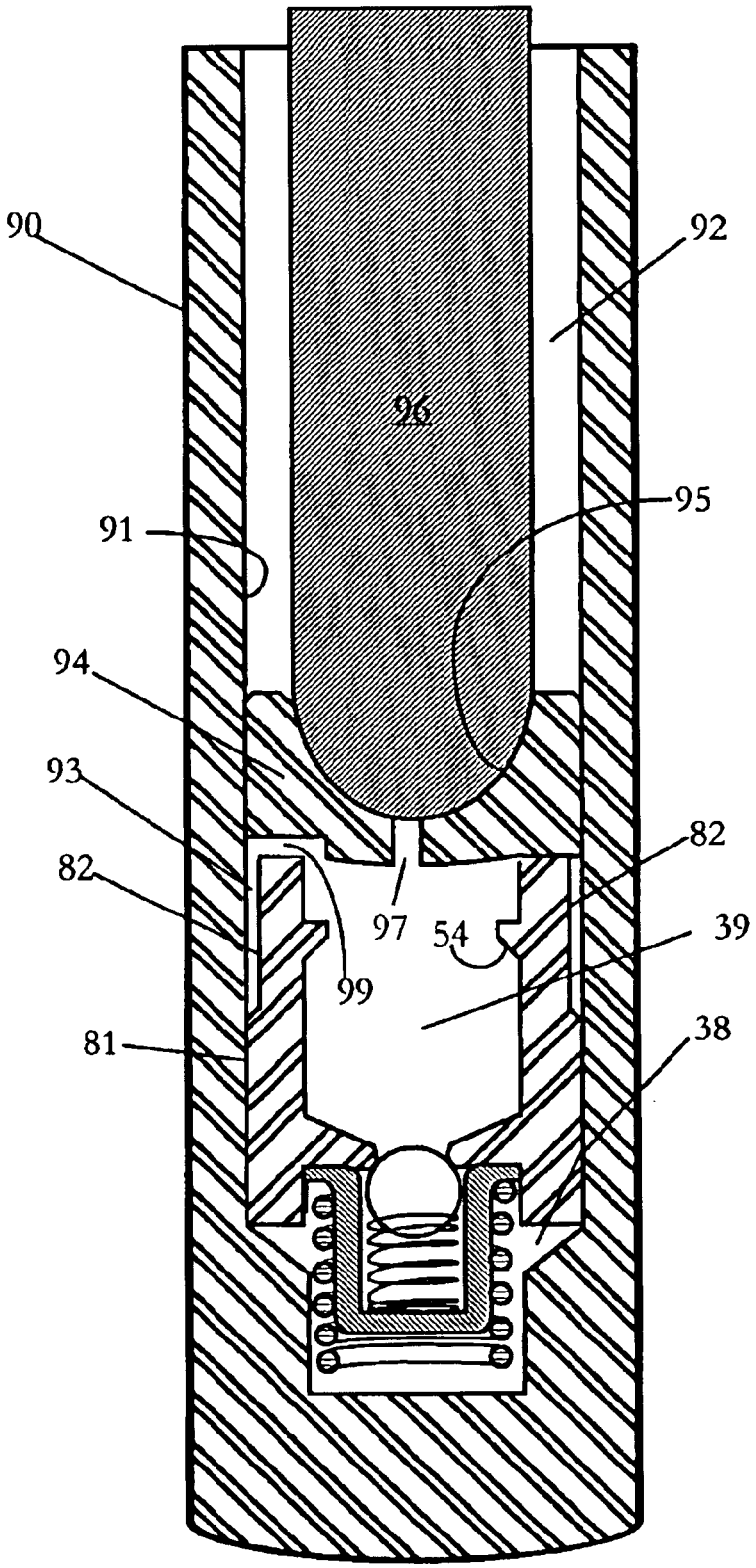
FIG. 11 depicts a sixth embodiment of a leakdown plunger.

Referring now to FIG. 2, the embodiment is provided with an outer plunger surface 80. The outer plunger surface 80 is preferably shaped so that the body 20 can be inserted into a lash adjuster body, such as that disclosed in the inventors' patent application entitled "Lash Adjuster Body," application Ser. No. 10/316,264 filed on Oct. 18, 2002. In the preferred embodiment, the outer plunger surface 80 is shaped so that the body 20 can be inserted into the lash adjuster body 10. Depicted in FIG. 11 is a lash adjuster body 110 having an inner lash adjuster surface 140 defining lash adjuster cavity 130. An embodiment of the leakdown plunger 10 is depicted in FIG. 11 within the lash adjuster cavity 130 of the lash adjuster body 110. As shown in FIG. 4, the body 20 of the leakdown plunger 10 is provided with an outer plunger surface 80 that is cylindrically shaped.

FIG. 4 depicts an alternative embodiment of the leakdown plunger 10. FIG. 4 depicts the second plunger opening 32 in greater detail. The second plunger opening 32 is shown with a chamfered plunger surface 34. However, those with skill in the art will appreciate that the second plunger opening 32 may be fabricated without the chamfered plunger surface 34.

The embodiment depicted in FIG. 4 is provided with a plurality of outer surfaces. As shown therein, the embodiment is provided with an outer plunger surface 80. The outer plunger surface 80 includes a plurality of surfaces. FIG. 4 depicts a cylindrical plunger surface 81, an undercut plunger surface 82, and a conical plunger surface 83. As depicted in FIG. 4, the undercut plunger surface 82 extends from one end of the body 20 and is cylindrically shaped. The diameter of the undercut plunger surface 82 is smaller than the diameter of the cylindrical plunger surface 81.

The undercut plunger surface 82 is preferably forged through use of an extruding die. Alternatively, the undercut plunger surface 82 is fabricated through machining. Machining the undercut plunger surface 82 is accomplished through use of an infeed centerless grinding machine, such as a Cincinnati grinder. The surface is first heat-treated and then the undercut plunger surface 82 is ground via a grinding wheel. Those skilled in the art will appreciate that additional surfaces can be ground into the outer surface with minor alterations to the grinding wheel.

Referring again to FIG. 4, the conical plunger surface 83 is located between the cylindrical plunger surface 81 and the undercut plunger surface 82. Those with skill in the art will appreciate that the outer plunger surface 80 can be fabricated without the conical plunger surface 83 so that the cylindrical plunger surface 81 and the undercut plunger surface 82 abut one another.

Figure 6:
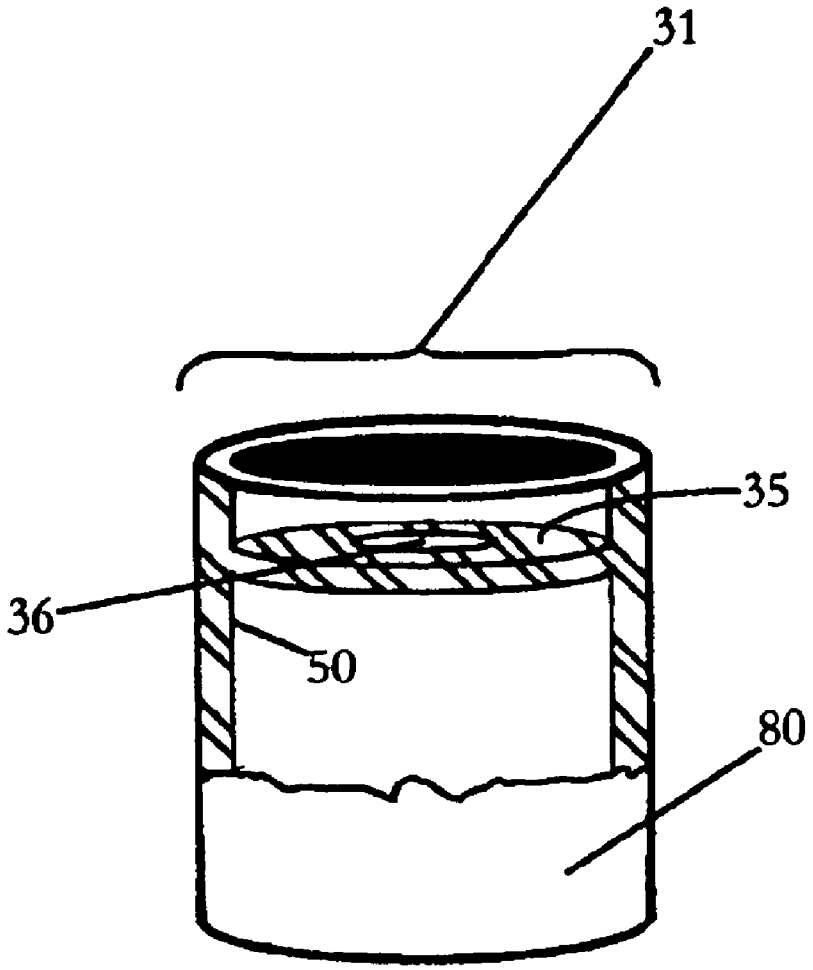
FIG. 6 depicts a third embodiment of a leakdown plunger.

FIG. 6 depicts an embodiment of the present invention with a section of the outer plunger surface 80 broken away. The embodiment depicted in FIG. 6 is provided with a first plunger opening 31. As shown in FIG. 6, the outer plunger surface 80 encloses an inner plunger surface 50. The inner plunger surface 50 includes an annular plunger surface 35 that defines a plunger hole 36.

Figure 7:
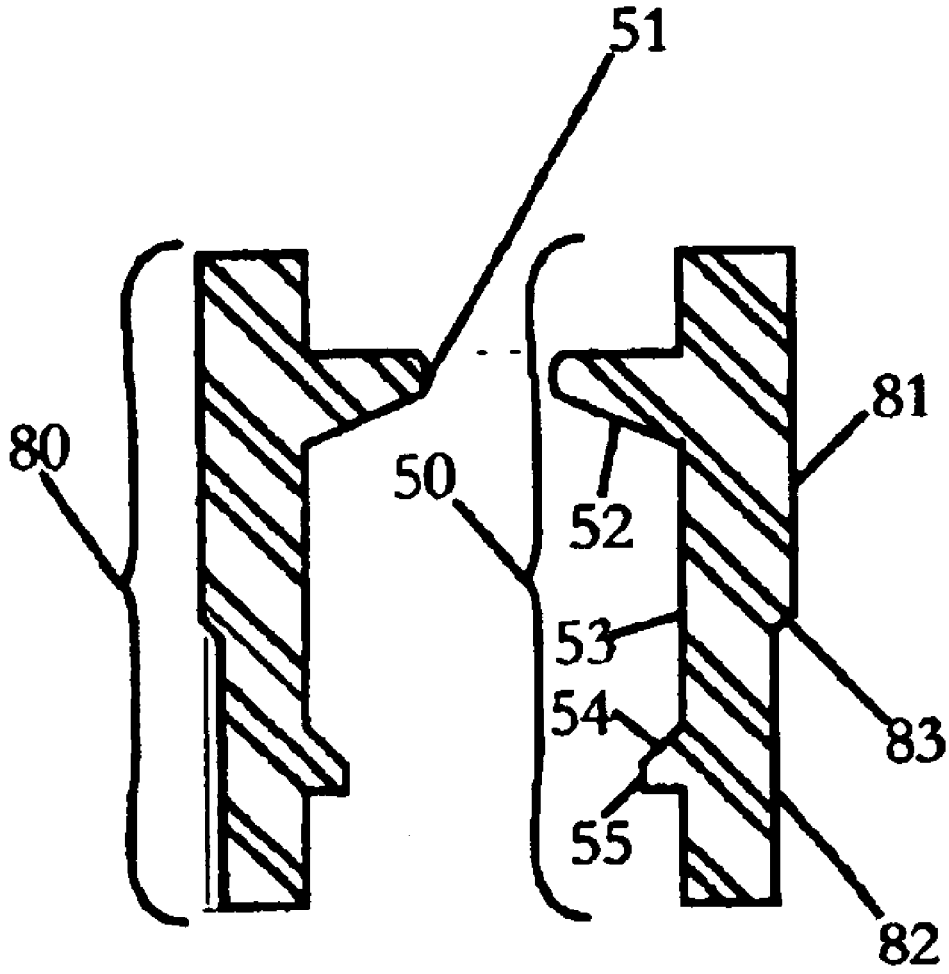
FIG. 7 depicts a fourth embodiment of a leakdown plunger.

FIG. 7 depicts a cross-sectional view of an alternative embodiment of the leakdown plunger 10. The body 20 shown in FIG. 7 is provided with an outer plunger surface 80 that includes a plurality of cylindrical and conical surfaces. In the embodiment depicted in FIG. 7, the outer plunger surface 80 includes an outer cylindrical plunger surface 81, an undercut plunger surface 82, and an outer conical plunger surface 83. As depicted in FIG. 7, the undercut plunger surface 82 extends from one end of the body 20 and is cylindrically shaped. The diameter of the undercut plunger surface 82 is smaller than, and preferably concentric relative to, the diameter of the outer cylindrical plunger surface 81. The outer conical plunger surface 83 is located between the outer cylindrical plunger surface 81 and the undercut plunger surface 82. Those with skill in the art will appreciate that the outer plunger surface 80 can be fabricated without the conical plunger surface 83 so that the outer cylindrical plunger surface 81 and the undercut plunger surface 82 abut one another.

Figure 8:
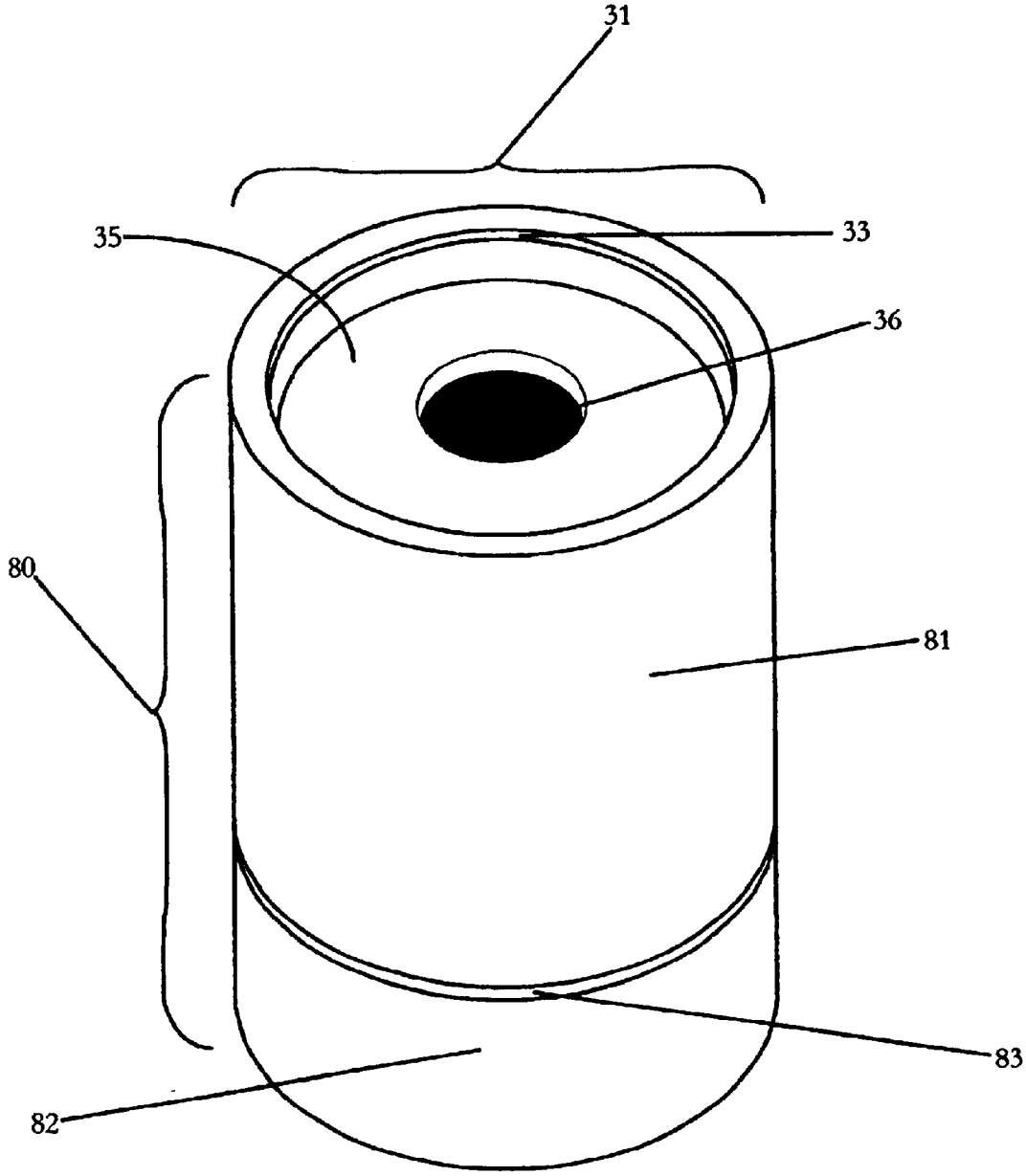
FIG. 8 depicts a fifth embodiment of a leakdown plunger.

FIG. 8 depicts in greater detail the first plunger opening 31 of the embodiment depicted in FIG. 7. The first plunger opening 31 is configured to accommodate an insert and is preferably provided with a first chamfered plunger surface 33. Those skilled in the art, however, will appreciate that the first chamfered plunger surface 33 is not necessary. As further shown in FIG. 8, the first plunger opening 31 is provided with a first annular plunger surface 35 defining a plunger hole 36.

The embodiment depicted in FIG. 8 is provided with an outer plunger surface 80 that includes a plurality of surfaces. The outer plunger surface 80 includes a cylindrical plunger surface 81, an undercut plunger surface 82, and a conical plunger surface 83. As depicted in FIG. 8, the undercut plunger surface 82 extends from one end of the body 20 and is cylindrically shaped. The diameter of the undercut plunger surface 82 is smaller than the diameter of the cylindrical plunger surface 81. The conical plunger surface 83 is located between the cylindrical plunger surface 81 and the undercut plunger surface 82. However, those with skill in the art will appreciate that the outer plunger surface 80 can be fabricated without the conical plunger surface 83 so that the cylindrical plunger surface 81 and the undercut plunger surface 82 abut one another. Alternatively, the cylindrical plunger surface 81 may abut the undercut plunger surface 82 so that the conical plunger surface 83 is an annular surface.

Figure 9:
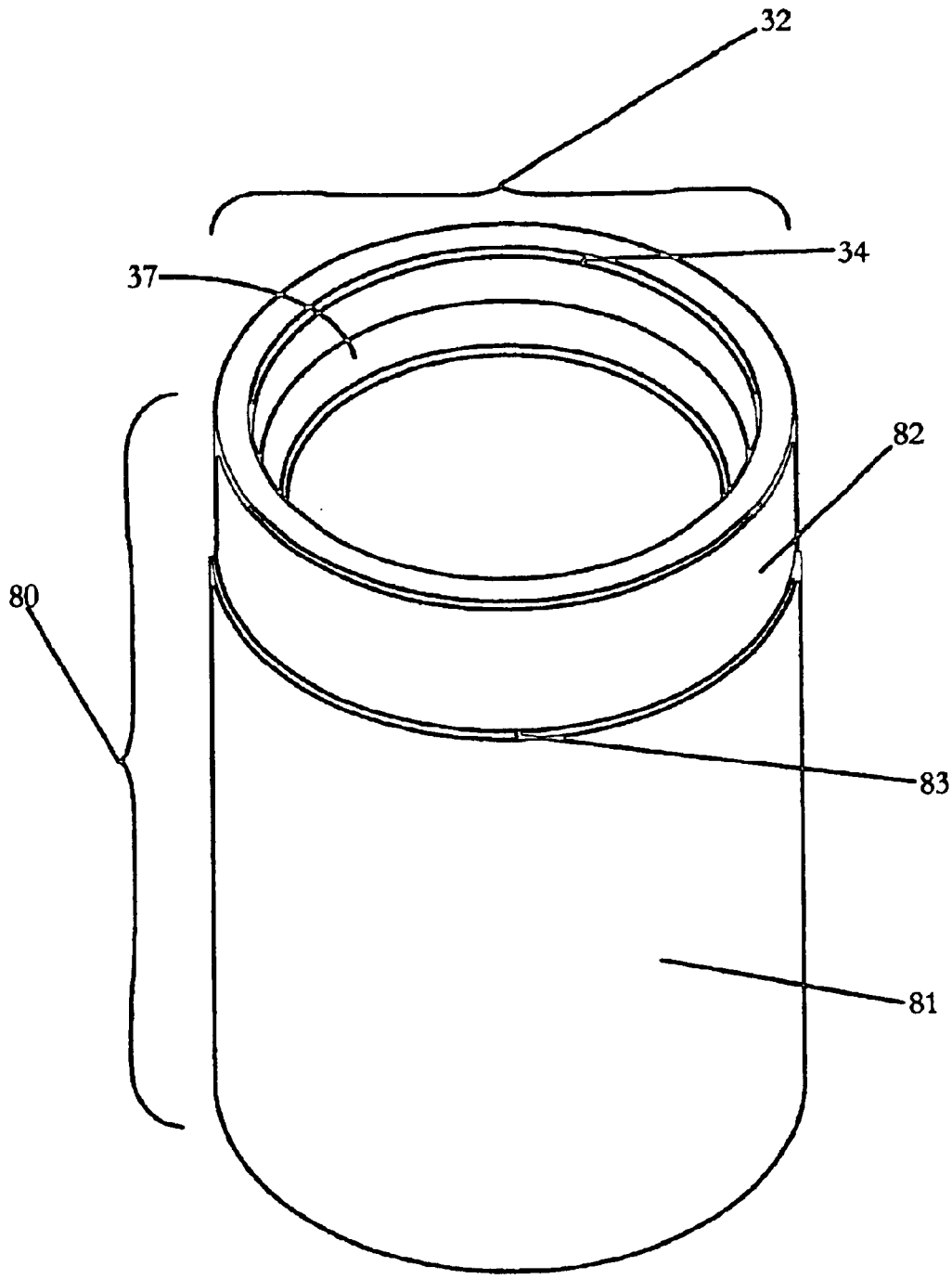
FIG. 9 depicts a perspective view of another preferred embodiment of a leakdown plunger.

FIG. 9 depicts the second plunger opening 32 of the embodiment depicted in FIG. 7. The second plunger opening 32 is shown with a second chamfered plunger surface 34. However, those with skill in the art will appreciate that the second plunger opening 32 may be fabricated without the second chamfered plunger surface 34. The second plunger opening 32 is provided with a second annular plunger surface 37.

Figure 10:
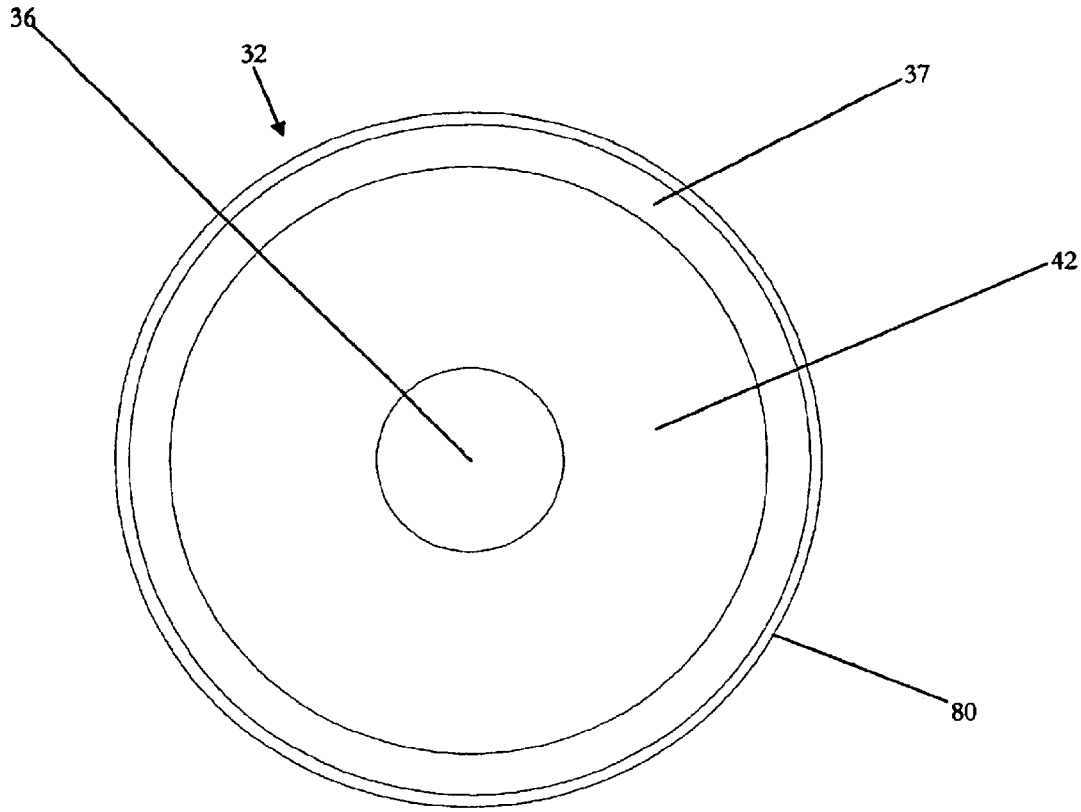
FIG. 10 depicts the top view of another preferred embodiment of a leakdown plunger.

FIG. 10 depicts a top view of the second plunger opening 32 of the embodiment depicted in FIG. 7. In FIG. 10, the second annular plunger surface 37 is shown in relation to the first conical plunger surface 42 and the plunger hole 36. As shown in FIG. 10, the plunger hole 36 is concentric relative to the outer plunger surface 80 and the annulus formed by the second annular plunger surface 37.

Figure 5:
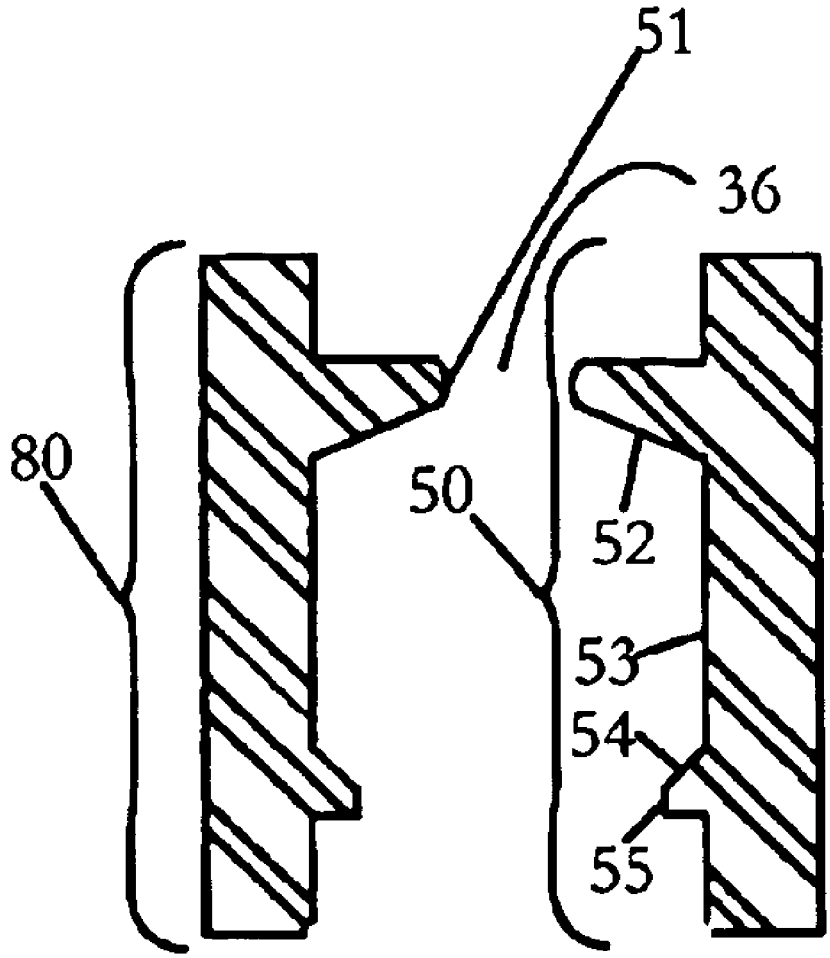
FIG. 5 depicts a second embodiment of a leakdown plunger.

Referring now to FIG. 5, the outer plunger surface 80 encloses an inner plunger surface 50. The inner plunger surface 50 includes a plurality of surfaces. In the alternative embodiment depicted in FIG. 5, the inner plunger surface 50 includes a rounded plunger surface 51 that defines a plunger hole 36. Those skilled in the art will appreciate that the rounded plunger surface 51 need not be rounded, but may be flat. The inner plunger surface 50 includes a first inner conical plunger surface 52 and a second inner conical plunger surface 54, and a first inner cylindrical plunger surface 53 and a second inner cylindrical plunger surface 55. The first inner conical plunger surface 52 is located adjacent to the rounded plunger surface 51. Adjacent to the first inner conical plunger surface 52 is the first inner cylindrical plunger surface 53. The first inner cylindrical plunger surface 53 is adjacent to the second inner conical plunger surface 54. The second inner conical plunger surface 54 is adjacent to the second inner cylindrical plunger surface 55.

FIG. 11 depicts an embodiment of the present invention within another body cooperating with a plurality of inserts. The undercut plunger surface 82 preferably cooperates with another body, such as a lash adjuster body or a valve lifter, to form a leakdown path 93. FIG. 11 depicts an embodiment of the present invention within a lash adjuster body 110; however, those skilled in the art will appreciate that the present invention may be inserted within other bodies, such as roller followers, and valve lifters.

As shown in FIG. 11, the undercut plunger surface 82 is configured to cooperate with the inner lash adjuster surface 140 of a lash adjuster body 110. The undercut plunger surface 82 and the inner lash adjuster surface 140 of the lash adjuster body 110 cooperate to define a leakdown path 93 for a liquid such as a lubricant.

The embodiment depicted in FIG. 11 is further provided with a cylindrical plunger surface 81. The cylindrical plunger surface 81 cooperates with the inner lash adjuster surface 140 of the lash adjuster body 110 to provide a first chamber 38. Those skilled in the art will appreciate that the first chamber 38 functions as a high pressure chamber for a liquid, such as a lubricant The second plunger opening 32 is configured to cooperate with a socket, such as the socket 210. The socket 210 is configured to cooperate with a push rod 296. In the embodiment depicted in FIG. 11, the socket 210 preferably functions as a socket, such as that disclosed in Applicants' "Socket," application Ser. No. 10/316,262, filed on Oct. 18, 2002, the disclosure of which is incorporated herein by reference. As shown in FIG. 11, the socket 210 is provided with a push rod cooperating surface 295. The push rod cooperating surface 295 is configured to function with a push rod 296. Those skilled in the art will appreciate that the push rod 296 cooperates with the rocker arm (not shown) of an internal combustion engine (not shown).

The socket 210 cooperates with the body 20 of the leakdown plunger 10 to define at least in part a second chamber 39 within the inner plunger surface 50. Those skilled in the art will appreciate that the second chamber 39 may advantageously function as a reservoir for a lubricant. The inner plunger surface 50 of the body 20 functions to increase the quantity of retained fluid in the second chamber 39 through the damming action of the second inner conical plunger surface 54.

The socket 210 is provided with a plurality of passages that function to fluidly communicate with the lash adjuster cavity 130 of the lash adjuster body 110. In the embodiment depicted in FIG. 11, the socket 210 is provided with a socket passage 237 and a plunger reservoir passage 238. The plunger reservoir passage 238 functions to fluidly connect the second chamber 39 with the cavity 130 of the lash adjuster body 110. As shown in FIG. 11, the socket passage 237 functions to fluidly connect the socket 210 and the cavity 130 of the lash adjuster body 110.

FIGS. 12 to 16 illustrate the presently preferred method of fabricating a leakdown plunger. FIGS. 12 to 16 depict what is known in the art as "slug progressions" that show the fabrication of the present invention from a rod or wire to a finished or near-finished body. In the slug progressions shown herein, pins are shown on the punch side; however, those skilled in the art will appreciate that the pins can be switched to the die side without departing from the scope of the present invention.

The leakdown plunger 10 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 12:
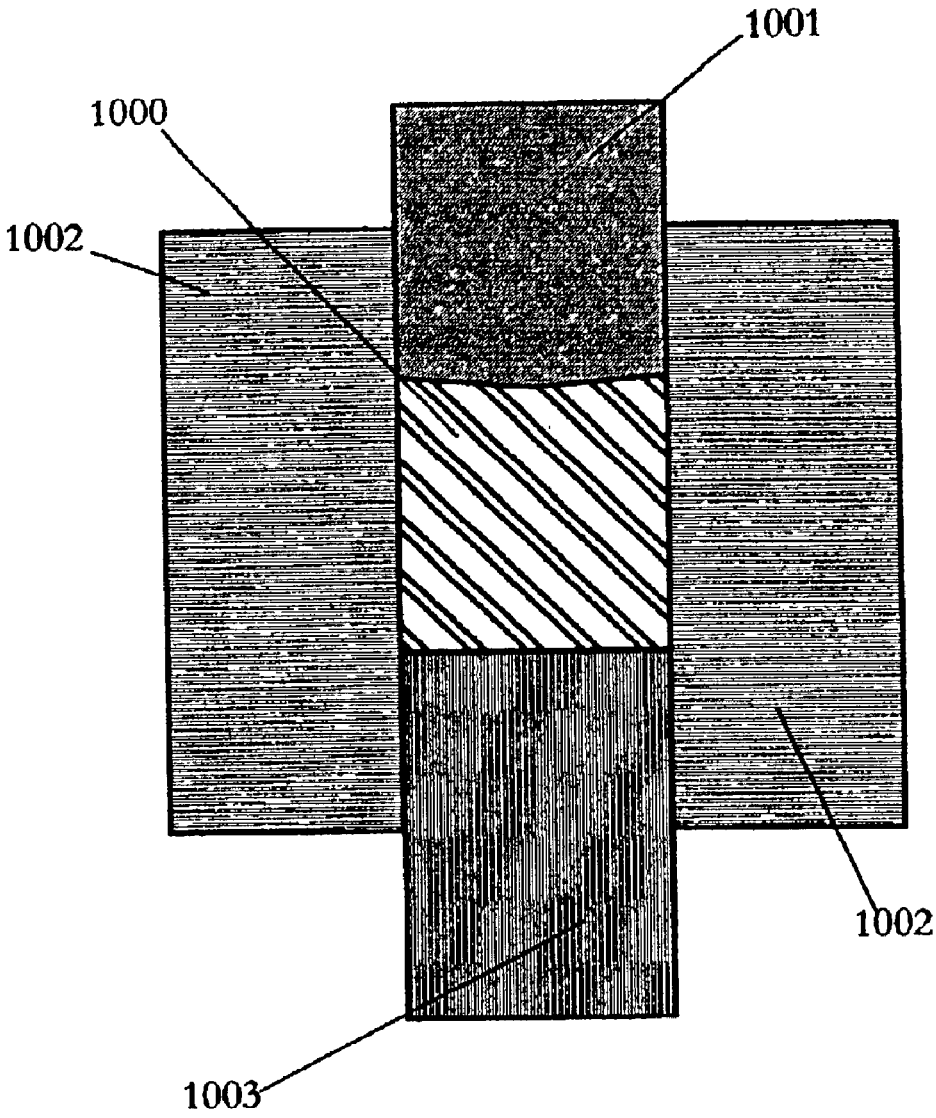
FIGS. 12–16 depict a preferred method of fabricating a leakdown plunger.

The process of forging an embodiment of the present invention begins with a metal wire or metal rod 1000 which is drawn to size. The ends of the wire or rod are squared off. As shown in FIG. 12, this is accomplished through the use of a first punch 1001, a first die 1002, and a first knock out pin 1003.

Figure 13:
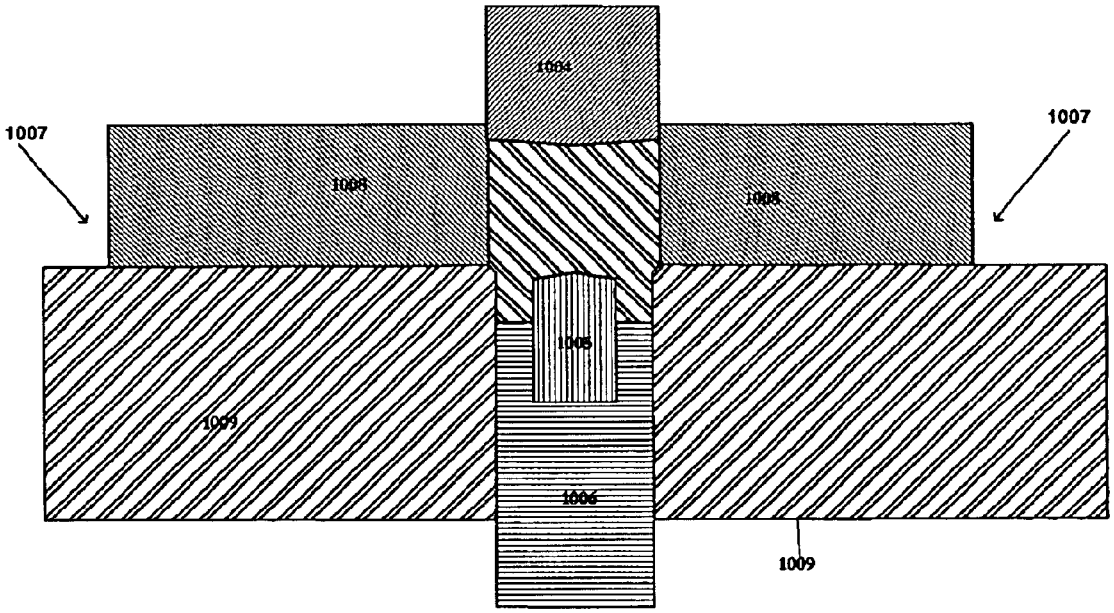

After being drawn to size, the wire or rod 1000 is run through a series of dies or extrusions. As depicted in FIG. 13, the fabrication of the second plunger opening 32 and the outer plunger surface 80 is preferably commenced through use of a second punch 1004, a second knock out pin 1005, a first sleeve 1006, and a second die 1007. The second plunger opening 32 is fabricated through use of the second knock out pin 1005 and the first sleeve 1006. The second die 1007 is used to fabricate the outer plunger surface 80. As shown in FIG. 13, the second die 1007 is composed of a second die top 1008 and a second die rear 1009. In the preferred forging process, the second die rear 1009 is used to form the undercut plunger surface 82 and the conical plunger surface 83.

Figure 14:
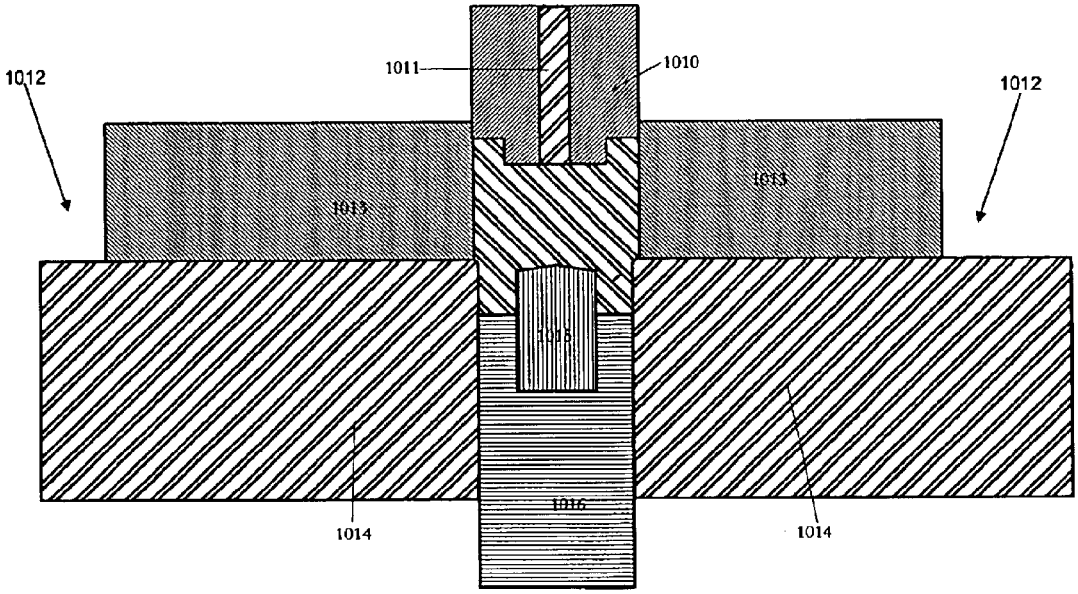

As depicted in FIG. 14, the first plunger opening 31 is fabricated through use of a third punch 1010. Within the third punch 1010 is a first pin 1011. The third punch 1010 and the first pin 1011 are used to fabricate at least a portion of the annular plunger surface 35. As shown in FIG. 14, it is desirable to preserve the integrity of the outer plunger surface 80 through use of a third die 1012. The third die 1012 is composed of a third die top 1013 and a third die rear 1014. Those skilled in the art will appreciate the desirability of using a third knock out pin 1015 and a second sleeve 1016 to preserve the forging of the second plunger opening 32.

Figure 15:
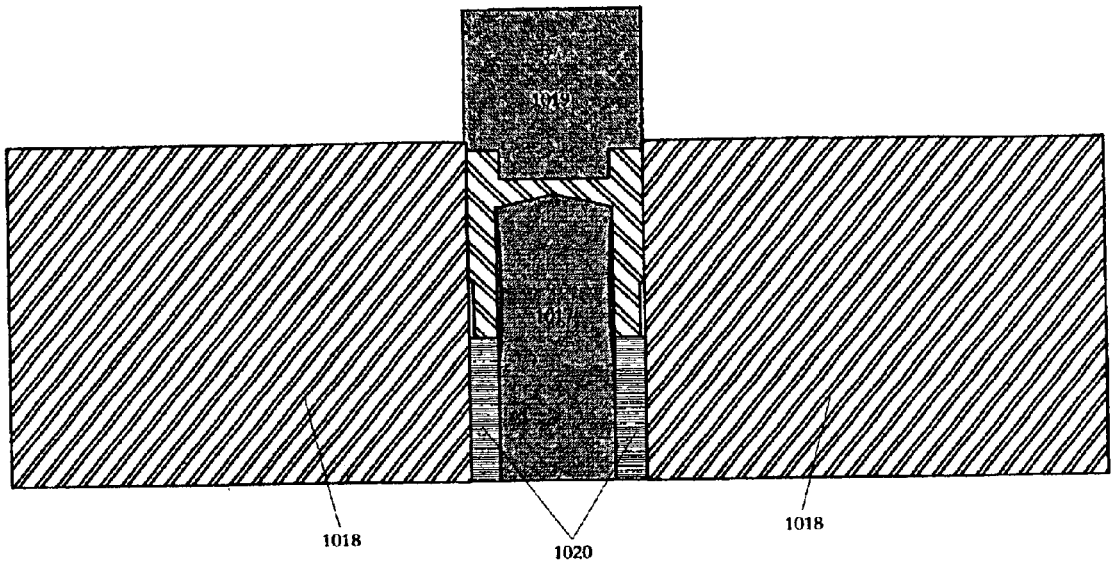

FIG. 15 depicts the forging of the inner plunger surface 50. As depicted, the inner plunger surface 50 is forged through use of a punch extrusion pin 1017. Those skilled in the art will appreciate that it is advantageous to preserve the integrity of the first plunger opening 31 and the outer plunger surface 80. This function is accomplished through use of a fourth die 1018 and a fourth knock out pin 1019. A punch stripper sleeve 1020 is used to remove the punch extrusion pin 1017 from the inner plunger surface 50.

Figure 16:
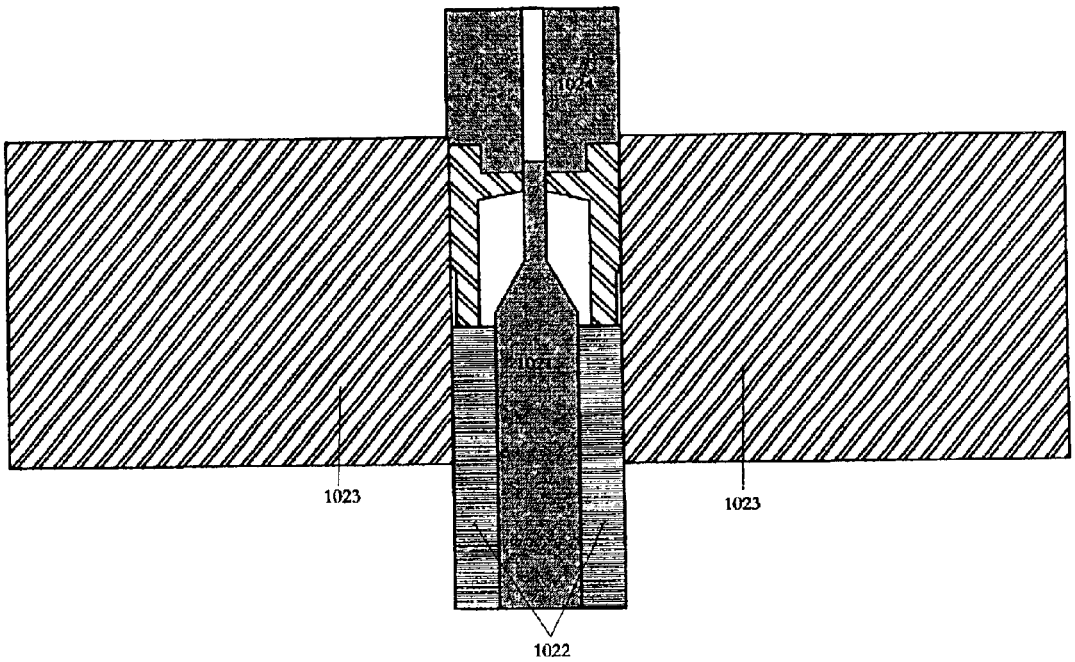

As shown in FIG. 16, the plunger hole 36 is fabricated through use of a piercing punch 1021 and a stripper sleeve 1022. To assure that other forging operations are not affected during the fabrication of the plunger hole 36, a fifth die 1023 is used around the outer plunger surface 80 and a tool insert 1024 is used at the first opening 31.

Figure 17:
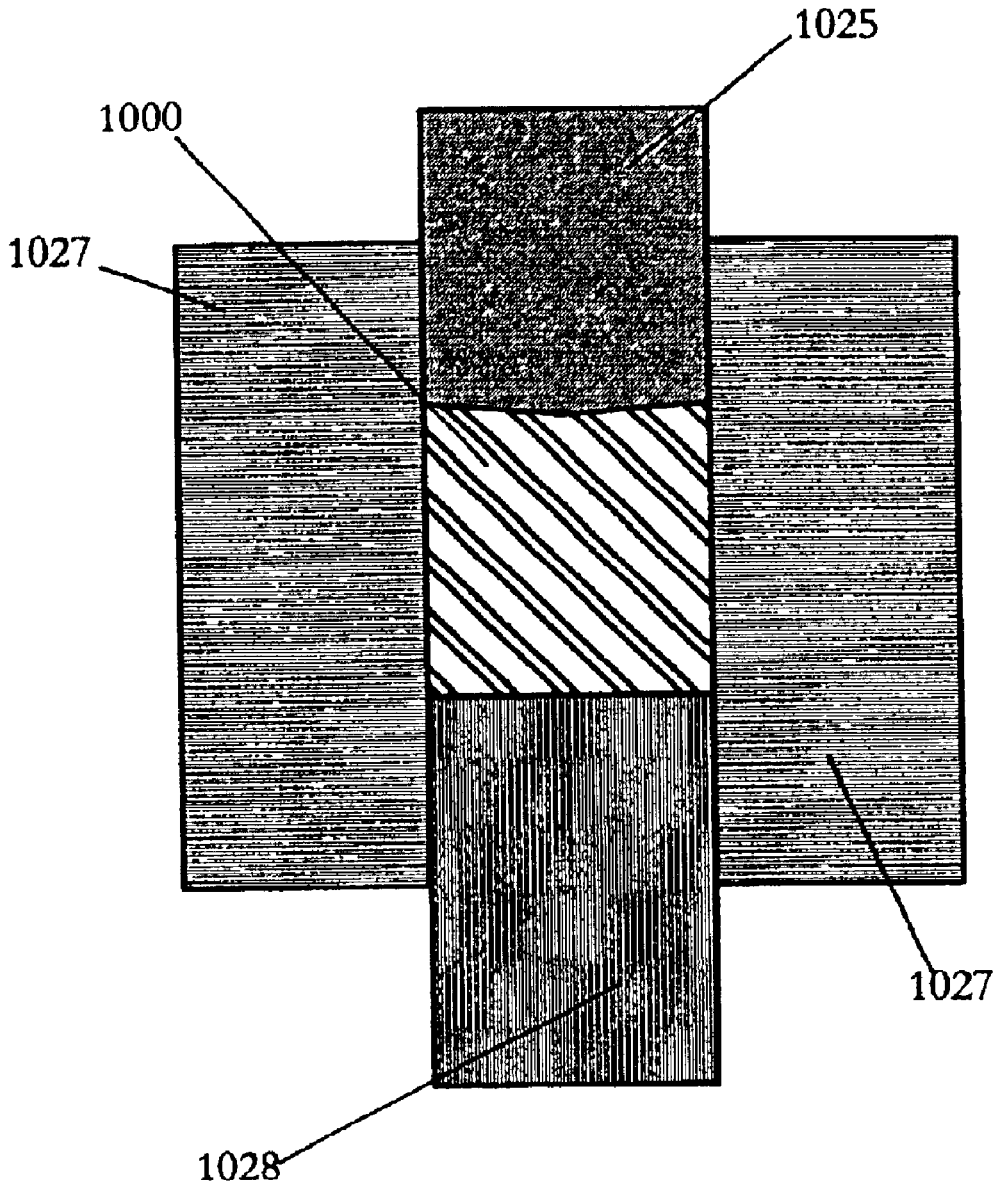
FIGS. 17–21 depict an alternative method of fabricating a leakdown plunger.

FIGS. 17 to 21 illustrate an alternative method of fabricating a leakdown plunger. FIG. 17 depicts a metal wire or metal rod 1000 drawn to size. The ends of the wire or rod 1000 are squared off through the use of a first punch 1025, a first die 1027, and a first knock out pin 1028.

Figure 18:
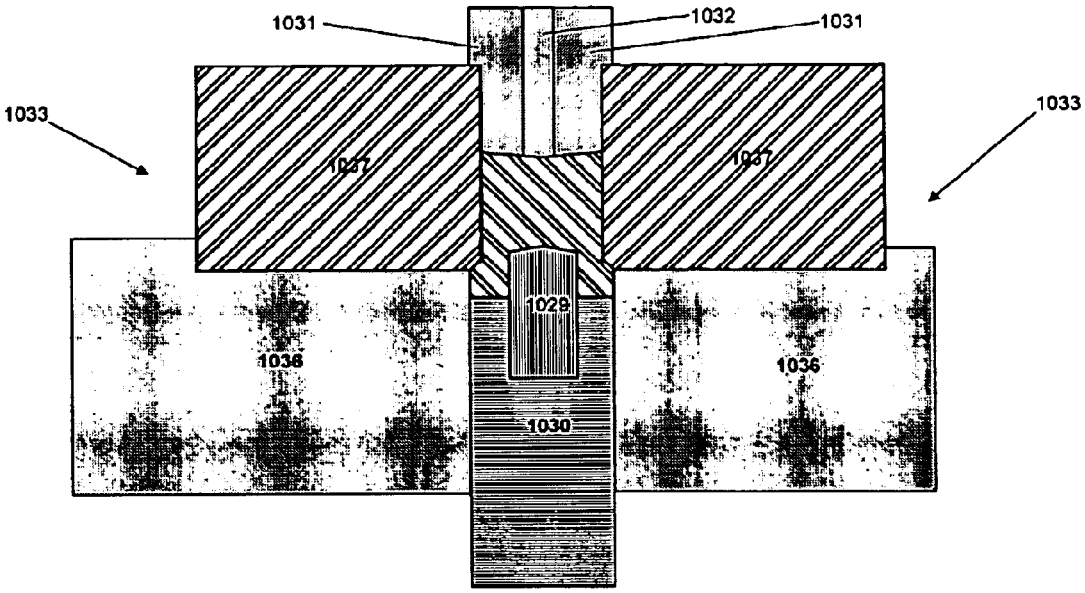

As depicted in FIG. 18, the fabrication of the first plunger opening 31, the second plunger opening 32, and the outer plunger surface 80 is preferably commenced through use of a punch pin 1029, a first punch stripper sleeve 1030, second knock out pin 1031, a stripper pin 1032, and a second die 1033. The first opening 31 is fabricated through use of the second knock out pin 1031. The stripper pin 1032 is used to remove the second knock out pin 1031 from the first plunger opening 31.

The second plunger opening 32 is fabricated, at least in part, through the use of the punch pin 1029. A first punch stripper sleeve 1030 is used to remove the punch pin 1029 from the second plunger opening 32. The outer plunger surface 80 is fabricated, at least in part, through the use of a second die 1033. The second die 1033 is composed of a second die top 1036 and a second die rear 1037.

Figure 19:
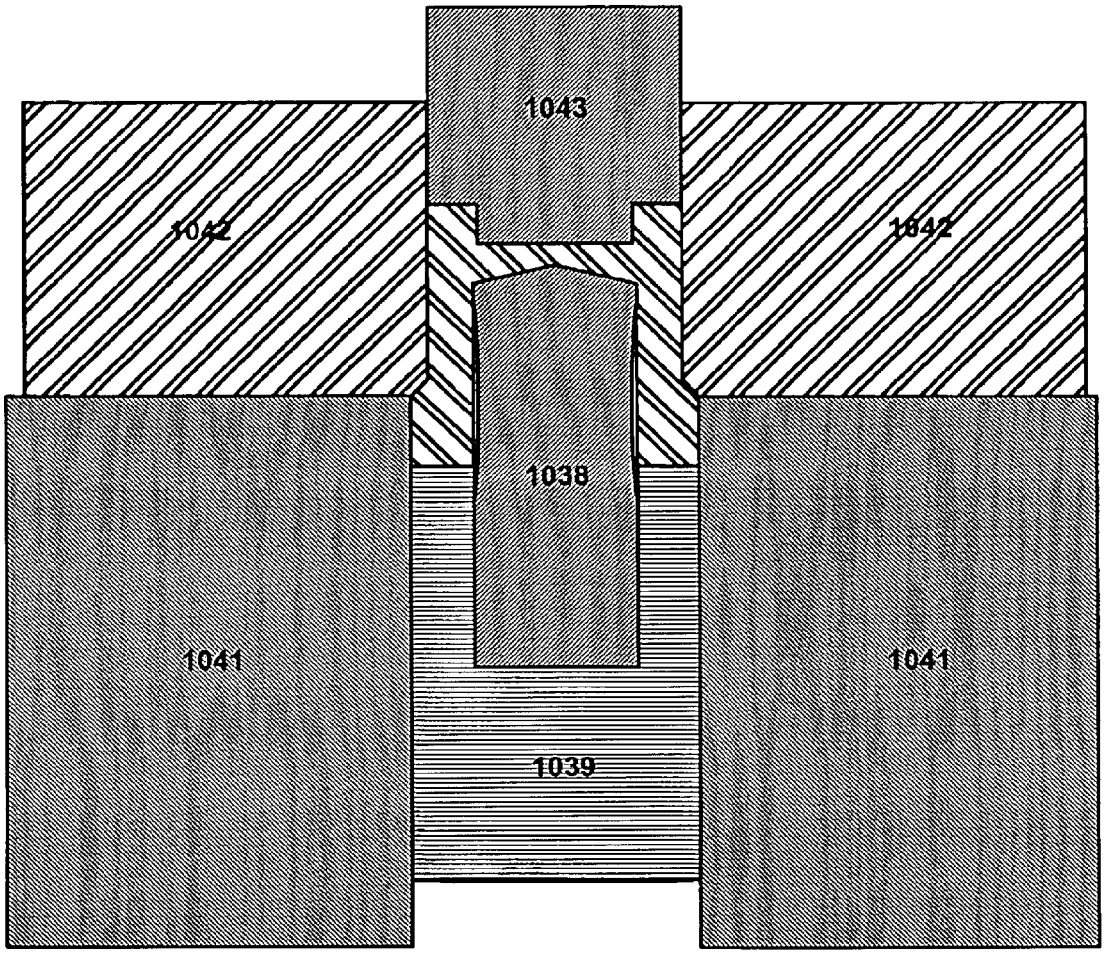

FIG. 19 depicts the forging of the inner plunger surface 50. As depicted, the inner plunger surface 50 is forged through the use of an extrusion punch 1038. A second punch stripper sleeve 1039 is used to remove the extrusion punch 1038 from the inner plunger surface 50.

Those skilled in the art will appreciate that it is advantageous to preserve the previous forging of the first plunger opening 31 and the outer plunger surface 80. A third knock out pin 1043 is used to preserve the previous forging operations on the first plunger opening 31. A third die 1040 is used to preserve the previous forging operations on the outer plunger surface 80. As depicted in FIG. 19, the third die 1040 is composed of a third die top 1041 and a third die rear 1042.

Figure 20:
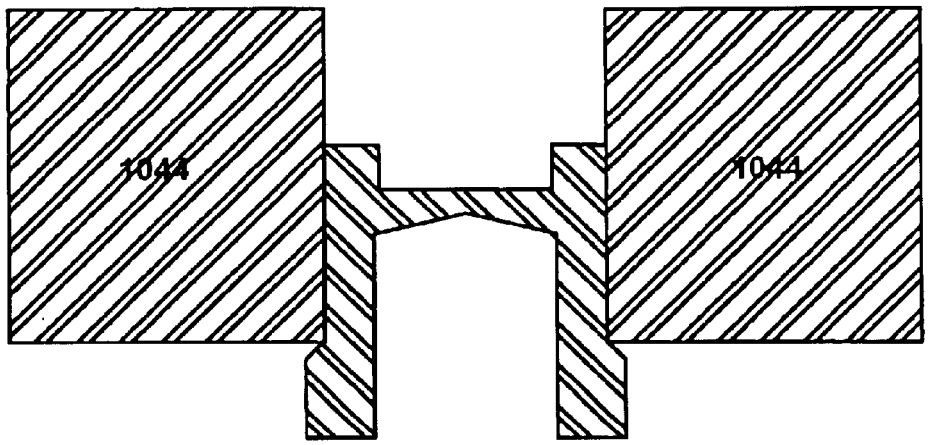

As depicted in FIG. 20, a sizing die 1044 is used in fabricating the second inner conical plunger surface 54 and the second inner cylindrical plunger surface 55. The sizing die 1044 is run along the outer plunger surface 80 from the first plunger opening 31 to the second plunger opening 32. This operation results in metal flowing through to the inner plunger surface 50.

Figure 21:
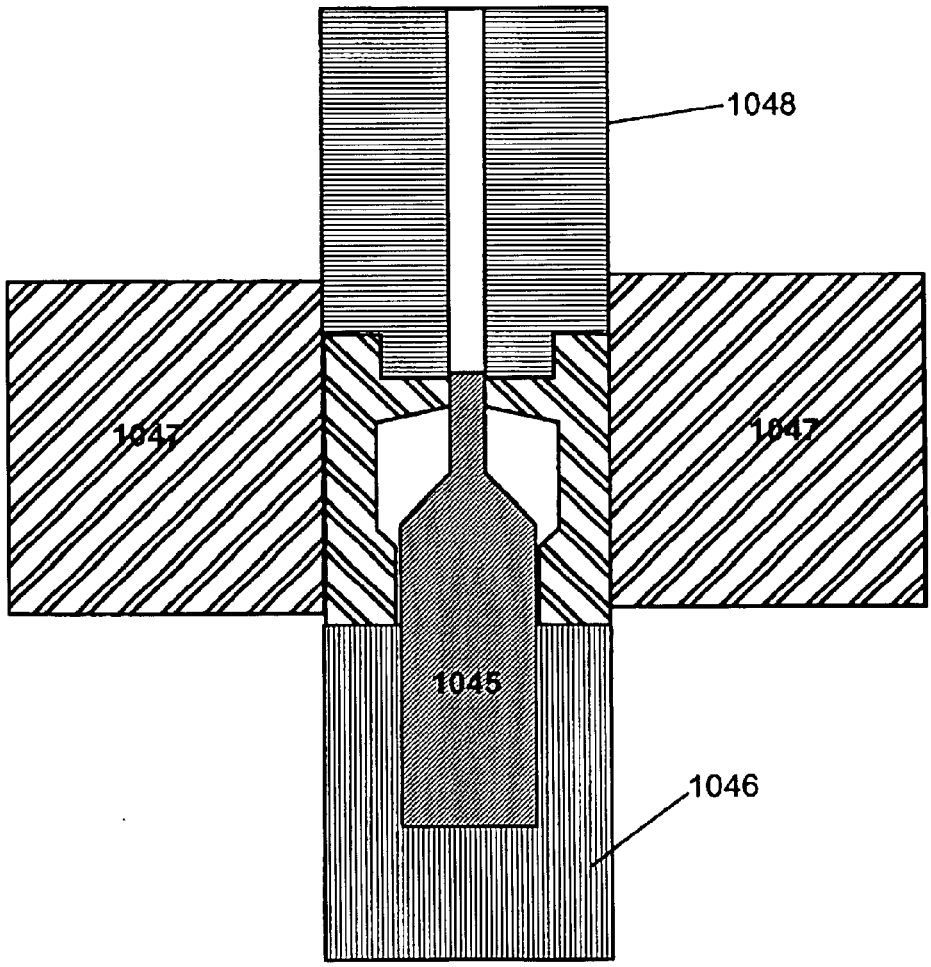

As shown in FIG. 21, the plunger hole 36 is fabricated through use of a piercing punch 1045 and a stripper sleeve 1046. The stripper sleeve 1046 is used in removing the piercing punch 1045 from the plunger hole 36. To assure that other forging operations are not affected during the fabrication of the plunger hole 36, a fourth die 1047 is used around the outer plunger surface 80 and a tool insert 1048 is used at the first plunger opening 31.

Figure 22:
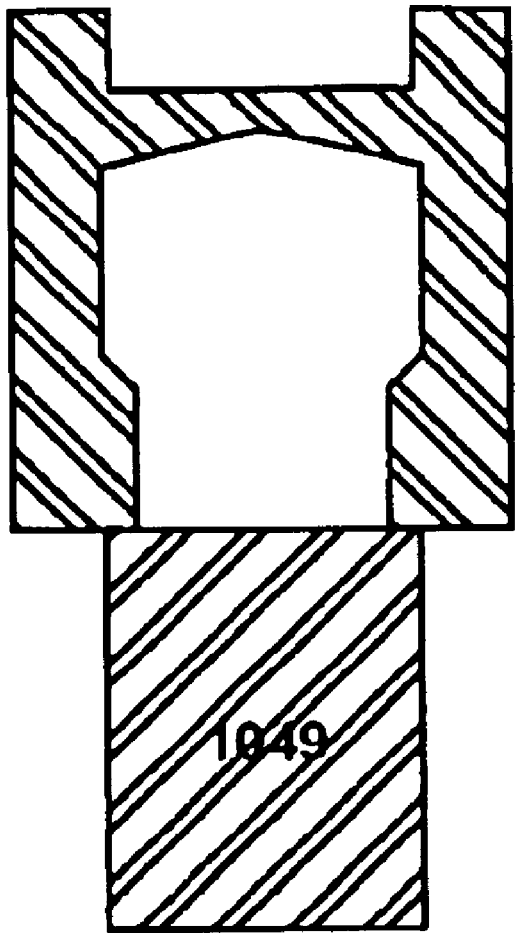
FIG. 22 depicts a step in an alternative method of fabricating a leakdown plunger.

Those skilled in the art will appreciate that further desirable finishing may be accomplished through machining. For example, an undercut plunger surface 82 may be fabricated and the second plunger opening 32 may be enlarged through machining. Alternatively, as depicted in FIG. 22, a shave punch 1049 may be inserted into the second plunger opening 32 and plow back excess material.

Figure 23:
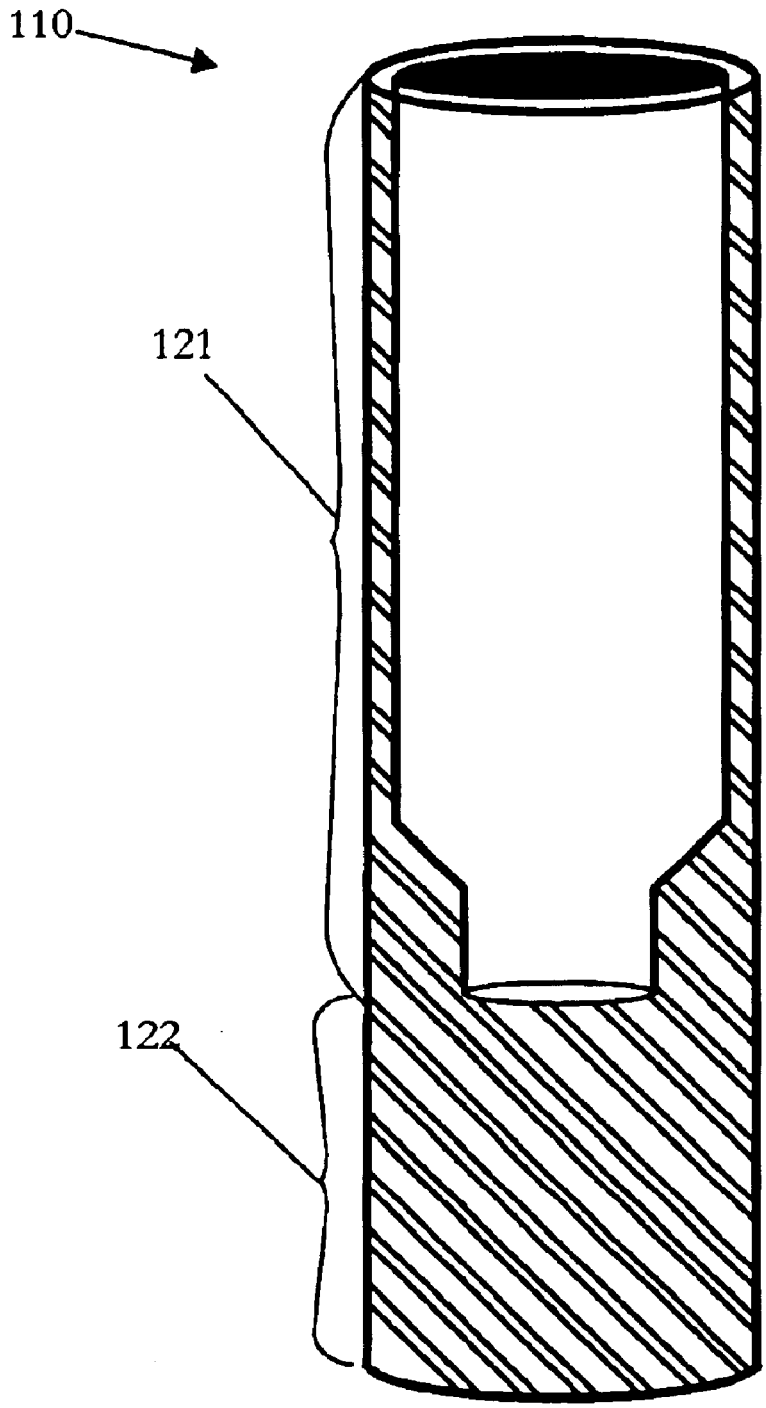
FIG. 23 depicts a preferred embodiment of a lash adjuster body.
Figure 24:
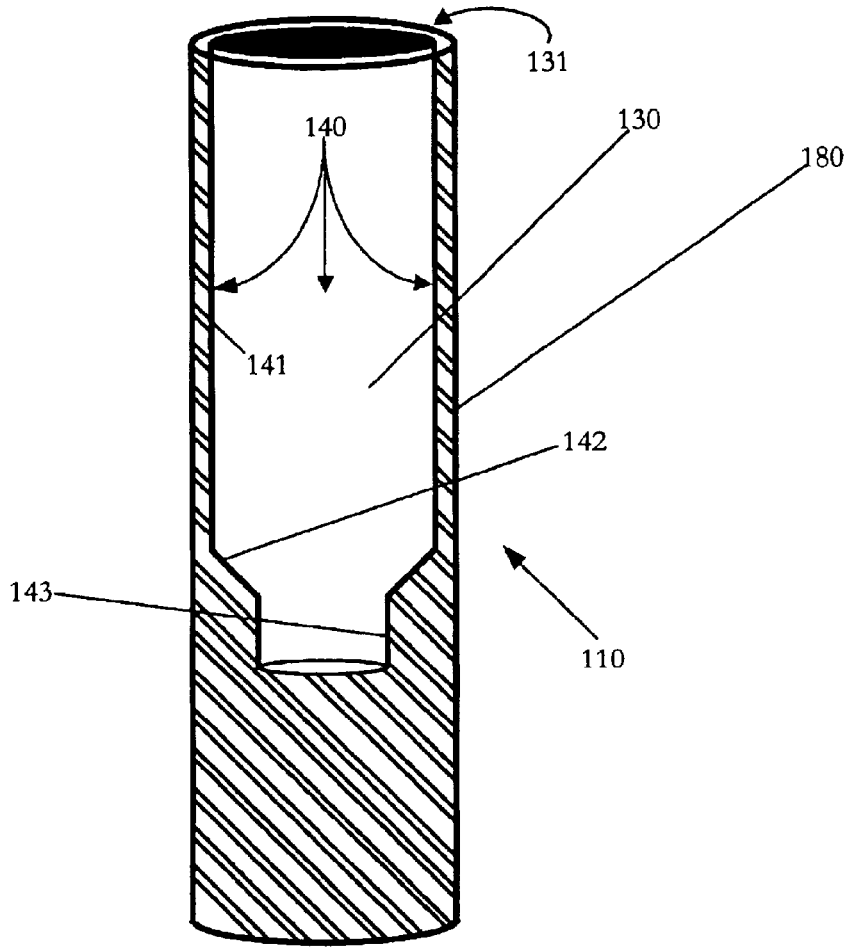
FIG. 24 depicts a preferred embodiment of a lash adjuster body.
Figure 25:
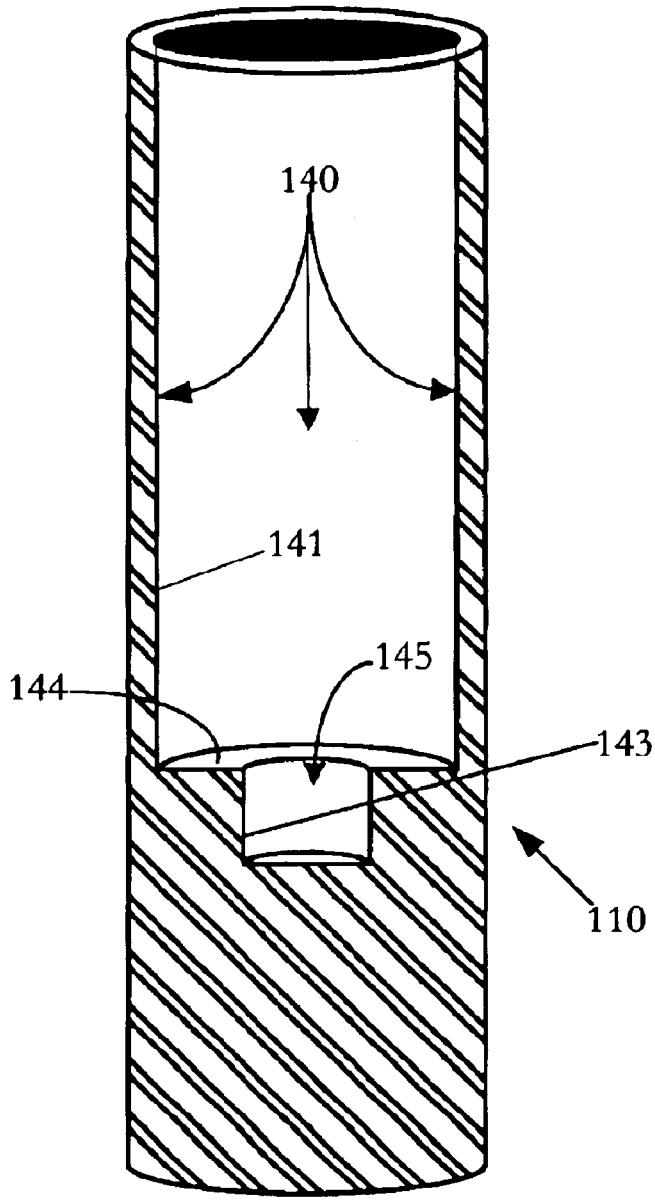
FIG. 25 depicts another embodiment of a lash adjuster body.

FIGS. 23, 24, and 25 show a preferred embodiment of the lash adjuster body 110. The lash adjuster body 110 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material According to yet another aspect of the present invention, the lash adjuster body 110 is composed of pearlitic material According to still another aspect of the present invention, the lash adjuster body 110 is composed of austenitic material. According to another aspect of the present invention, the metal is a ferritic material.

The lash adjuster body 110 is composed of a plurality of lash adjuster elements. According to one aspect of the present invention, the lash adjuster element is cylindrical in shape. According to another aspect of the present invention, the lash adjuster element is conical in shape. According to yet another aspect of the present invention, the lash adjuster element is solid. According to still another aspect of the present invention, the lash adjuster element is hollow.

FIG. 23 depicts a cross-sectional view of the lash adjuster 110 composed of a plurality of lash adjuster elements. FIG. 23 shows the lash adjuster body, generally designated 110. The lash adjuster body 110 of the preferred embodiment is fabricated from a single piece of metal wire or rod and is described herein as a plurality of lash adjuster elements. The lash adjuster body 110 includes a hollow lash adjuster element 121 and a solid lash adjuster element 122. In the preferred embodiment, the solid lash adjuster element 122 is located adjacent to the hollow lash adjuster element 121.

The lash adjuster body 110 functions to accommodate a plurality of inserts. According to one aspect of the present invention, the lash adjuster body 110 accommodates a leakdown plunger, such as the leakdown plunger 10. According to another aspect of the present invention, the lash adjuster body 110 accommodates a push rod seat (not shown). According to yet another aspect of the present invention, the lash adjuster body 110 accommodates a socket, such as the socket 210.

The lash adjuster body 110 is provided with a plurality of outer surfaces and inner surfaces. FIG. 24 depicts a cross-sectional view of the preferred embodiment of the present invention. As shown in FIG. 24, the lash adjuster body 110 is provided with an outer lash adjuster surface 180 which is configured to be inserted into another body. According to one aspect of the present invention, the outer lash adjuster surface 180 is configured to be inserted into a valve lifter body, such as the valve lifter body 310. According to another aspect of the present invention, the outer lash adjuster surface 180 is configured to be inserted into a roller follower, such as roller follower 410.

The outer lash adjuster surface 180 encloses at least one cavity. As depicted in FIG. 24, the outer lash adjuster surface 180 encloses a lash adjuster cavity 130. The lash adjuster cavity 130 is configured to cooperate with a plurality of inserts. According to one aspect of the present invention, the lash adjuster cavity 130 is configured to cooperate with a leakdown plunger. In the preferred embodiment, the lash adjuster cavity 130 is configured to cooperate with the leakdown plunger 10. According to another aspect of the present invention, the lash adjuster cavity 130 is configured to cooperate with a socket In the preferred embodiment, the lash adjuster cavity 130 is configured to cooperate with the socket 210. According to yet another aspect of the present invention, the lash adjuster cavity 130 is configured to cooperate with a push rod. According to still yet another aspect of the present invention, the lash adjuster cavity is configured to cooperate with a push rod seat Referring to FIG. 24, the lash adjuster body 110 of the present invention is provided with a lash adjuster cavity 130 that includes a lash adjuster opening 131. The lash adjuster opening 131 is in a circular shape. The lash adjuster cavity 130 is provided with the inner lash adjuster surface 140.

The inner lash adjuster surface 140 includes a plurality of surfaces. According to one aspect of the present invention, the inner lash adjuster surface 140 includes a cylindrical lash adjuster surface. According to another aspect of the present invention, the inner lash adjuster surface 140 includes a conical or frustoconical surface.

As depicted in FIG. 24, the inner lash adjuster surface 140 is provided with a first cylindrical lash adjuster surface 141, preferably concentric relative to the outer lash adjuster surface 180. Adjacent to the first cylindrical lash adjuster surface 141 is a conical lash adjuster surface 142. Adjacent to the conical lash adjuster surface 142 is a second cylindrical lash adjuster surface 143. However, those skilled in the art will appreciate that the inner lash adjuster surface 140 can be fabricated without the conical lash adjuster surface 142.

FIG. 25 depicts a cut-away view of the lash adjuster body 110 of the preferred embodiment. The inner lash adjuster surface 140 is provided with a first cylindrical lash adjuster surface 141. The first cylindrical lash adjuster surface 141 abuts an annular lash adjuster surface 144 with an annulus 145. The annulus 145 defines a second cylindrical lash adjuster surface 143.

The lash adjuster body 110 of the present invention is fabricated through a plurality of processes. According to one aspect of the present invention, the lash adjuster body 110 is machined. According to another aspect of the present invention, the lash adjuster body 110 is forged. According to yet another aspect of the present invention, the lash adjuster body 110 is fabricated through casting. The preferred embodiment of the present invention is forged. As used herein, the term "forge," "forging," or "forged" is intended to encompass what is known in the art as "cold forming," "cold heading," "deep drawing," and "hot forging."

In the preferred embodiment, the lash adjuster body 110 is forged with use of a National® 750 parts former machine. However, those skilled in the art will appreciate that other part formers, such as, for example, a Waterbury machine can be used. Those skilled in the art will further appreciate that other forging methods can be used as well.

The process of forging the preferred embodiment begins with a metal wire or metal rod which is drawn to size. The ends of the wire or rod are squared off by a punch. After being drawn to size, the wire or rod is run through a series of dies or extrusions.

The lash adjuster cavity 130 is extruded through use of a punch and an extruding pin. After the lash adjuster cavity 130 has been extruded, the lash adjuster cavity 130 is forged. The lash adjuster cavity 130 is extruded through use of an extruding punch and a forming pin.

Alternatively, the lash adjuster body 110 is fabricated through machining. As used herein, machining means the use of a chucking machine, a drilling machine, a grinding machine, or a broaching machine. Machining is accomplished by first feeding the lash adjuster body 110 into a chucking machine, such as an ACME-Gridley automatic chucking machine. Those skilled in the art will appreciate that other machines and other manufacturers of automatic chucking machines can be used.

To machine the lash adjuster cavity 130, the end containing the lash adjuster opening 131 is faced so that it is substantially flat The lash adjuster cavity 130 is bored. Alternatively, the lash adjuster cavity 130 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the lash adjuster cavity 130 is ground using an internal diameter grinding machine, such as a Heald grinding machine. Those skilled in the art will appreciate that the lash adjuster cavity 130 can be ground using other grinding machines.

Figure 26:
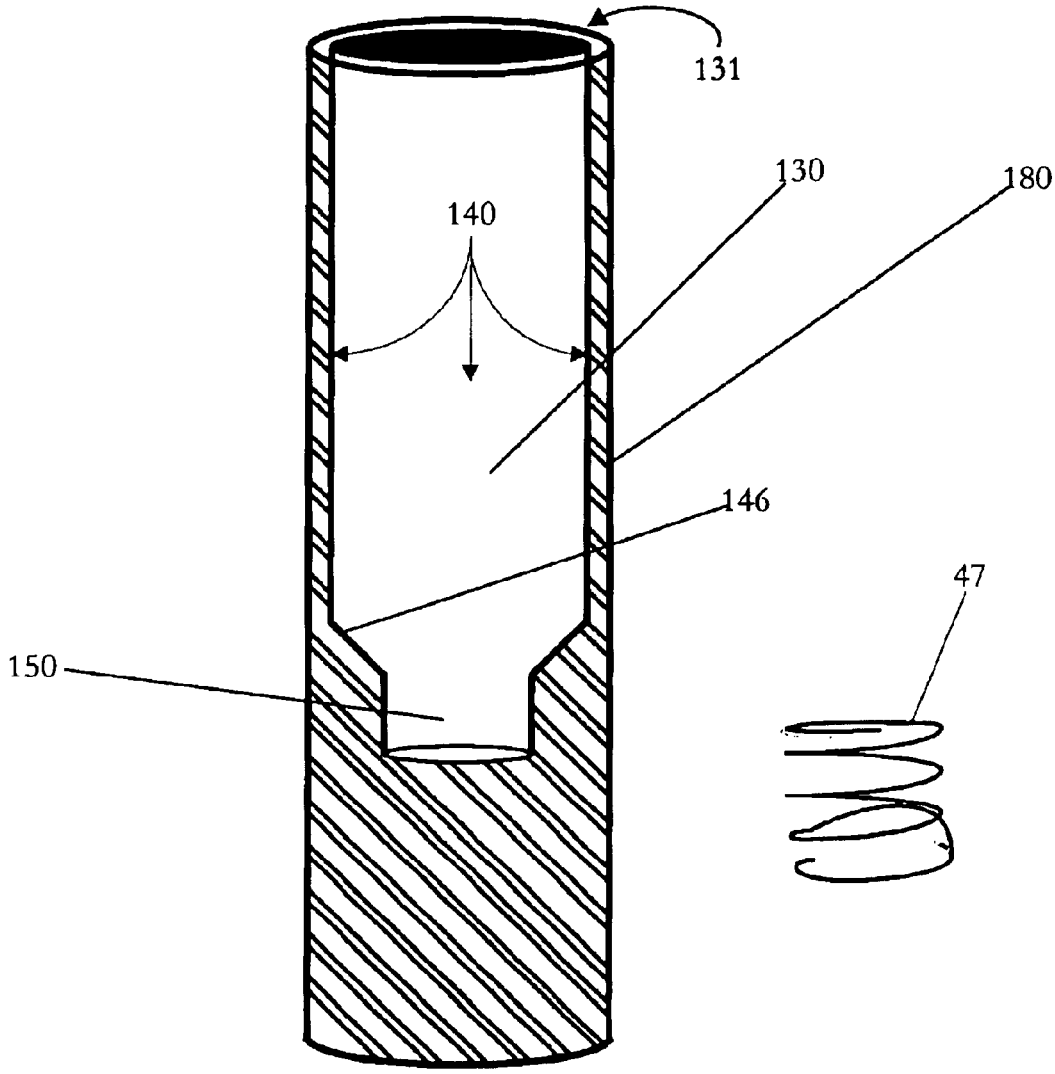
FIG. 26 depicts another embodiment of a lash adjuster body.

FIG. 26 depicts the inner lash adjuster surface 140 provided with a lash adjuster well 150. The lash adjuster well 150 is shaped to accommodate a cap spring 47. In the embodiment depicted in FIG. 26, the lash adjuster well 150 is cylindrically shaped at a diameter that is smaller than the diameter of the inner lash adjuster surface 140. The cylindrical shape of the lash adjuster well 150 is preferably concentric relative to the outer lash adjuster surface 180. The lash adjuster well 150 is preferably forged through use of an, extruding die pin.

Alternatively, the lash adjuster well 150 is machined by boring the lash adjuster well 150 in a chucking machine. Alternatively, the lash adjuster well 150 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material After heat-treating, the lash adjuster well 150 is ground using an internal diameter grinding machine, such as a Heald grinding machine. Those skilled in the art will appreciate that the lash adjuster well 150 can be ground using other grinding machines.

Adjacent to the lash adjuster well 150, in the embodiment depicted in FIG. 26, is a lash adjuster lead surface 146 which is conically shaped and can be fabricated through forging or machining. However, those skilled in the art will appreciate that the present invention can be fabricated without the lash adjuster lead surface 146.

Figure 27:
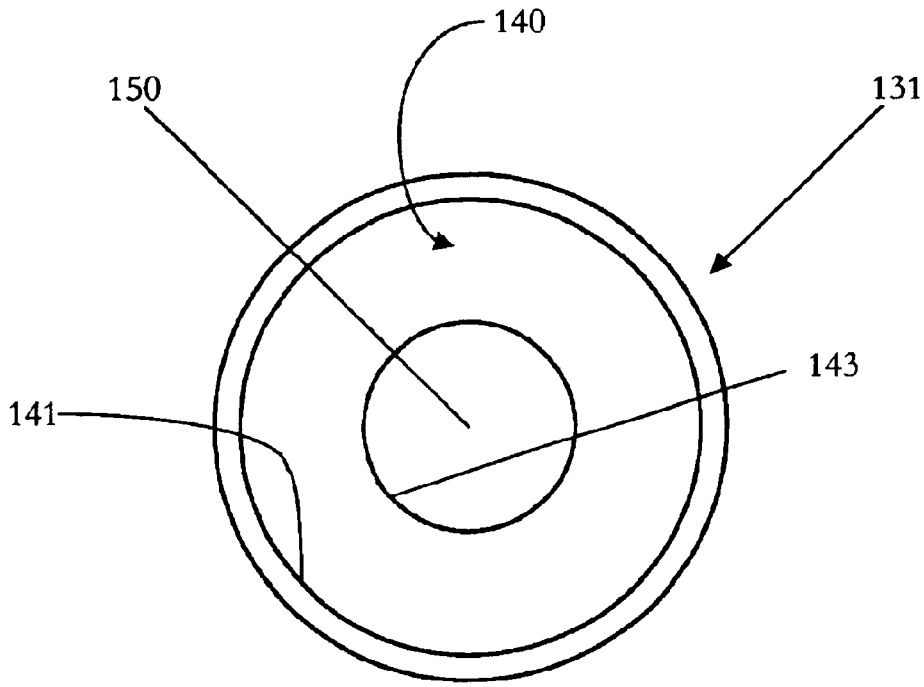
FIG. 27 depicts a top view of an embodiment of a lash adjuster body.

FIG. 27 depicts a view of the lash adjuster opening 131 that reveals the inner lash adjuster surface 140 of the preferred embodiment of the present invention. The inner lash adjuster surface 140 is provided with a first cylindrical lash adjuster surface 141. A lash adjuster well 150 is defined by a second cylindrical lash adjuster surface 143. As shown in FIG. 27, the second cylindrical lash adjuster surface 143 is concentric relative to the first cylindrical lash adjuster surface 141.

Figure 28:
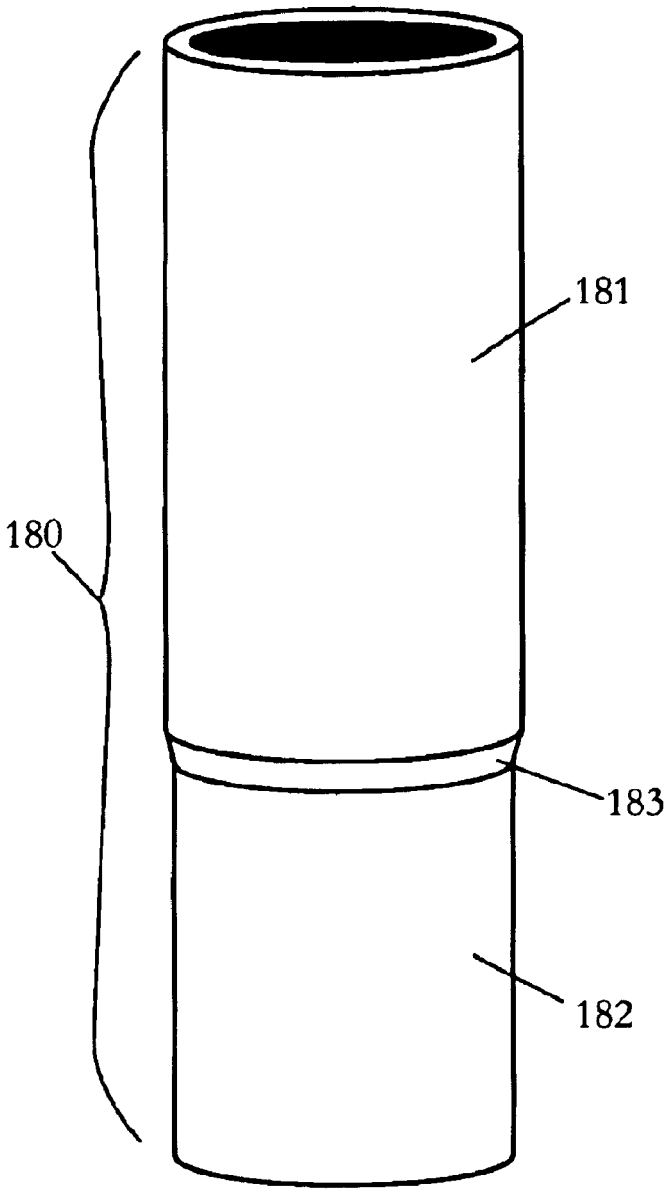
FIG. 28 depicts the top view of another preferred embodiment of a lash adjuster body.

Depicted in FIG. 28 is a lash adjuster body 110 of an alternative embodiment. As shown in FIG. 28, the lash adjuster body 110 is provided with an outer lash adjuster surface 180. The outer lash adjuster surface 180 includes a plurality of surfaces. In the embodiment depicted in FIG. 28, the outer lash adjuster surface 180 includes an outer cylindrical lash adjuster surface 181, an undercut lash adjuster surface 182, and a conical lash adjuster surface 183. As depicted in FIG. 28, the undercut lash adjuster surface 182 extends from one end of the lash adjuster body 110 and is cylindrically shaped. The diameter of the undercut lash adjuster surface 182 is smaller than the diameter of the outer cylindrical lash adjuster surface 181.

The undercut lash adjuster surface 182 is forged through use of an extruding die. Alternatively, the undercut lash adjuster surface 182 is fabricated through machining. Machining the undercut lash adjuster surface 182 is accomplished through use of an infeed centerless grinding machine, such as a Cincinnati grinder. The surface is first heat-treated and then the undercut lash adjuster surface 182 is ground via a grinding wheel Those skilled in the art will appreciate that additional surfaces can be ground into the outer lash adjuster surface 180 with minor alterations to the grinding wheel.

As depicted in FIG. 28, the conical lash adjuster surface 183 is located between the outer cylindrical lash adjuster surface 181 and the undercut lash adjuster surface 182. The conical lash adjuster surface 183 is forged through use of an extruding die. Alternatively, the conical lash adjuster surface 183 is fabricated through machining. Those with skill in the art will appreciate that the outer lash adjuster surface 180 can be fabricated without the conical lash adjuster surface 183 so that the outer cylindrical lash adjuster surface 181 and the undercut lash adjuster surface 182 abut one another.

Those skilled in the art will appreciate that the features of the lash adjuster body 110 may be fabricated through a combination of machining, forging, and other methods of fabrication. By way of example and not limitation, aspects of the lash adjuster cavity 130 can be machined; other aspects of the lash adjuster cavity can be forged.

Figure 29:
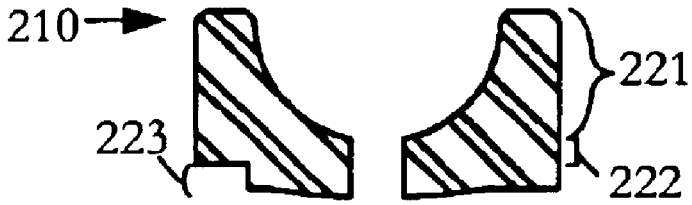
FIG. 29 depicts a preferred embodiment of a socket
Figure 30:
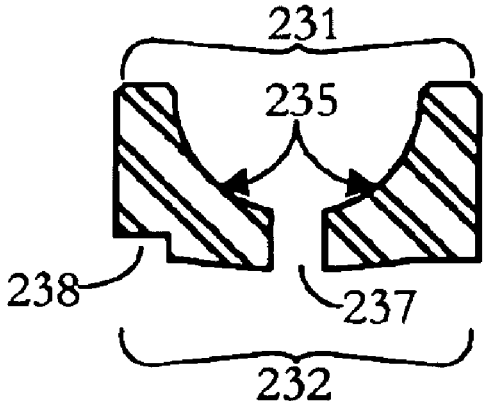
FIG. 30 depicts a preferred embodiment of a socket
Figure 31:
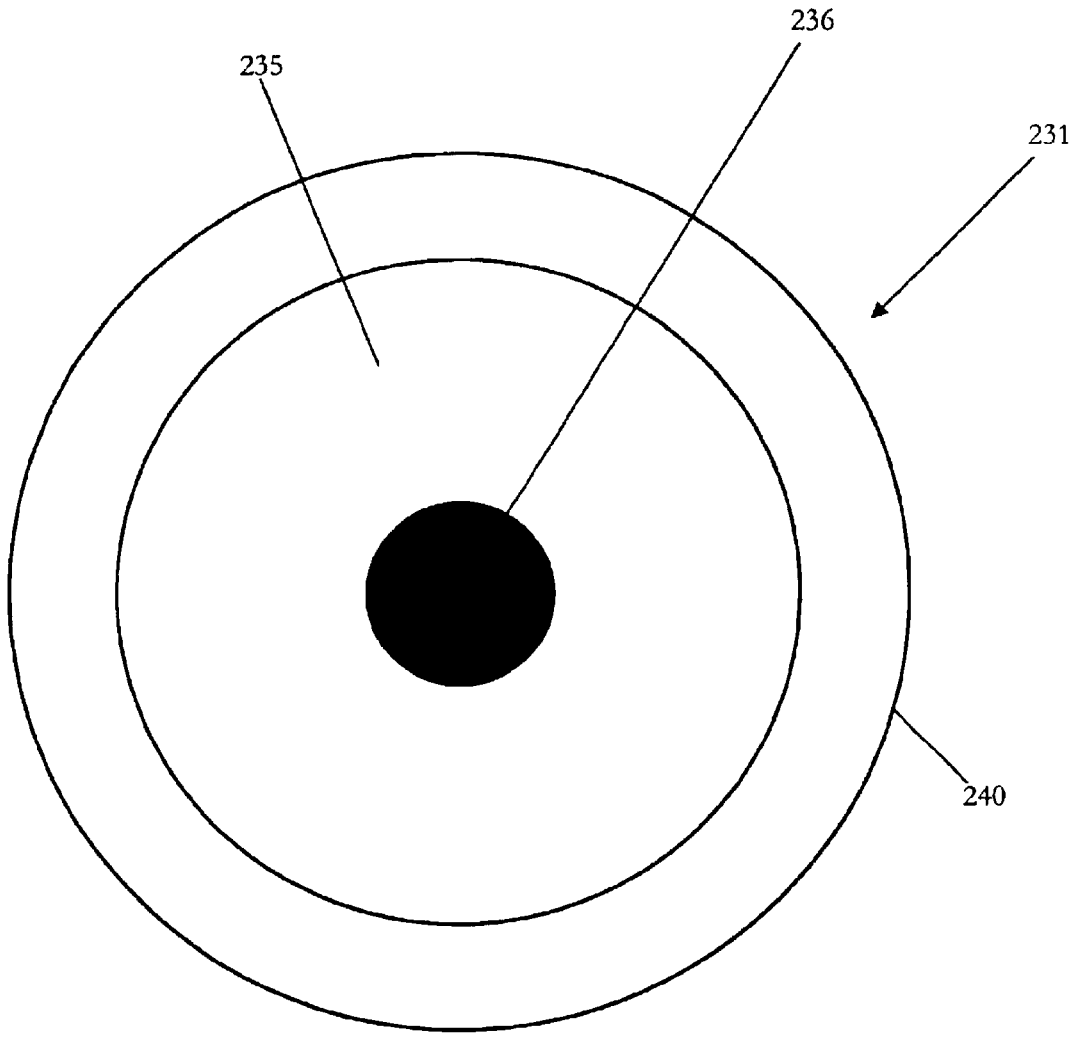
FIG. 31 depicts the top view of a surface of a socket.

Turning now to the drawings, FIGS. 29, 30, and 31 show a preferred embodiment of a socket 210. The socket 210 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the socket 210 is composed of pearlitic material. According to still another aspect of the present invention, the socket 210 is composed of austenitic material. According to another aspect of the present invention, the metal is a ferritic material.

The socket 210 is composed of a plurality of socket elements. According to one aspect of the present invention, the socket element is cylindrical in shape. According to another aspect of the present invention, the socket element is conical in shape. According to yet another aspect of the present invention, the socket element is solid. According to still another aspect of the present invention, the socket element is hollow.

FIG. 29 depicts a cross-sectional view of the socket 210 of the preferred embodiment of the present invention composed of a plurality of socket elements. FIG. 29 shows the socket, generally designated 210. The socket 210 functions to accept a liquid, such as a lubricant and is provided with a plurality of surfaces and passages. Referring now to FIG. 31, the first socket surface 231 functions to accommodate an insert, such as, for example, a push rod 296.

The socket 210 of the preferred embodiment is fabricated from a single piece of metal wire or rod and is described herein as a plurality of socket elements. The socket 210 includes a first hollow socket element 221, a second hollow socket element 222, and a third hollow socket element 223. As depicted in FIG. 29, the first hollow socket element 221 is located adjacent to the second hollow socket element 222. The second hollow socket element 222 is located adjacent to the third hollow socket element 223.

The first hollow socket element 221 functions to accept an insert, such as a push rod. The third hollow socket element 223 functions to conduct fluid. The second hollow socket element 222 functions to fluidly link the first hollow socket element 221 with the third hollow socket element 223.

Referring now to FIG. 30, the socket 210 is provided with a plurality of outer surfaces and inner surfaces. FIG. 30 depicts a cross sectional view of the socket 210 of the preferred embodiment of the present invention. As shown in FIG. 30, the preferred embodiment of the present invention is provided with a first socket surface 231. The first socket surface 231 is configured to accommodate an insert. The socket 210 of the preferred embodiment is also provided with a second socket surface 232. The second socket surface 232 is configured to cooperate with an engine workpiece.

FIG. 31 depicts a top view of the first socket surface 231. As shown in FIG. 31, the first socket surface 231 is provided with a generally spherical push rod cooperating surface 235 defining a first socket hole 236. Preferably, the push rod cooperating surface 235 is concentric relative to the outer socket surface 240; however, such concentricity is not necessary. In the embodiment depicted in FIG. 31, the first socket hole 236 fluidly links the first socket surface 231 with a socket passage 237. The socket passage 237 is shaped to conduct fluid, preferably a lubricant. In the embodiment depicted in FIG. 31, the socket passage 237 is cylindrically shaped; however, those skilled in the art will appreciate that the socket passage 237 may assume any shape so long as it is able to conduct fluid.

Figure 32:
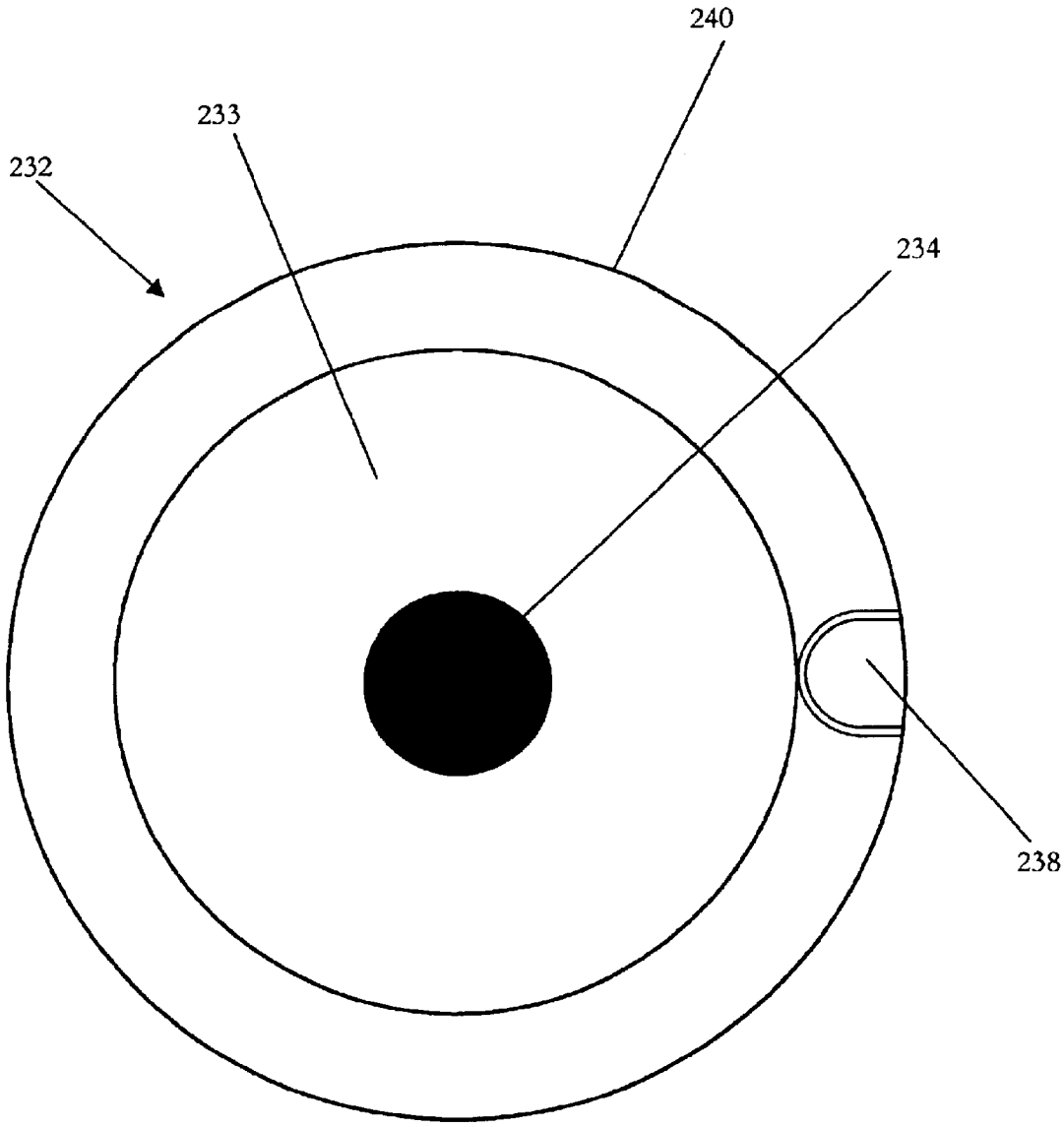
FIG. 32 depicts the top view of another surface of a socket.

FIG. 32 depicts a top view of the second socket surface 232. The second socket surface 232 is provided with a plunger reservoir passage 238. The plunger reservoir passage 238 is configured to conduct fluid, preferably a lubricant. As depicted in FIG. 32, the plunger reservoir passage 238 of the preferred embodiment is generally cylindrical in shape; however, those skilled in the art will appreciate that the plunger reservoir passage 238 may assume any shape so long as it conducts fluid.

The second socket surface 232 defines a second socket hole 234. The second socket hole 234 fluidly links the second socket surface 232 with socket passage 237. The second socket surface 232 is provided with a curved socket surface 233. The curved socket surface 233 is preferably concentric relative to the outer socket surface 240. However, those skilled in the art will appreciate that it is not necessary that the second socket surface 232 be provided with a curved socket surface 233 or that the curved socket surface 233 be concentric relative to the outer socket surface 240. The second socket surface 232 may be provided with any surface, and the curved socket surface 233 of the preferred embodiment may assume any shape so long as the second socket surface 232 cooperates with the opening of an engine workpiece.

Figure 33:
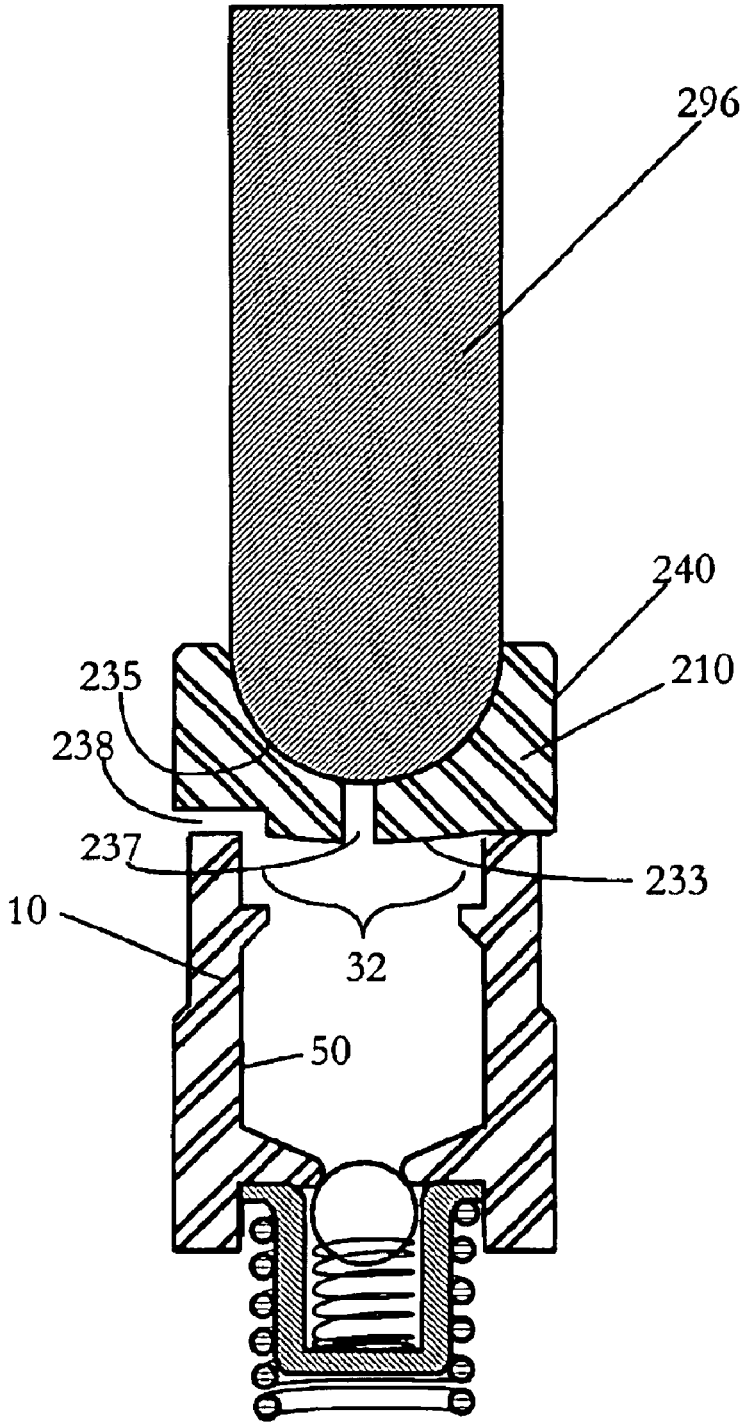
FIG. 33 depicts an embodiment of a socket accommodating an engine work piece.

Referring now to FIG. 33, the first socket surface 231 is depicted accommodating an insert. As shown in FIG. 33, that insert is a push rod 296. The second socket surface 232 is further depicted cooperating with an engine workpiece. In FIG. 33, that engine workpiece is a leakdown plunger 10. Those skilled in the art will appreciate that push rods other than the push rod 296 shown herein can be used without departing from the scope and spirit of the present invention. Furthermore, those skilled in the art will appreciate that leakdown plungers other than the leakdown plunger 10 shown herein can be used without departing from the scope and spirit of the present invention.

As depicted in FIG. 33, the curved socket surface 233 cooperates with a second plunger opening 32 of the leakdown plunger 10. According to one aspect of the present invention, the curved socket surface 233 preferably corresponds to the second plunger opening 32 of the leakdown plunger 10. According to another aspect of the present invention, the curved socket surface 233 preferably provides a closer fit between the second socket surface 232 of the socket 210 and the second plunger opening 32 of the leakdown plunger 10.

In the embodiment depicted in FIG. 33, a socket passage 237 is provided. The socket passage 237 preferably functions to lubricate the push rod cooperating surface 235. The embodiment depicted in FIG. 33 is also provided with a plunger reservoir passage 238. The plunger reservoir passage 238 is configured to conduct fluid, preferably a lubricant.

The plunger reservoir passage 238 performs a plurality of functions. According to one aspect of the present invention, the plunger reservoir passage 238 fluidly links the second plunger opening 32 of the leakdown plunger 10 and the outer socket surface 240 of the socket 210. According to another aspect of the present invention, the plunger reservoir passage 238 fluidly links the inner plunger surface 50 of the leakdown plunger 10 and the outer socket surface 240 of the socket 210.

Those skilled in the art will appreciate that the plunger reservoir passage 238 can be extended so that it joins socket passage 237 within the socket 210. However, it is not necessary that the passages 237, 238 be joined within the socket 210. As depicted in FIG. 33, the plunger reservoir passage 238 of an embodiment of the present invention is fluidly linked to socket passage 237. Those skilled in the art will appreciate that the outer socket surface 240 is fluidly linked to the first socket surface 231 in the embodiment depicted in FIG. 33.

Figure 34:
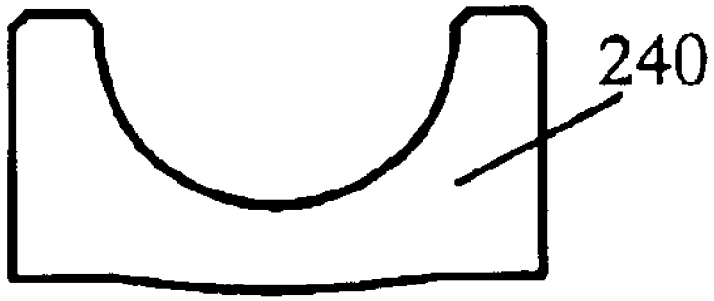
FIG. 34 depicts an outer surface of an embodiment of a socket

As depicted in FIG. 34, the preferred embodiment of the socket 210 is provided with an outer socket surface 240. The outer socket surface 240 is configured to cooperate with the inner surface of an engine workpiece. The outer socket surface 240 of the presently preferred embodiment is cylindrically shaped. However, those skilled in the art will appreciate that the outer socket surface 240 may assume any shape so long as it is configured to cooperate with the inner surface of an engine workpiece.

Figure 35:
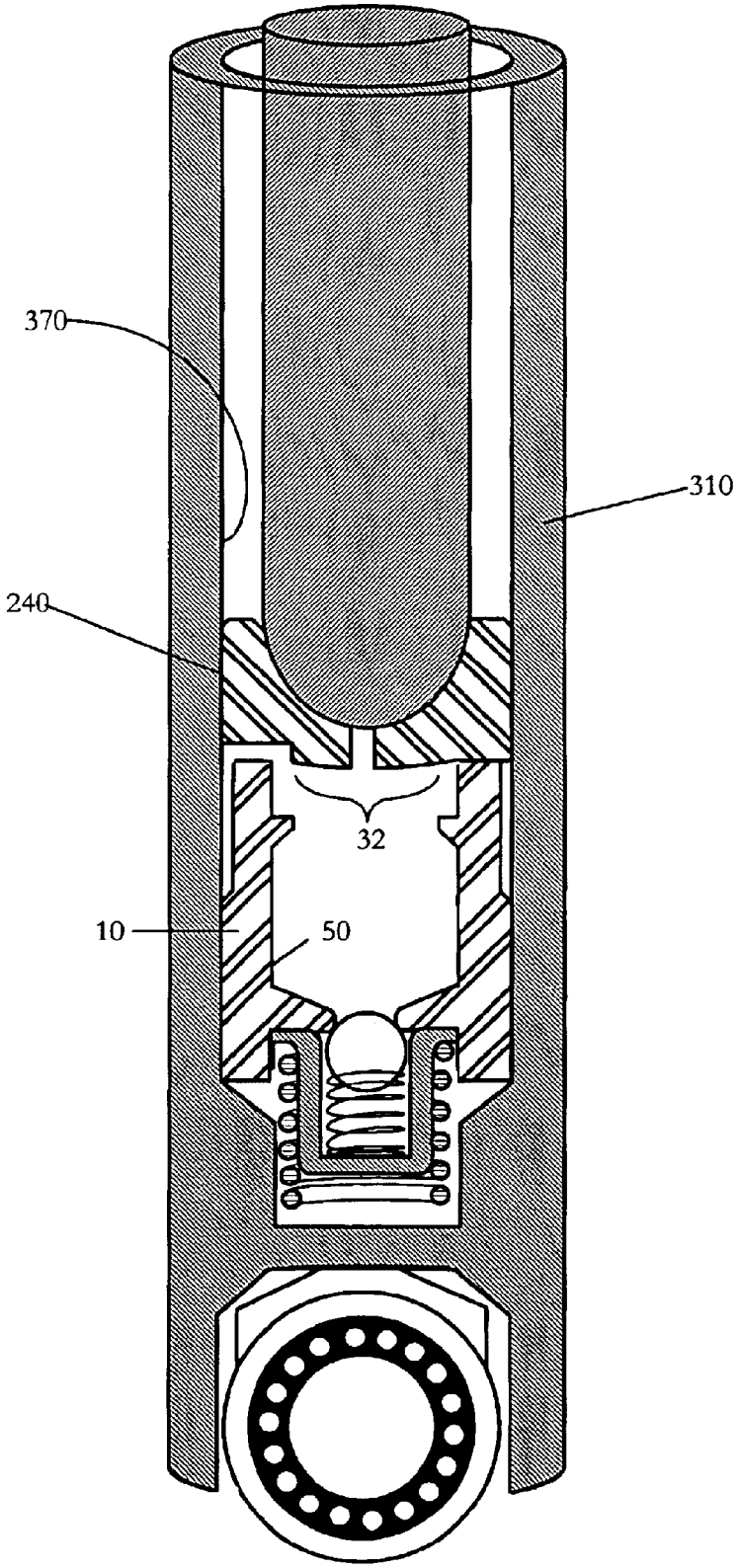
FIG. 35 depicts an embodiment of a socket cooperating with an engine work piece.

As depicted in FIG. 35, the outer socket surface 240 may advantageously be configured, to cooperate with the inner surface of an engine workpiece. As shown in FIG. 35, the outer socket surface 240 is configured to cooperate with the second inner lifter surface 370 of a valve lifter body 310. Those skilled in the art will appreciate that the outer socket surface 40 may advantageously be configured to cooperate with the inner surfaces of other lifter bodies.

Figure 36:
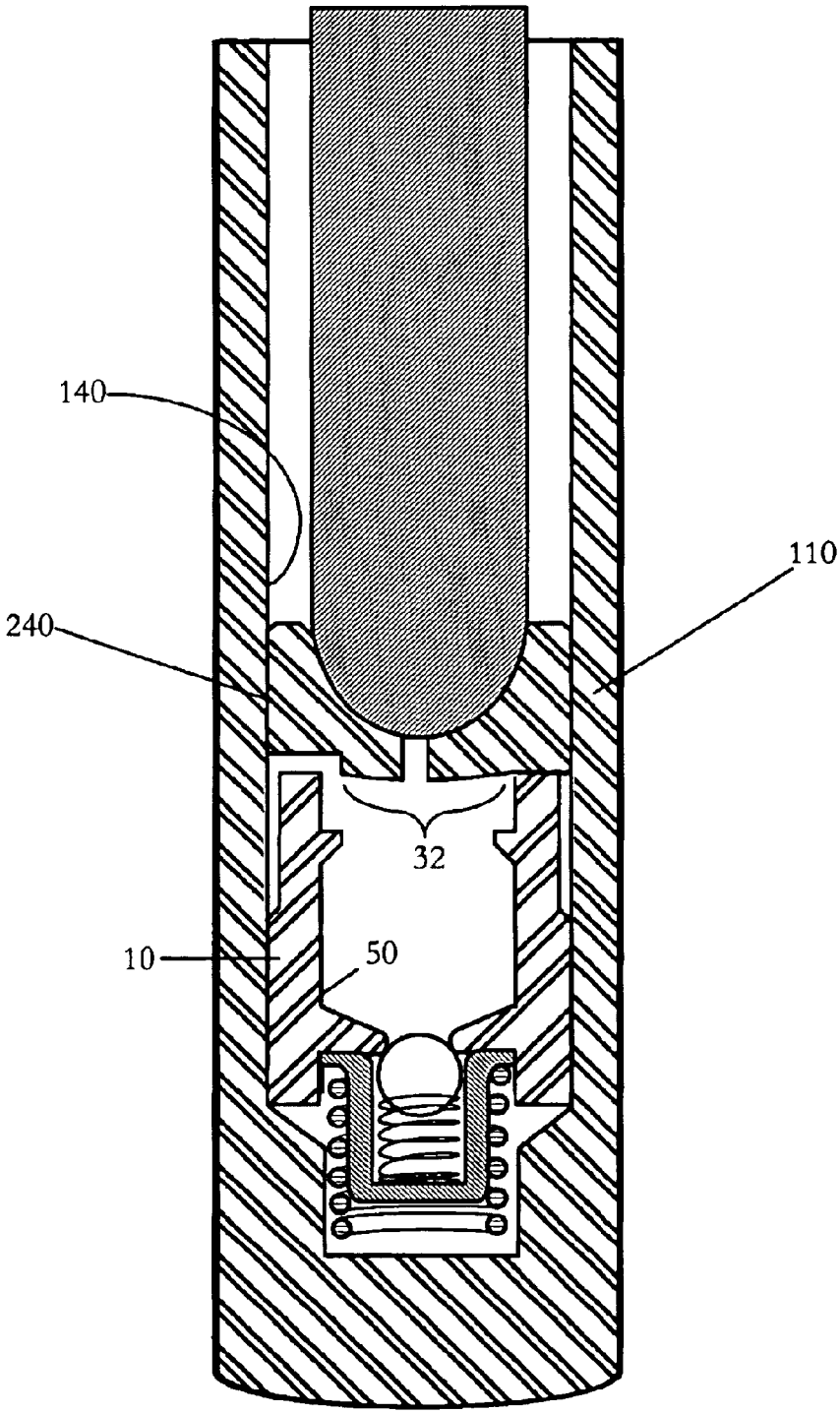
FIG. 36 depicts an embodiment of a socket cooperating with an engine work piece.
Figure 37:
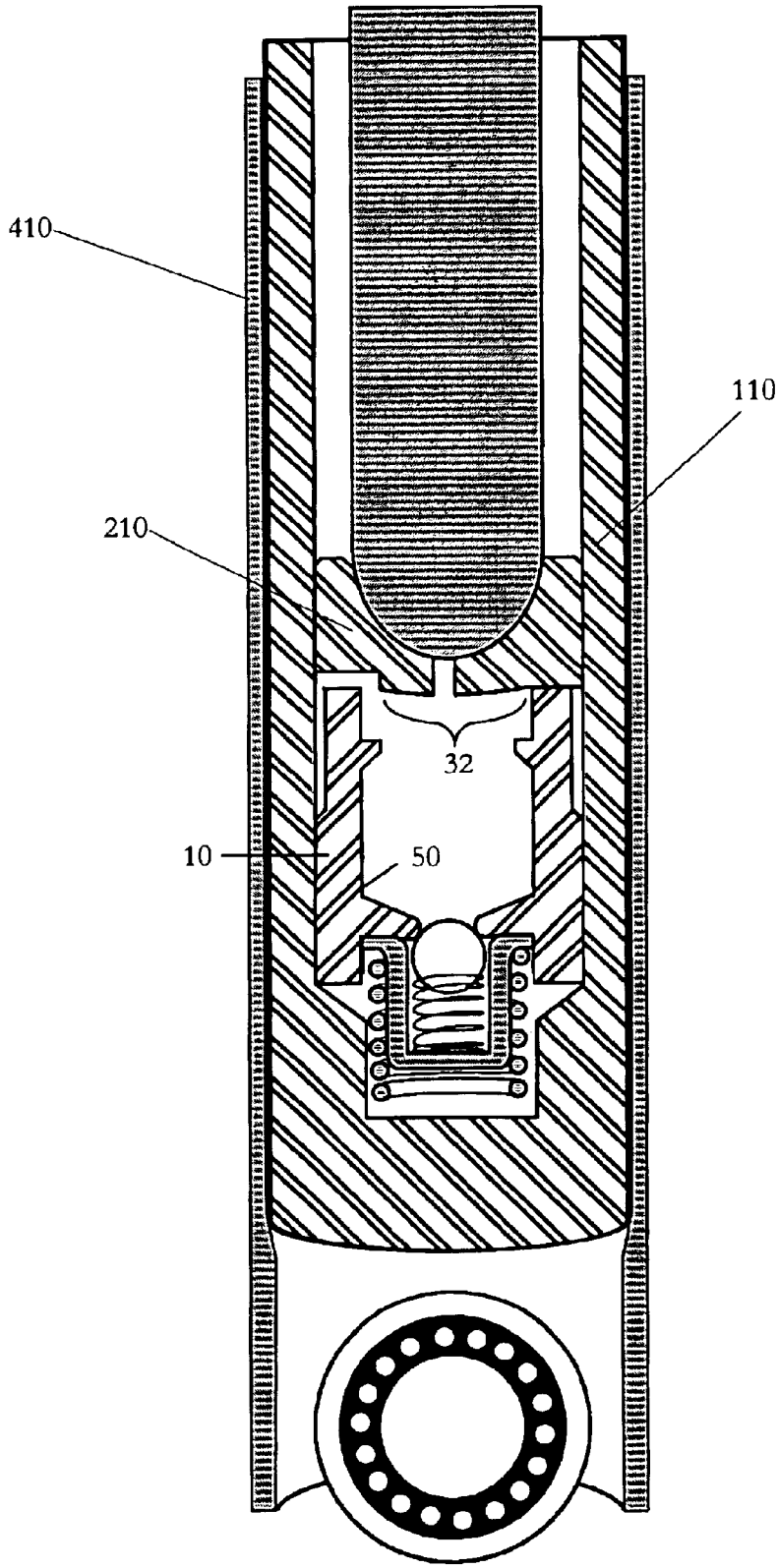
FIG. 37 depicts an embodiment of a socket cooperating with an engine work piece.

FIG. 36 depicts the outer socket surface 240 configured to cooperate with the inner surface of another workpiece. Those skilled in the art will appreciate that the outer socket surface 40 may be configured to cooperate with a lash adjuster. As shown in FIG. 36, the outer socket surface 240 is configured to cooperate with the inner lash adjuster surface 140 of a lash adjuster body 110. As depicted in FIG. 37, the lash adjuster body 110, with the socket 210 of the present invention located therein, may be inserted into a roller follower body 410.

Referring now to FIG. 38 to FIG. 42, the presently preferred method of fabricating a socket 210 is disclosed. FIGS. 38 to 42 depict what is known in the art as a "slug progression" that shows the fabrication of the present invention from a rod or wire to a finished or near-finished body. In the slug progression shown herein, pins are shown on the punch side; however, those skilled in the art will appreciate that the pins can be switched to the die side without departing from the scope of the present invention.

The socket 210 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 38:
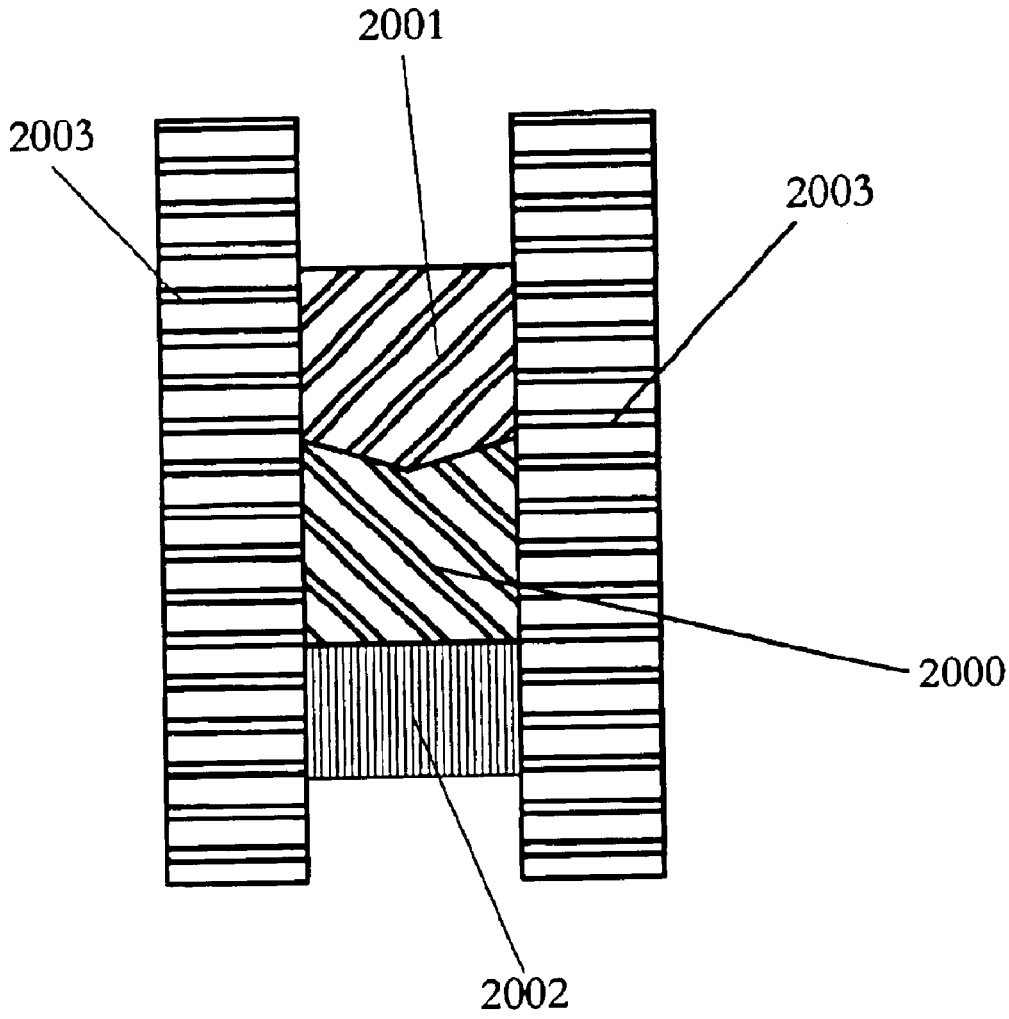
FIGS. 38–42 depict a preferred method of fabricating a socket.

The process of forging an embodiment of the present invention begins with a metal wire or metal rod 2000 which is drawn to size. The ends of the wire or rod are squared off. As shown in FIG. 38, this is accomplished through the use of a first punch 2001, a first die 2002, and a first knock out pin 2003.

Figure 39:
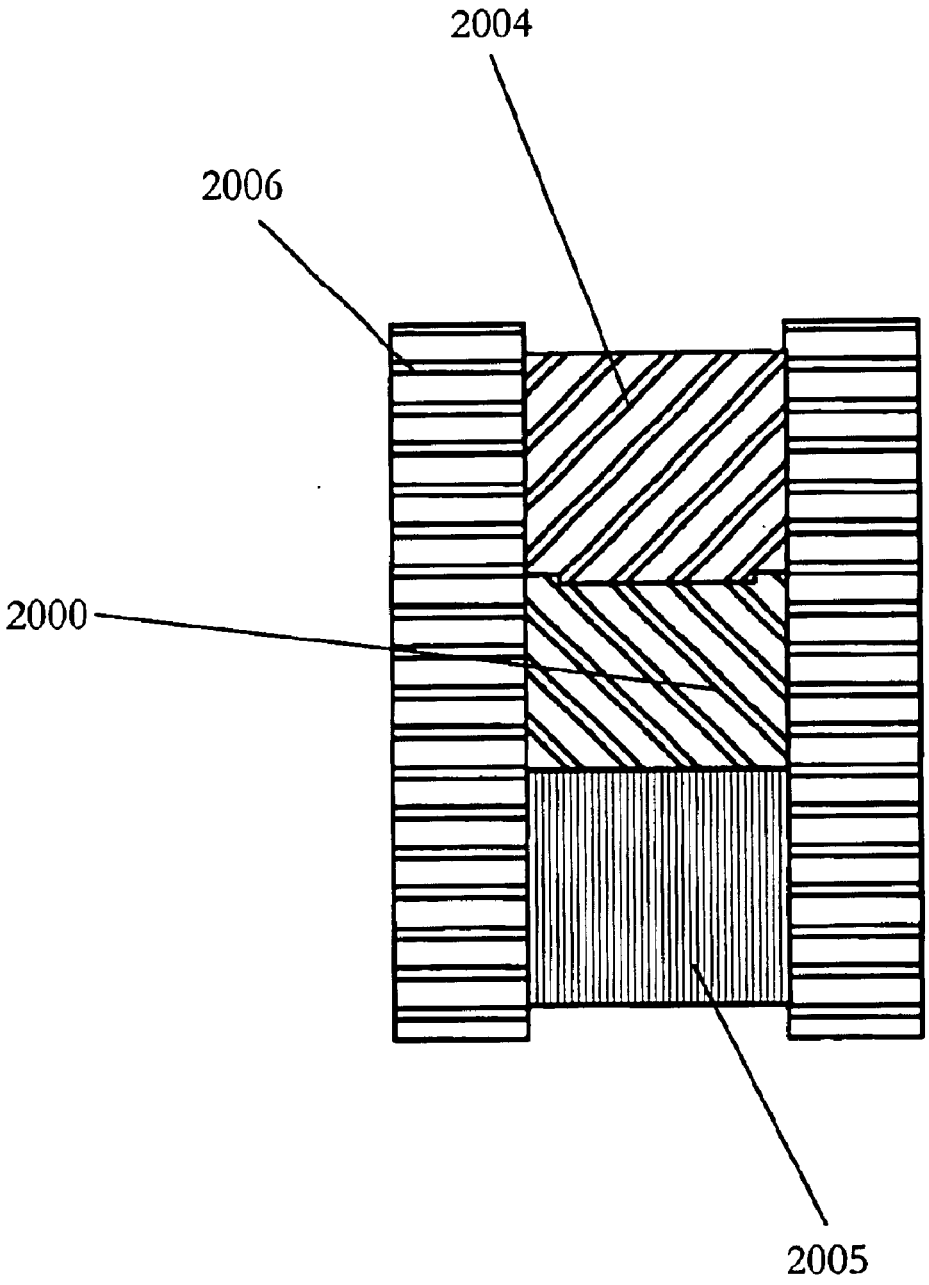

After being drawn to size, the wire or rod 2000 is run through a series of dies or extrusions. As depicted in FIG. 39, the fabrication of the first socket surface 231, the outer socket surface 240, and the second socket surface 232 is preferably commenced through use of a second punch 2004, a second knock out pin 2005, and a second die 2006. The second punch 2004 is used to commence fabrication of the first socket surface 231. The second die 2006 is used against the outer socket surface 240. The second knock out pin 2005 is used to commence fabrication of the second socket surface 232.

Figure 40:
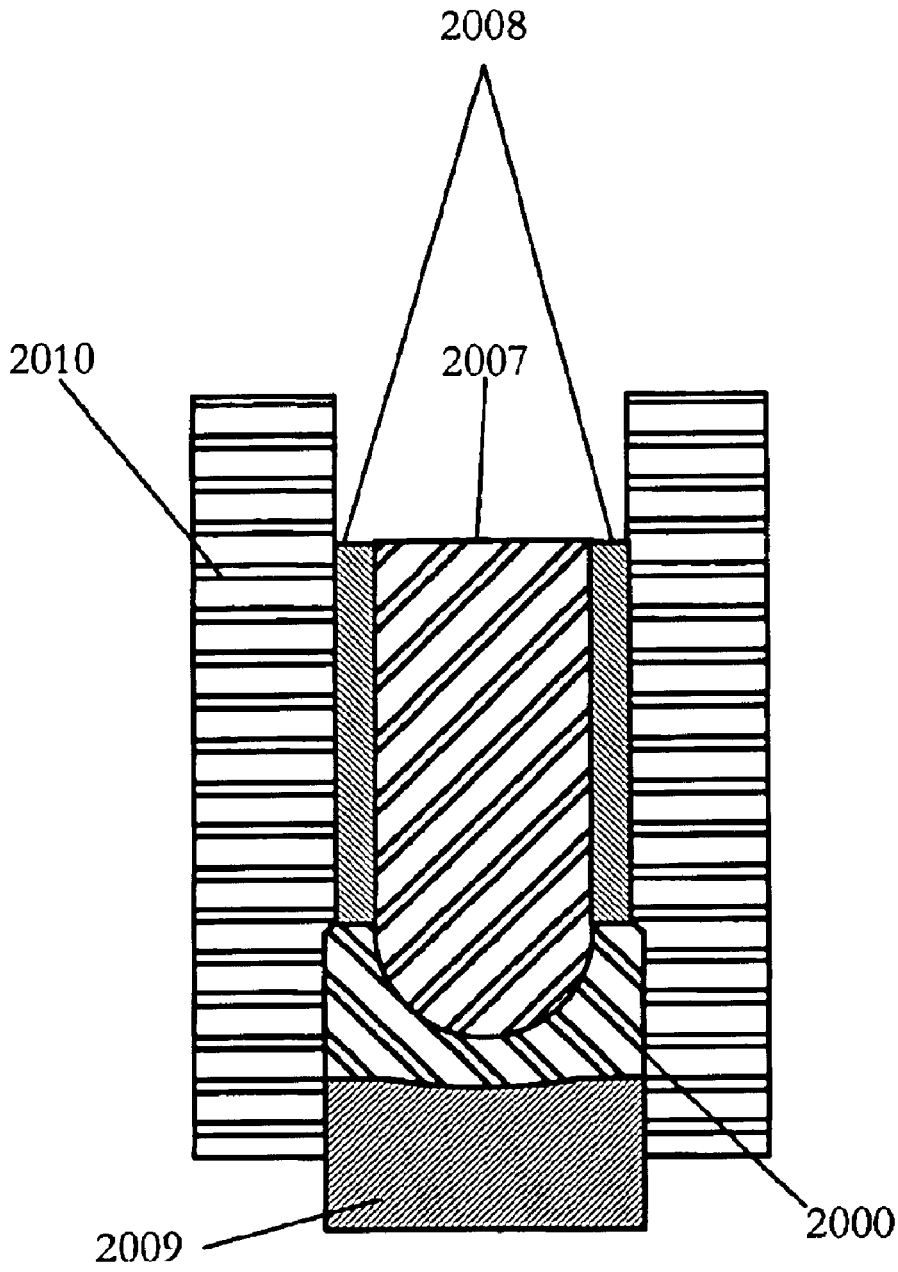

FIG. 40 depicts the fabrication of the first socket surface 231, the second socket surface 232, and the outer socket surface 240 through use of a third punch 2007, a first stripper sleeve 2008, a third knock out pin 2009, and a third die 2010. The first socket surface 231 is fabricated using the third punch 2007. The first stripper sleeve 2008 is used to remove the third punch 2007 from the first socket surface 231. The second socket surface 232 is fabricated through use of the third knock out pin 2009, and the outer socket surface 240 is fabricated through use of the third die 2010.

Figure 41:
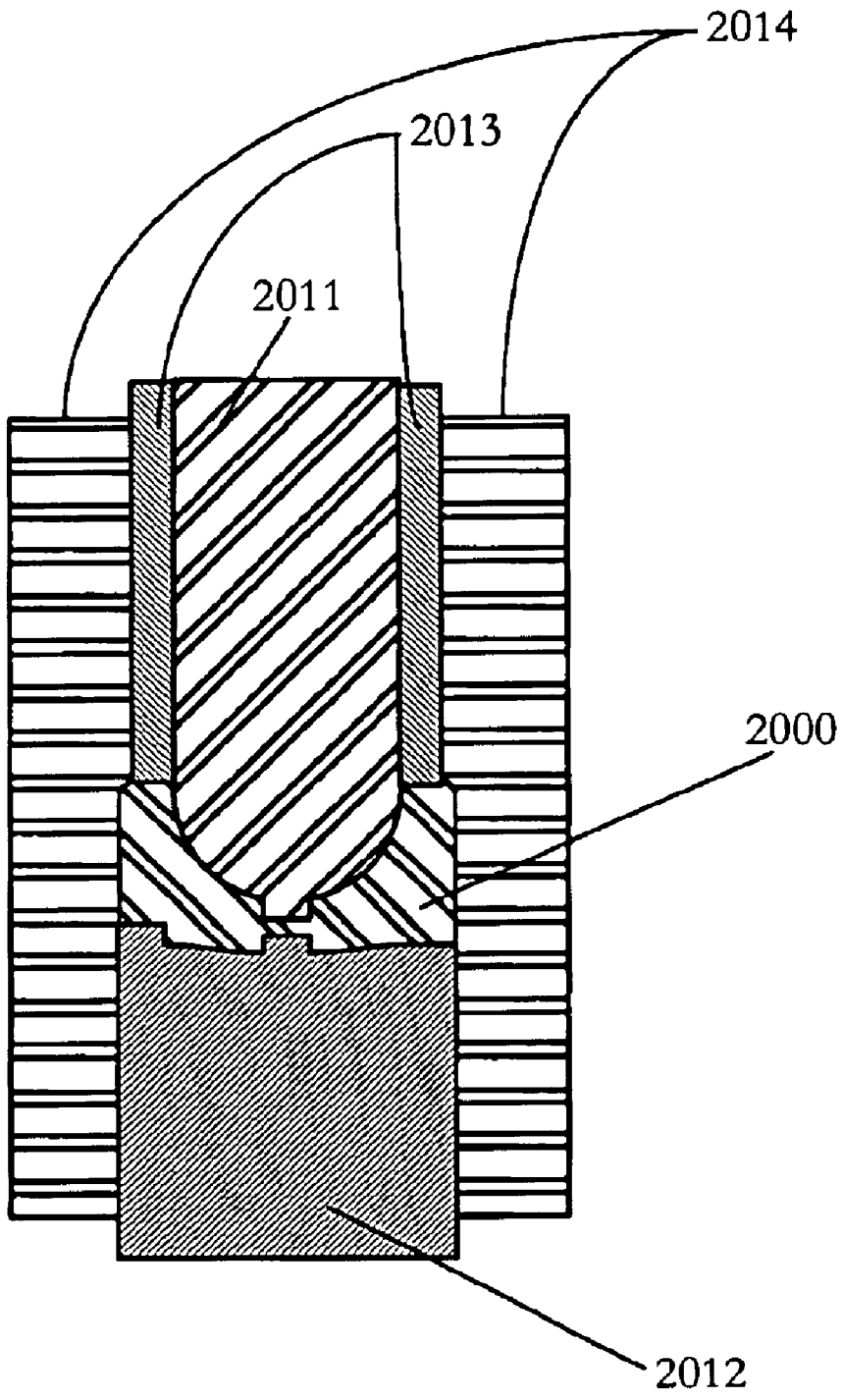

As depicted in FIG. 41, the fabrication of the passages 237, 238 is commenced through use of a punch pin 2011 and a fourth knock out pin 2012. A second stripper sleeve 2013 is used to remove the punch pin 2011 from the first socket surface 231. The fourth knock out pin 2012 is used to fabricate the plunger reservoir passage 238. A fourth die 2014 is used to prevent change to the outer socket surface 240 during the fabrication of the passages 237, 238.

Figure 42:
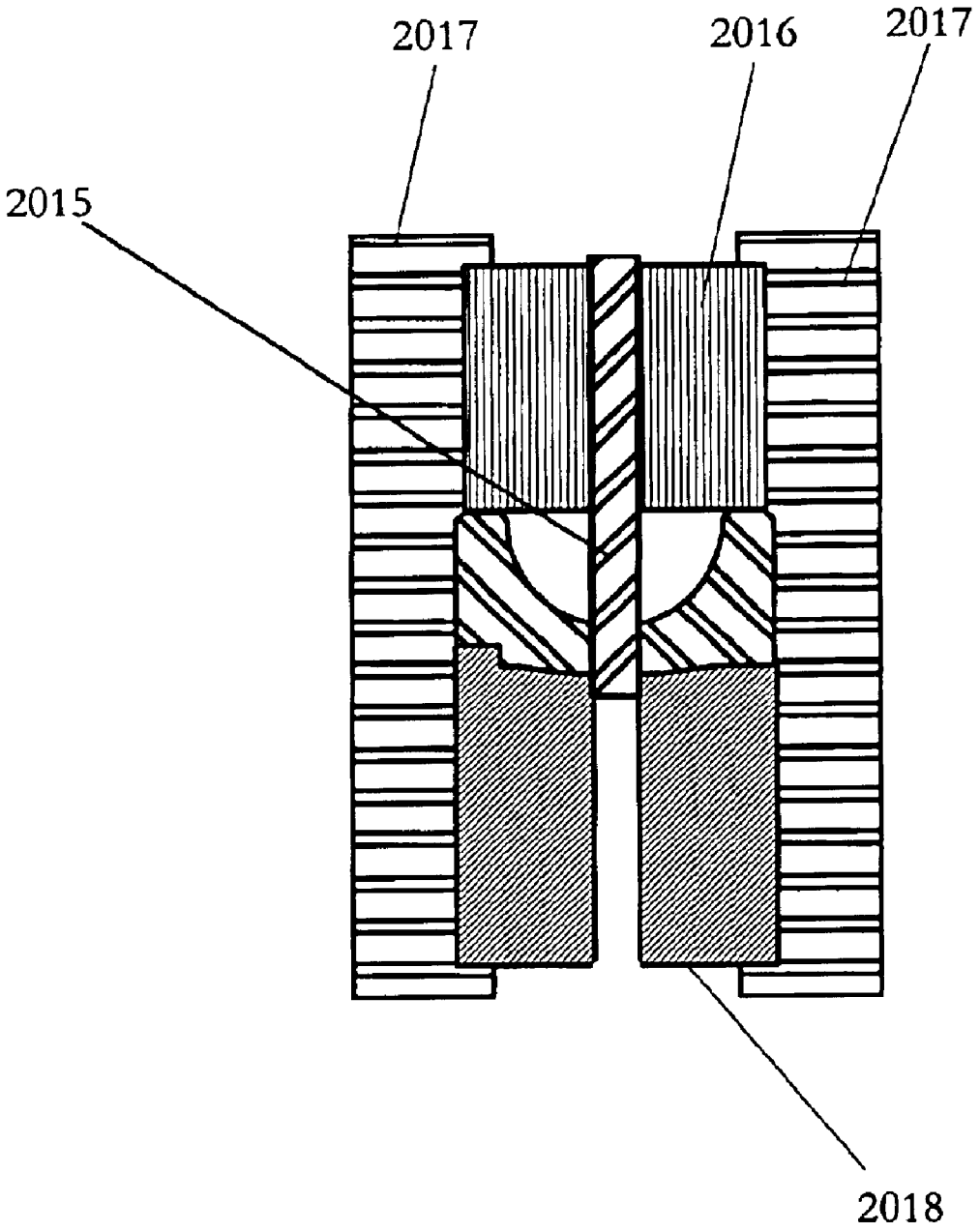

Referring now to FIG. 42, fabrication of socket passage 237 is completed through use of pin 2015. A third stripper sleeve 2016 is used to remove the pin 2015 from the first socket surface 231. A fifth die 2017 is used to prevent change to the outer socket surface 240 during the fabrication of socket passage 237. A tool insert 2018 is used to prevent change to the second socket surface 232 and the plunger reservoir passage 238 during the fabrication of socket passage 237.

Those skilled in the art will appreciate that further desirable finishing may be accomplished through machining. For example, passages 237, 238 may be enlarged and other passages may be drilled. However, such machining is not necessary.

Figure 43:
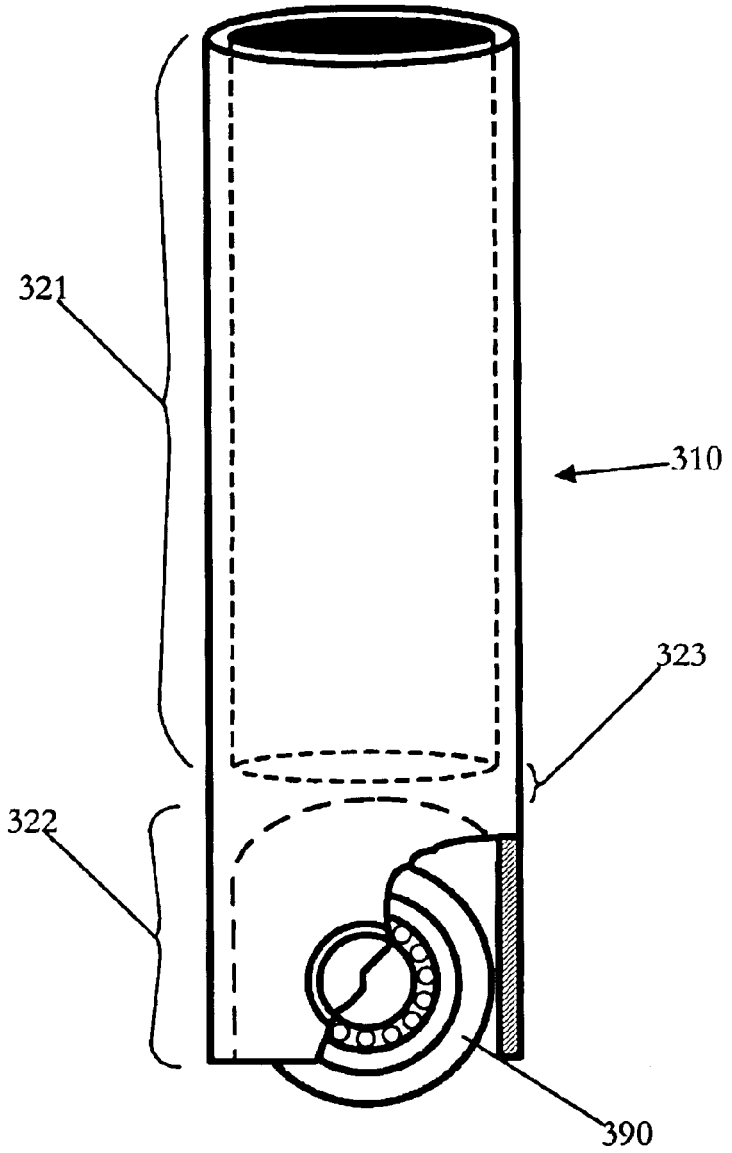
FIG. 43 depicts a preferred embodiment of a valve lifter body.
Figure 44:
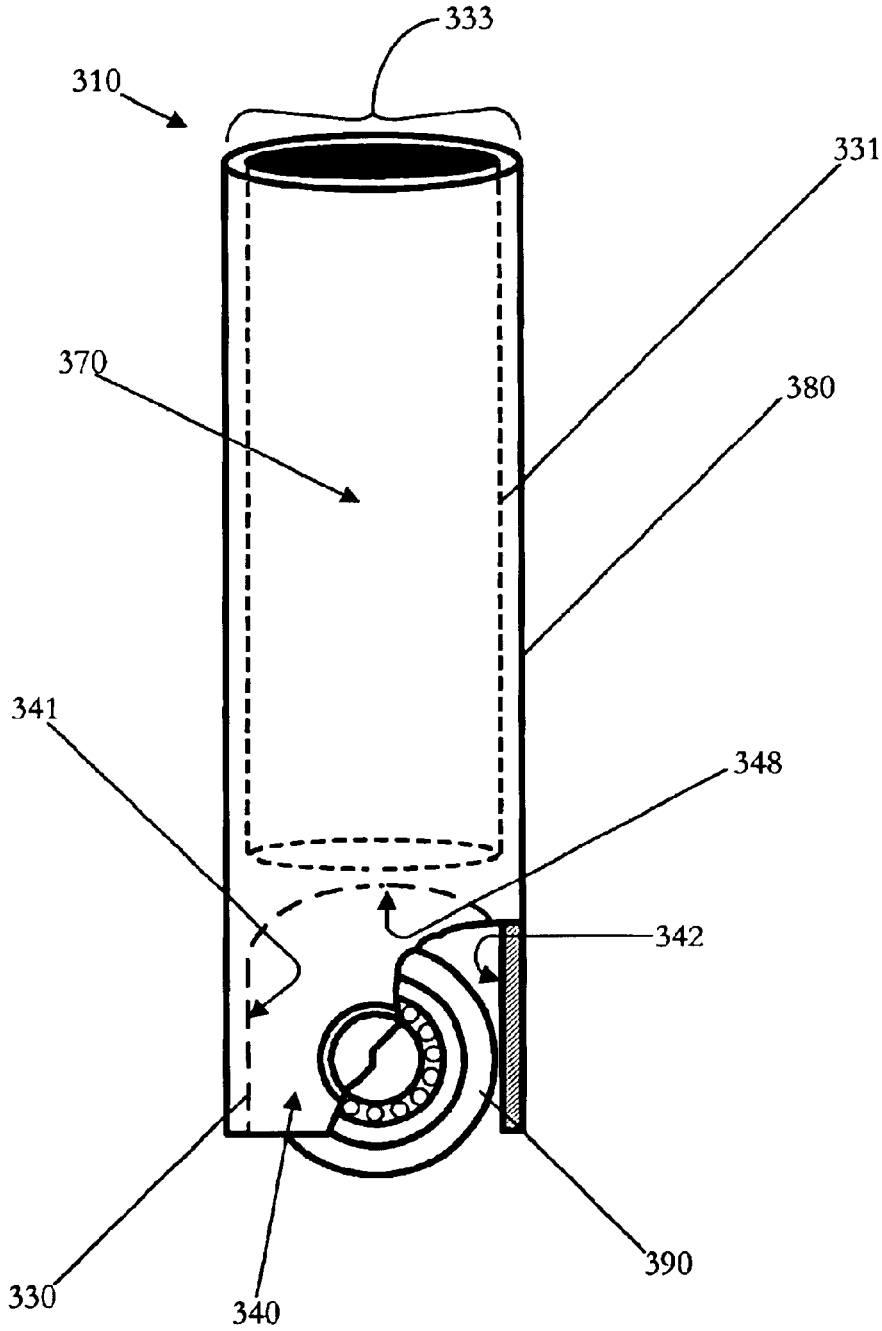
FIG. 44 depicts a preferred embodiment of a valve lifter body.
Figure 45:
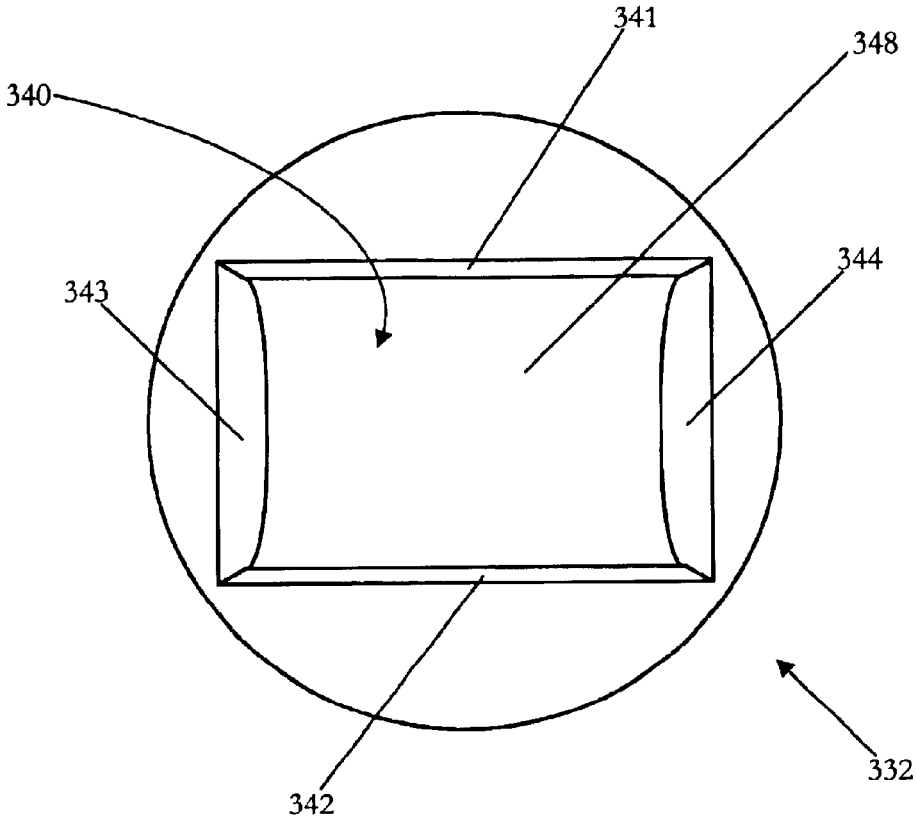
FIG. 45 depicts the top view of a preferred embodiment of a valve lifter body.

Turning now to the drawings, FIGS. 43, 44, and 45 show a preferred embodiment of the valve lifter body 310. The valve lifter 310 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel Those with skill in the art will also appreciate that the metal is a super alloy. According to one aspect of the present invention, the super alloy is bronze; according to another aspect of the present invention, the super alloy is a high nickel material. According to yet another aspect of the present invention, the valve lifter 310 is composed of pearlitic material. According to still another aspect of the present invention, the valve lifter 310 is composed of austenitic material. According to another aspect of the present invention, the metal is a ferritic material.

The valve lifter body 310 is composed of a plurality of lifter elements. According to one aspect of the present invention, the lifter element is cylindrical in shape. According to another aspect of the present invention, the lifter element is conical in shape. According to yet another aspect of the present invention, the lifter element is solid. According to still another aspect of the present invention, the lifter element is hollow.

FIG. 43 depicts a cross-sectional view of the valve lifter body 310 of the preferred embodiment of the present invention composed of a plurality of lifter elements. FIG. 43 shows the valve lifter body, generally designated 310, with a roller 390. The valve lifter body 310 of the preferred embodiment is fabricated from a single piece of metal wire or rod and is described herein as a plurality of lifter elements. The valve lifter body 310 includes a first hollow lifter element 321, a second hollow lifter element 322, and a solid lifter element 323. In the preferred embodiment, the solid lifter element 323 is located between the first hollow lifter element 321 and the second hollow lifter element 322.

The valve lifter body 310 functions to accommodate a plurality of inserts. According to one aspect of the present invention, the valve lifter body 310 accommodates a lash adjuster, such as the lash adjuster body 110. According to another aspect of the present invention, the valve lifter body 310 accommodates a leakdown plunger, such as the leakdown plunger 10. According to another aspect of the present invention, the valve lifter body 310 accommodates a push rod seat (not shown). According to yet another aspect of the present invention, the valve lifter body 310 accommodates a socket, such as the socket 210.

The valve lifter body 310 is provided with a plurality of outer surfaces and inner surfaces. FIG. 44 depicts a cross-sectional view of the valve lifter body 310 of the preferred embodiment of the present invention. As shown in FIG. 44, the valve lifter body 310 is provided with an outer lifter surface 380 which is cylindrically shaped. The outer lifter surface 380 encloses a plurality of cavities. As depicted in FIG. 44, the outer lifter surface 380 encloses a first lifter cavity 3and a second lifter cavity 331. The first lifter cavity 330 includes a first inner lifter surface 340. The second lifter cavity 331 includes a second inner lifter surface 370.

FIG. 45 depicts a top view and provides greater detail of the first lifter cavity 330 of the preferred embodiment. As shown in FIG. 45, the first lifter cavity 330 is provided with a first lifter opening 332 shaped to accept a cylindrical insert. The first inner lifter surface 340 is configured to house a cylindrical insert 390, which, in the preferred embodiment of the present invention, functions as a roller. Those skilled in the art will appreciate that housing a cylindrical insert can be accomplished through a plurality of different configurations. The first inner lifter surface 340 of the preferred embodiment includes a plurality of flat surfaces and a plurality of walls. As depicted in FIG. 45, the inner lifter surface 340 includes two opposing lifter walls 343, 344. A first flat lifter surface 341 is adjacent to a curved lifter surface 348. The curved lifter surface 348 is adjacent to a second flat lifter surface 342. The two lifter walls 343, 344 are located on opposing sides of the curved lifter surface 348.

Figure 54:
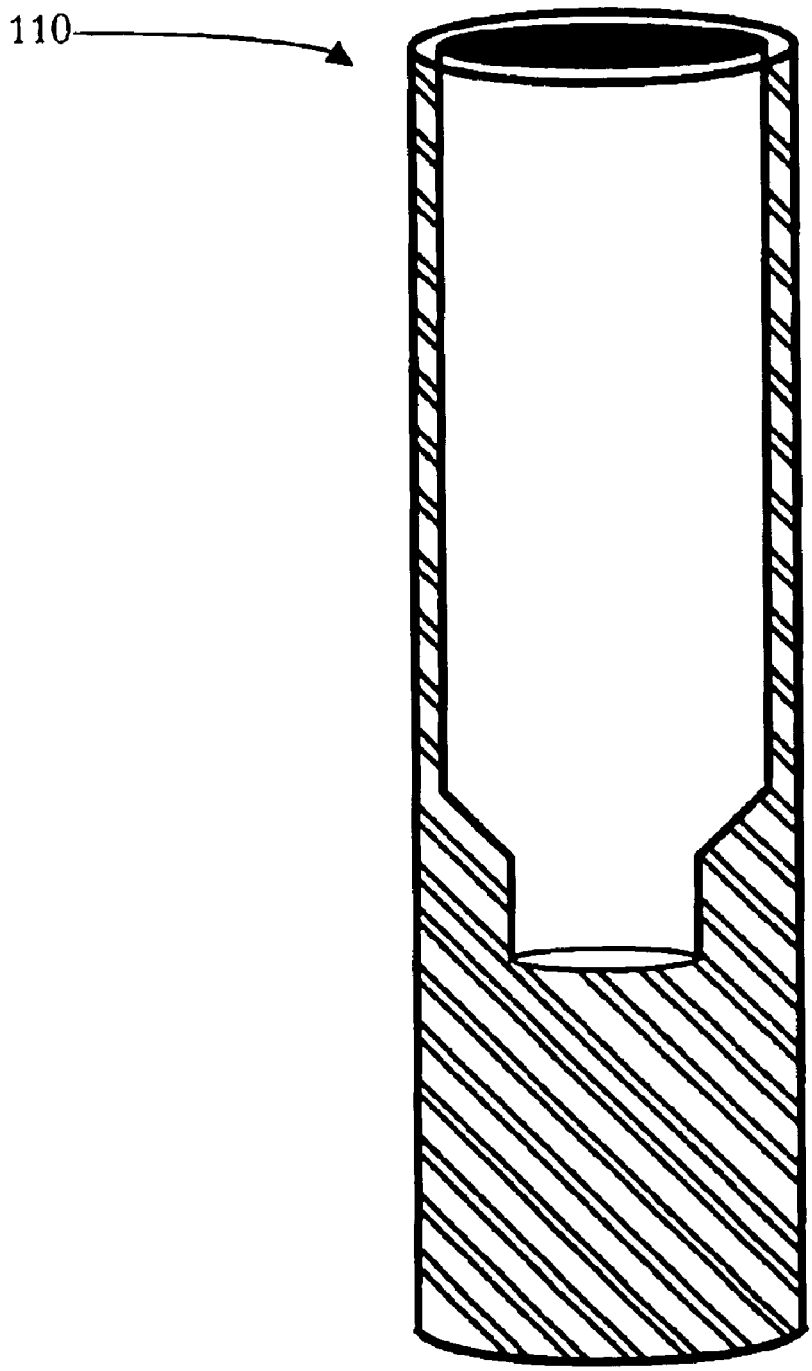
FIG. 54 depicts a lash adjuster body.

Referring to FIG. 44, the valve lifter body 310 of the present invention is provided with a second lifter cavity 331 which includes a second lifter opening 333 which is in a circular shape. The second lifter cavity 331 is provided with a second inner lifter surface 370. The second inner lifter surface 370 of the preferred embodiment is cylindrically shaped. Alternatively, the second inner lifter surface 370 is configured to house a lash adjuster generally designated 110 on FIG. 54. However, those skilled in the art will appreciate that the second inner lifter surface 370 can be conically or frustoconically shaped without departing from the spirit of the present invention.

The present invention is fabricated through a plurality of processes. According to one aspect of the present invention, the valve lifter body 310 is machined. According to another aspect of the present invention, the valve lifter body 310 is forged. According to yet another aspect of the present invention, the valve lifter body 310 is fabricated through casting. The valve lifter body 310 of the preferred embodiment of the present invention is forged. As used herein, the term "forge," "forging," or "forged" is intended to encompass what is known in the art as "cold forming," "cold heading," "deep drawing," and "hot forging."

The valve lifter body 310 is preferably forged with use of a National® 750 parts former machine. Those skilled in the art will appreciate that other part formers, such as, for example, a Waterbury machine can be used. Those skilled in the art will further appreciate that other forging methods can be used as well The process of forging the valve lifter body 310 preferably begins with a metal wire or metal rod which is drawn to size. The ends of the wire or rod are squared off by a punch. After being drawn to size, the wire or rod is run through a series of dies or extrusions. The second lifter cavity 331 is extruded through use of a punch and an extruding pin. After the second lifter cavity 331 has been extruded, the first lifter cavity 330 is forged. The first lifter cavity 330 is extruded through use of an extruding punch and a forming pin.

Alternatively, the valve lifter body 310 is fabricated through machining. As used herein, machining means the use of a chucking machine, a drilling machine, a grinding machine, or a broaching machine. Machining is accomplished by first feeding the valve lifter body 310 into a chucking machine, such as an ACME-Gridley automatic chucking machine. Those skilled in the art will appreciate that other machines and other manufacturers of automatic chucking machines can be used.

To machine the second lifter cavity 331, the end containing the second lifter opening 333 is faced so that it is substantially flat. The second lifter cavity 331 is bored. Alternatively, the second lifter cavity 331 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second lifter cavity 331 is ground using an internal diameter grinding machine, such as a Heald grinding machine. Those skilled in the art will appreciate that the second lifter cavity 331 can be ground using other grinding machines.

Those skilled in the art will appreciate that the other features of the present invention may be fabricated through machining. For example, the first lifter cavity 330 can be machined. To machine the first lifter cavity 330, the end containing the first lifter opening 332 is faced so that it is substantially flat. The first lifter cavity 330 is drilled and then the first lifter opening 332 is broached using a broaching machine.

Figure 46:
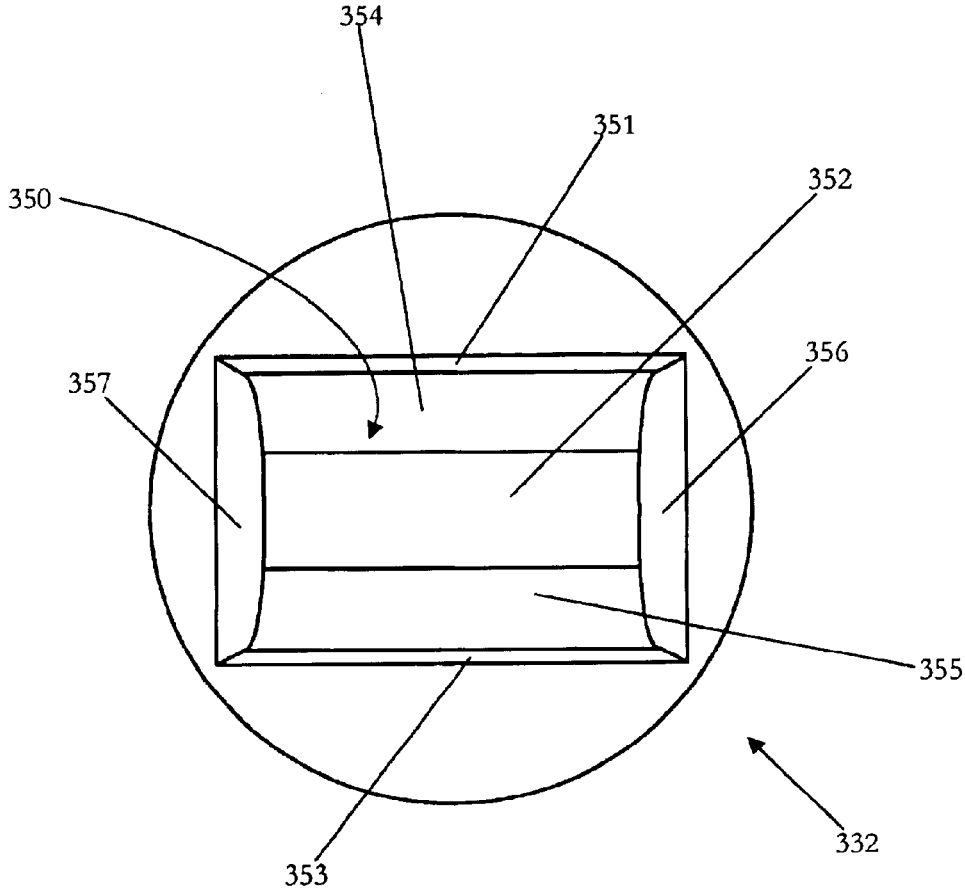
FIG. 46 depicts the top view of another preferred embodiment of a valve lifter body.
Figure 47:
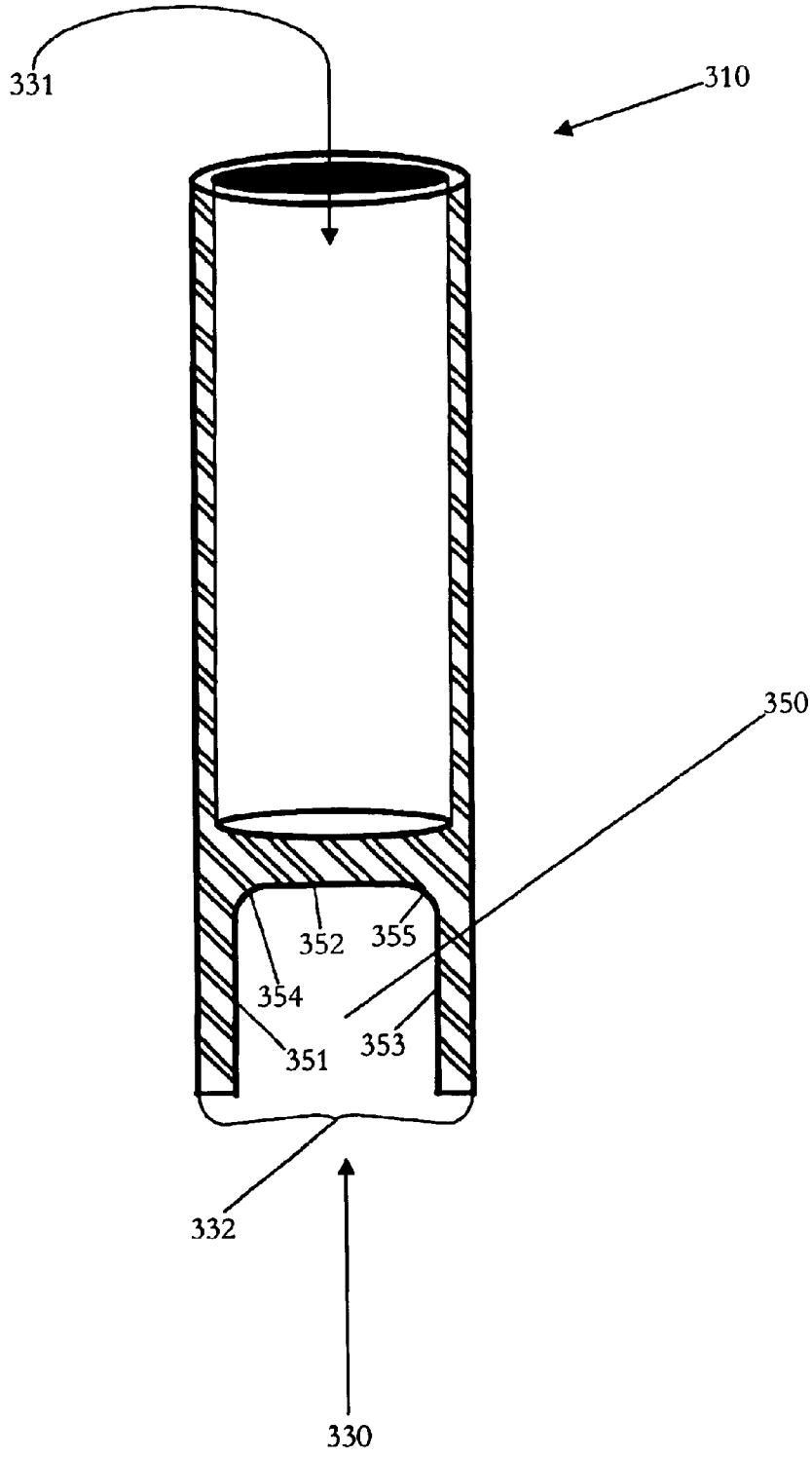
FIG. 47 depicts a second embodiment of a valve lifter body.

In an alternative embodiment of the present invention depicted in FIG. 46, the first lifter cavity 330 is provided with a first lifter opening 332 shaped to accept a cylindrical insert and a first inner lifter surface 350. The first inner lifter surface 350 includes a plurality of flat surfaces, a plurality of curved surfaces, and a plurality of walls. As depicted in FIG. 46, a first flat lifter surface 351 is adjacent to a first curved lifter surface 354. The first curved lifter surface 354 is adjacent to a second flat lifter surface 352. The second flat lifter surface 352 is adjacent to a second curved lifter surface 355. The second curved lifter surface 355 is adjacent to a third flat lifter surface 353. On opposing sides of the third flat lifter surface 353 are lifter walls 356, 357. FIG. 47 depicts a cross-sectional view of the valve lifter body 310 with the first lifter cavity 330 shown in FIG. 46.

Figure 48:
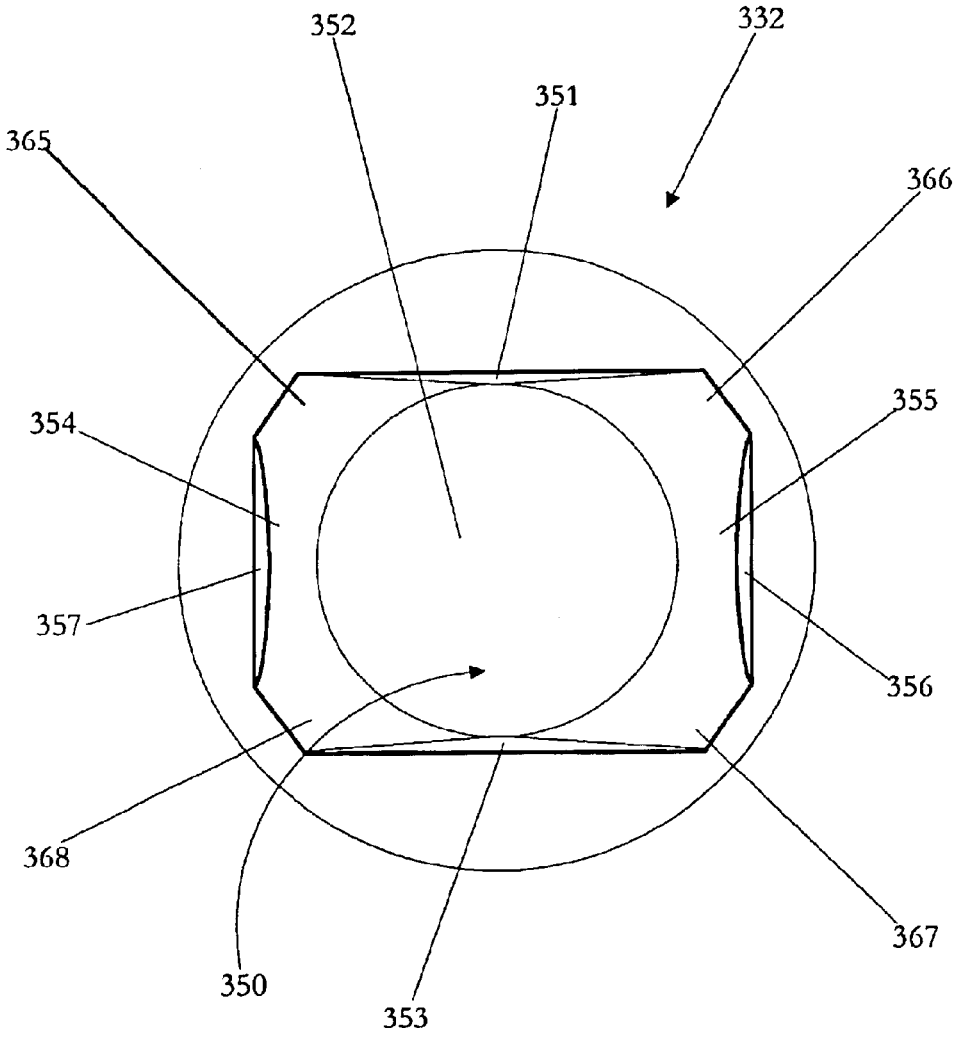
FIG. 48 depicts the top view of another preferred embodiment of a valve lifter body.
Figure 49:
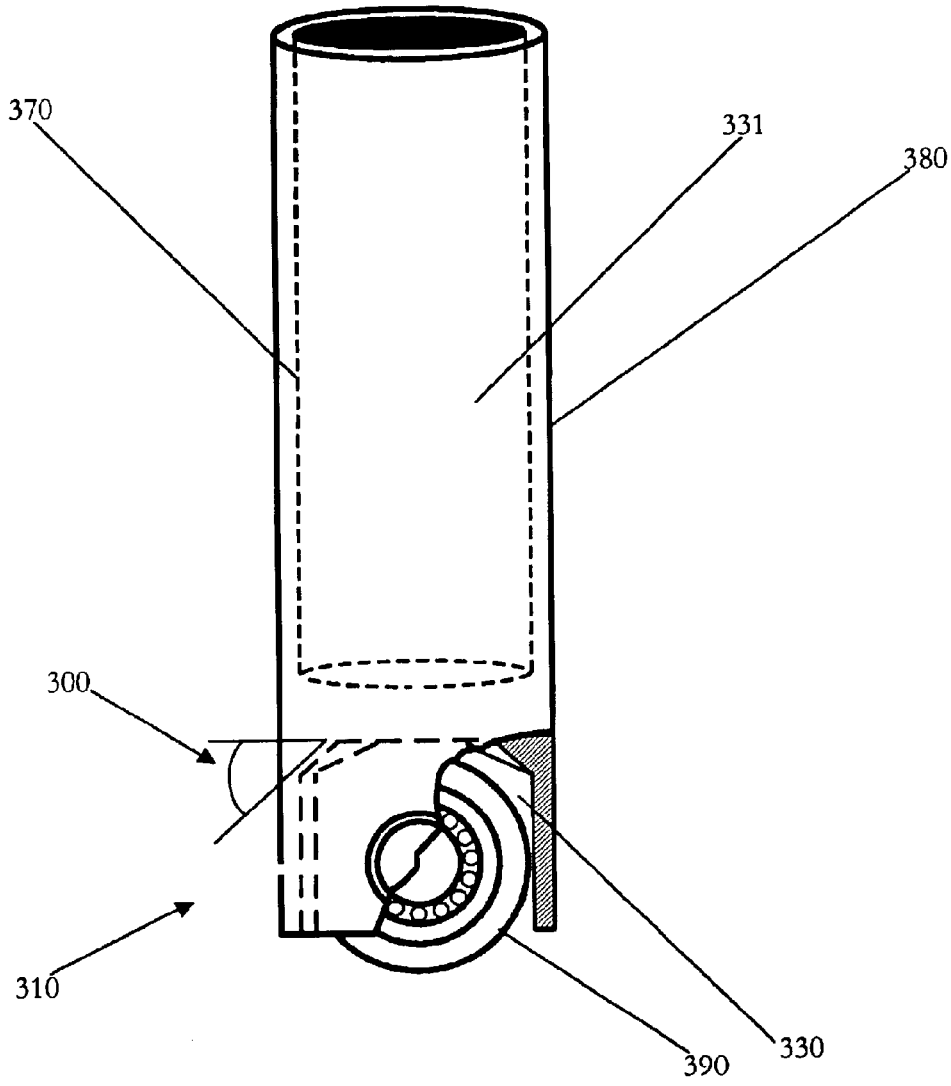
FIG. 49 depicts a third embodiment of a valve lifter body.

In another alternative embodiment of the present invention, as depicted in FIGS. 48 and 49, the first lifter cavity 330 is provided with a first lifter opening 332 shaped to accept a cylindrical insert and a first inner lifter surface 350. The first inner lifter surface 350 includes a plurality of flat surfaces and a plurality of walls. Referring to FIG. 48, a first flat lifter surface 351 is adjacent to a second flat lifter surface 352, a first angled lifter surface 365, and a second angled lifter surface 366. The first angled lifter surface 365 is adjacent to a second flat lifter surface 352 and a first curved lifter surface 354. As depicted in FIG. 49 the first angled lifter surface 365 is configured to be at an angle 300 relative to the plane of the second flat lifter surface 352, preferably between twenty-five and about ninety degrees.

The second angled lifter surface 366 is adjacent to the flat lifter surface 352. As shown in FIG. 49, the second angled lifter surface 366 is configured to be at an angle 300 relative to the plane of the second flat lifter surface 352, preferably between twenty-five and about ninety degrees. The second angled lifter surface 366 is adjacent to a second curved lifter surface 355. The second curved lifter surface 355 is adjacent to a third angled lifter surface 367 and a first lifter wall 356. The third angled lifter surface 367 is adjacent to the second flat lifter surface 352 and a third flat lifter surface 353. As depicted in FIG. 49, the third angled lifter surface 367 is configured to be at an angle 300 relative to the plane of the second flat lifter surface 352, preferably between twenty-five and about ninety degrees.

The third flat lifter surface 353 is adjacent to a fourth angled lifter surface 368. The fourth angled lifter surface 368 adjacent to the first curved lifter surface 354 and a second lifter wall 357. As depicted in FIG. 49, the fourth angled lifter surface 368 is configured to be at an angle 300 relative to the plane of the second flat lifter surface 352, preferably between twenty-five and about ninety degrees. FIG. 49 depicts a cross-sectional view of an embodiment with the first lifter cavity 330 of FIG. 48.

Figure 50:
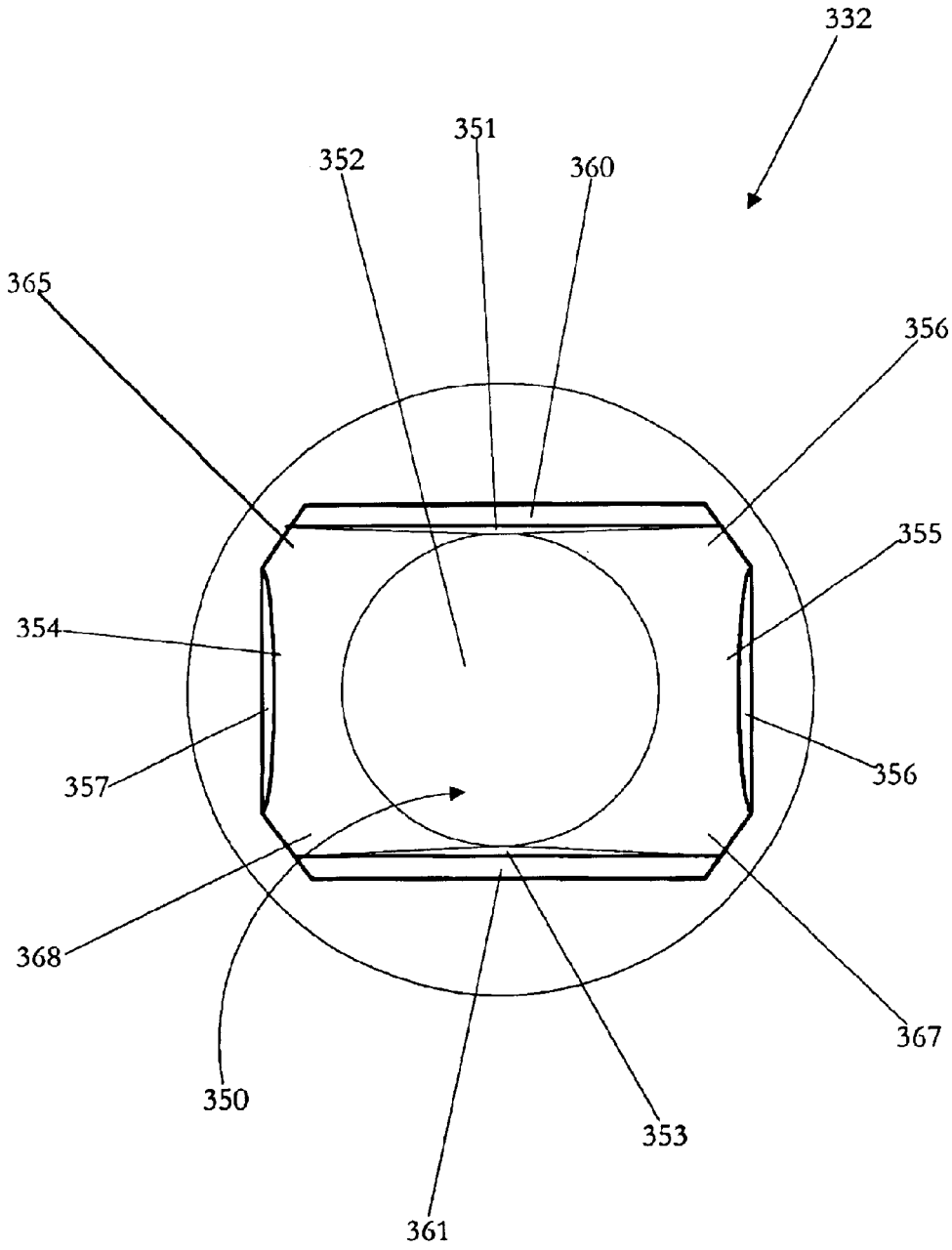
FIG. 50 depicts the top view of another preferred embodiment of a valve lifter body.

Shown in FIG. 50 is an alternative embodiment of the first lifter cavity 330 depicted in FIG. 48. In the embodiment depicted in FIG. 50, the first lifter cavity 330 is provided with a chamfered lifter opening 332 and a first inner lifter surface 350. The chamfered lifter opening 332 functions so that a cylindrical insert can be introduced to the valve lifter body 310 with greater ease. The chamfered lifter opening 332 accomplishes this function through lifter chamfers 360, 361 which are located on opposing sides of the chamfered lifter opening 332. The lifter chamfers 360, 361 of the embodiment shown in FIG. 50 are flat surfaces at an angle relative to the flat lifter surfaces 341, 342 so that a cylindrical insert 390 can be introduced through the first lifter opening 332 with greater ease. Those skilled in the art will appreciate that the lifter chamfers 360, 361 can be fabricated in a number of different configurations; so long as the resulting configuration renders introduction of a cylindrical insert 390 through the first lifter opening 332 with greater ease, it is a "chamfered lifter opening" within the spirit and scope of the present invention.

The lifter chamfers 360, 361 are preferably fabricated through forging via an extruding punch pin. Alternatively, the lifter chamfers 360, 361 are machined by being ground before heat-treating. Those skilled in the art will appreciate that other methods of fabrication can be employed within the scope of the present invention.

Figure 51:
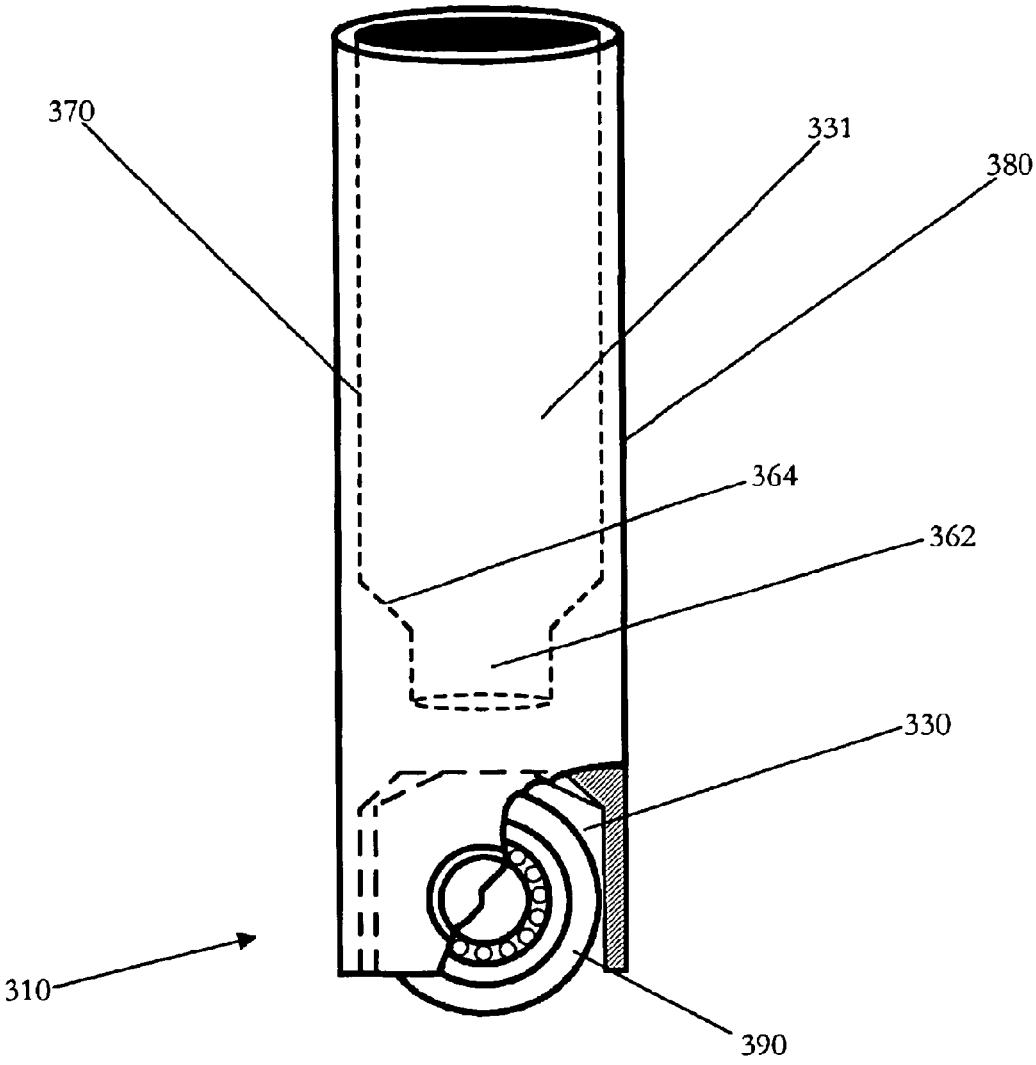
FIG. 51 depicts a fourth embodiment of a valve lifter body.

FIG. 51 discloses yet another alternative embodiment of the present invention. As depicted in FIG. 51, the valve lifter body 310 is provided with a second lifter cavity 331 which includes a plurality of cylindrical and conical surfaces. The second lifter cavity 331 depicted in FIG. 51 includes a second inner lifter surface 370. The second inner lifter surface 370 of the preferred embodiment is cylindrically shaped, concentric relative to the cylindrically shaped outer surface 380. The second inner lifter surface 370 is provided with a lifter well 362. The lifter well 362 is shaped to accommodate a spring (not shown). In the embodiment depicted in FIG. 51, the lifter well 362 is cylindrically shaped at a diameter that is smaller than the diameter of the second inner lifter surface 370. The cylindrical shape of the lifter well 362 is preferably concentric relative to the outer lifter surface 380. The lifter well 362 is preferably forged through use of an extruding die pin.

Alternatively, the lifter well 362 is machined by boring the lifter well 362 in a chucking machine. Alternatively, the lifter well 362 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lifter well 362 is ground using an internal diameter grinding machine, such as a Heald grinding machine. Those skilled in the art will appreciate that the lifter well 362 can be ground using other grinding machines.

Adjacent to the lifter well 362, the embodiment depicted in FIG. 51 is provided with a conically-shaped lead lifter surface 364 which can be fabricated through forging or machining. However, those skilled in the art will appreciate that the present invention can be fabricated without the lead lifter surface 364.

Figure 52:
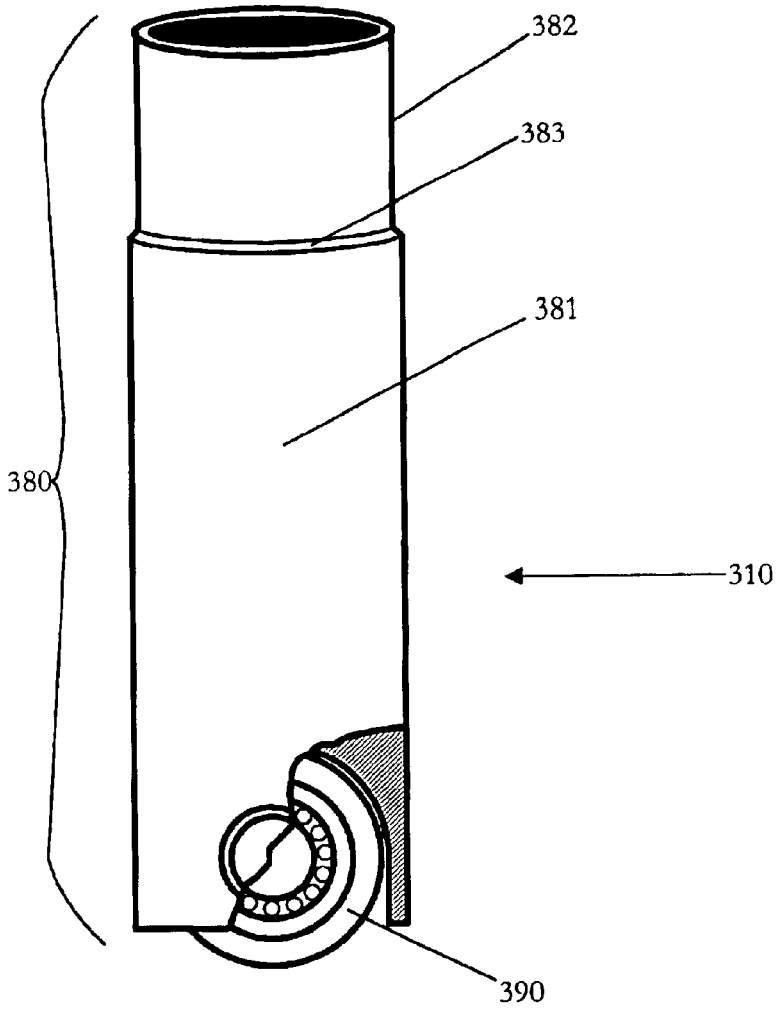
FIG. 52 depicts a fourth embodiment of a valve lifter body.

Depicted in FIG. 52 is another alternative embodiment of the present invention. As shown in FIG. 52, the valve lifter body 310 is provided with an outer lifter surface 380. The outer lifter surface 380 includes a plurality of surfaces. In the embodiment depicted in FIG. 52, the outer lifter surface 380 includes a cylindrical lifter surface 381, an undercut lifter surface 382, and a conical lifter surface 383. As depicted in FIG. 52, the undercut lifter surface 382 extends from one end of the valve lifter body 310 and is cylindrically shaped. The diameter of the undercut lifter surface 382 is smaller than the diameter of the cylindrical lifter surface 381.

The undercut lifter surface 382 is preferably forged through use of an extruding die. Alternatively, the undercut lifter surface 382 is fabricated through machining. Machining the undercut lifter surface 382 is accomplished through use of an infeed centerless grinding machine, such as a Cincinnati grinder. The surface is first heat-treated and then the undercut lifter surface 382 is ground via a grinding wheel. Those skilled in the art will appreciate that additional surfaces can be ground into the outer lifter surface 380 with minor alterations to the grinding wheel.

As depicted in FIG. 52, the conical lifter surface 383 is located between the cylindrical lifter surface 381 and the undercut lifter surface 382. The conical lifter surface 383 is preferably forged through use of an extruding die. Alternatively, the conical lifter surface 383 is fabricated through machining. Those with skill in the art will appreciate that the outer lifter surface 380 can be fabricated without the conical lifter surface 383 so that the cylindrical lifter surface 381 and the undercut lifter surface 382 abut one another.

Figure 53:
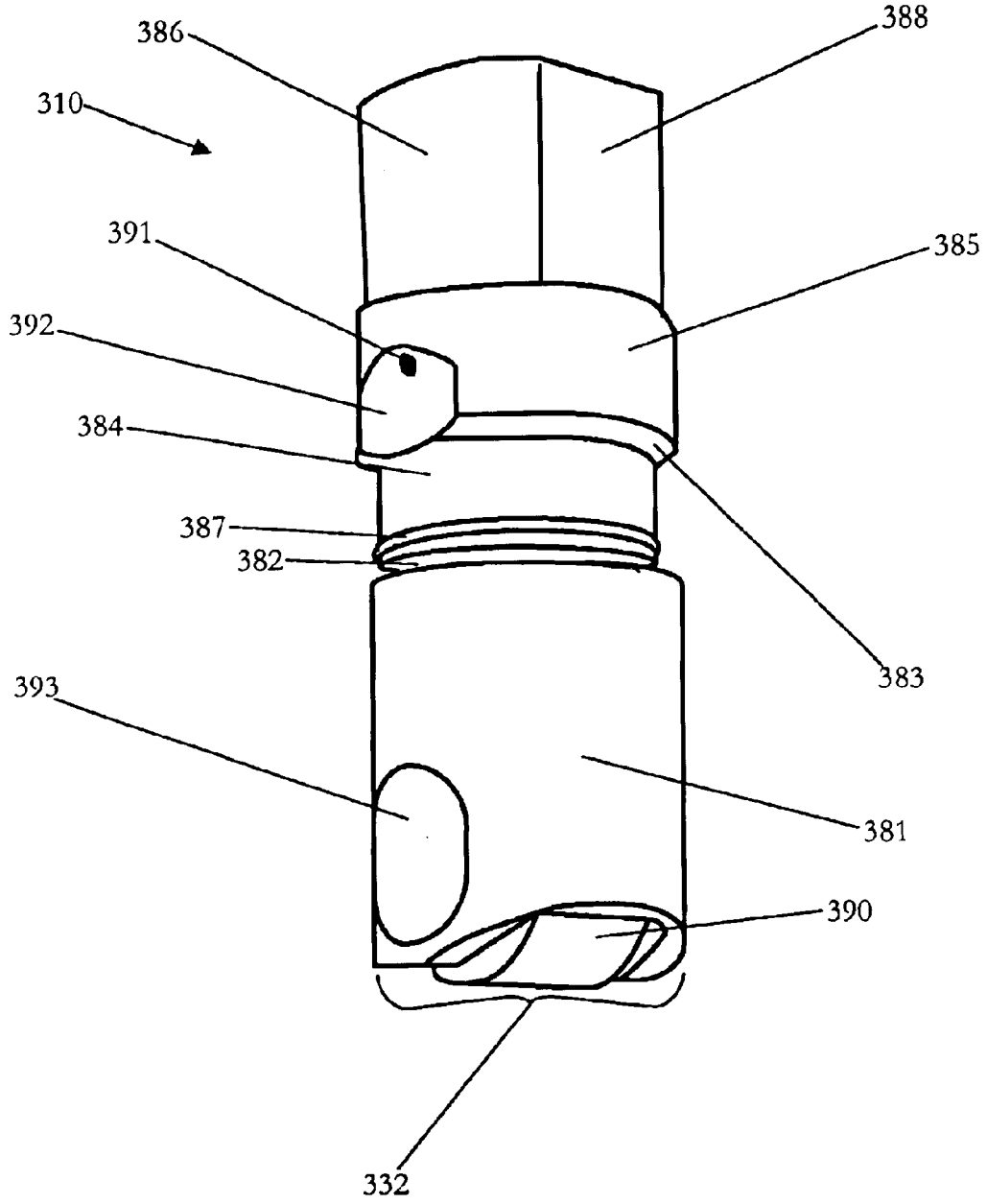
FIG. 53 depicts a fifth embodiment of a valve lifter body.

FIG. 53 depicts another embodiment valve lifter body 310 of the present invention. In the embodiment depicted in FIG. 53, the outer lifter surface 380 includes a plurality of outer surfaces. The outer lifter surface 380 is provided with a first cylindrical lifter surface 381. The first cylindrical lifter surface 381 contains a first lifter depression 393. Adjacent to the first cylindrical lifter surface 381 is a second cylindrical lifter surface 382. The second cylindrical lifter surface 382 has a radius which is smaller than the radius of the first cylindrical lifter surface 381. The second cylindrical lifter surface 382 is adjacent to a third cylindrical lifter surface 384. The third cylindrical lifter surface 384 has a radius which is greater than the radius of the second cylindrical lifter surface 382. The third cylindrical lifter surface 384 contains a lifter ridge 387. Adjacent to the third cylindrical lifter surface 384 is a conical lifter surface 383. The conical lifter surface 383 is adjacent to a fourth cylindrical lifter surface 385. The fourth cylindrical lifter surface 385 and the conical lifter surface 383 contain a second lifter depression 392. The second lifter depression 392 defines a lifter hole 391. Adjacent to the fourth cylindrical lifter surface 385 is a flat outer lifter surface 388. The flat outer lifter surface 388 is adjacent to a fifth cylindrical lifter surface 386.

Those skilled in the art will appreciate that the features of the valve lifter body 310 may be fabricated through a combination of machining, forging, and other methods of fabrication. By way of example and not limitation, the first lifter cavity 330 can be machined while the second lifter cavity 331 is forged. Conversely, the second lifter cavity 331 can be machined while the first lifter cavity 330 is forged.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An assembly, comprising:

a) socket provided with an outer socket surface that is generally cylindrical in shape, a first socket surface, and a second socket surface, wherein the outer socket surface is configured to cooperate with the inner surface of an engine workpiece, the first socket surface includes a push rod cooperating surface, and the second socket surface includes a plunger reservoir passage configured to conduct fluid and a curved socket surface that is concentric relative to the outer socket surface and configured to cooperate with a leakdown plunger;

b) the leakdown plunger is provided with a first plunger opening, a second plunger opening, and an outer plunger surface enclosing an inner plunger surface, wherein the first plunger opening is provided with an annular plunger surface defining a plunger hole shaped to accommodate an insert, the second plunger opening is configured to cooperate with the socket, the outer plunger surface includes a cylindrical plunger surface and an undercut plunger surface wherein the undercut plunger surface is cylindrically shaped and is located at an end of the plunger body, and the inner plunger surface includes a plurality of inner cylindrical plunger surfaces and is fluidly linked to the outer socket surface by the plunger reservoir passage; and c) means for cold forming at least a portion of at least one of the socket and the leakdown plunger.

2. An assembly according to claim 1, wherein said means for cold forming comprises a parts former.

3. An assembly according to claim 1, wherein the means for cold forming comprises a pin.

4. An assembly according to claim 1, wherein the means for cold forming comprises a punch.

5. An assembly according to claim 1, wherein comprising means for cold forming at least a portion of at least one of the first plunger opening, the second plunger opening, the outer plunger surface, and the inner plunger surface.

6. An assembly according to claim 1, further comprising means for cold forming at least a portion of at least one of the outer socket surface, the first socket surface, and the second socket surface.

7. An assembly according to claim 1, further comprising means for machining at least a portion of at least one of the socket and leakdown plunger.

8. An assembly according to claim 7, wherein said means for machining comprises at least one of a grinding machine and a grinding wheel.

9. An assembly according to claim 1, further comprising means cold forming the first plunger opening and means for machining the second plunger opening.

10. An assembly, comprising:

a) a socket provided with an outer socket surface that is generally cylindrical in shape, a first socket surface, and a second socket surface, wherein the outer socket surface is configured to cooperate with the inner surface of an engine workpiece, the first socket surface includes a push rod cooperating surface, and the second socket surface includes a plunger reservoir passage configured to conduct fluid and a curved socket surface that is concentric relative to the outer socket surface and configured to cooperate with a leakdown plunger;

b) the leakdown plunger is provided with a first plunger opening, a second plunger opening, and an outer plunger surface enclosing an inner plunger surface, wherein the first plunger opening is provided with an annular plunger surface defining a plunger hole shaped to accommodate an insert, the second plunger opening is configured to cooperate with the socket, the outer plunger surface includes a cylindrical plunger surface and an undercut plunger surface wherein the undercut plunger surface is cylindrically shaped and is located at an end of the plunger body, and the inner plunger surface includes a plurality of inner cylindrical plunger surfaces and is fluidly linked to the outer socket surface by the plunger reservoir passage;

c) a valve lifter body provided with an outer lifter surface that encloses a first lifter cavity and a second lifter cavity, wherein the first lifter cavity includes a first inner lifter surface and a first lifter opening shaped to accept a roller, the second lifter cavity includes a second inner lifter surface and a second lifter opening and is configured to accommodate the socket and the leakdown plunger; and d) means for cold forming at least a portion of at least one of the socket, the leakdown plunger, and the valve lifter body.

11. An assembly according to claim 10, wherein said means for cold forming comprises a parts former.

12. An assembly according to claim 10, wherein the means for cold forming comprises a pin.

13. An assembly according to claim 10, wherein the means for cold forming comprises a punch.

14. An assembly according to claim 10, further comprising means for cold forming at least a portion of at least one of the first plunger opening, the second plunger opening, the outer plunger surface, and the inner plunger surface.

15. An assembly according to claim 10, further comprising means for cold forming at least a portion of at least one of the outer socket surface, the first socket surface, and the second socket surface.

16. An assembly according to claim 10, further comprising means for cold forming at least a portion of at least one of the outer lifter surface, the first lifter cavity, and the second lifter cavity.

17. An assembly according to claim 10, further comprising means for machining at least a portion of at least one of the socket, leakdown plunger, and the valve lifter body.

18. An assembly according to clam 17, wherein said means for machining comprises at least one of a grinding machine and a grinding wheel.

19. An assembly according to claim 10, further comprising means cold forming the first plunger opening and means for machining the second plunger opening.

20. An assembly according to claim 10, further comprising a lash adjuster that accommodates the socket and the leakdown plunger, wherein the valve lifter body accommodates the lash adjuster.

21. An assembly, comprising:

a) socket provided with an outer socket surface that is generally cylindrical in shape, a first socket surface, and a second socket surface, wherein the outer socket surface is configured to cooperate with the inner surface of an engine workpiece, the first socket surface includes a push rod cooperating surface, and the second socket surface includes a plunger reservoir passage configured to conduct fluid and a curved socket surface that is concentric relative to the outer socket surface and configured to cooperate with a leakdown plunger;

b) the leakdown plunger is provided with a first plunger opening, a second plunger opening, and an outer plunger surface enclosing an inner plunger surface, wherein the first plunger opening is provided with an annular plunger surface defining a plunger hole shaped to accommodate an insert, the second plunger opening is configured to cooperate with the socket, the outer plunger surface includes a cylindrical plunger surface and an undercut plunger surface wherein the undercut plunger surface is cylindrically shaped and is located at an end of the plunger body, and the inner plunger surface includes a plurality of inner cylindrical plunger surfaces and is fluidly linked to the outer socket surface by the plunger reservoir passage;

c) a valve lifter body provided with an outer lifter surface that encloses a first lifter cavity and a second lifter cavity, wherein the first lifter cavity includes a first inner lifter surface and a first lifter opening shaped to accept a roller, the second lifter cavity includes a second inner lifter surface and a second lifter opening and is configured to accommodate the socket, the leakdown plunger, and a lash adjuster body;

d) the lash adjuster body is provided with a lash adjuster opening and an outer lash adjuster surface enclosing a lash adjuster cavity that includes an inner lash adjuster surface, wherein the inner lash adjuster surface is configured to accommodate the leakdown plunger and the socket and includes a first cylindrical lash adjuster surface and a lash adjuster well that includes a second cylindrical lash adjuster surface; and e) means for cold forming at least a portion of the socket, the leakdown plunger, the valve lifter body, and the lash adjuster.

22. An assembly according to claim 21, wherein said means for cold forming comprises a parts former.

23. An assembly according to claim 21, wherein the means for cold forming comprises a pine.

24. An assembly according to claim 21, wherein the means for cold forming comprises a punch.

25. An assembly according to claim 21, further comprising means for cold forming at least a portion of at least one of the first plunger opening, the second plunger opening, the outer plunger surface, and the inner plunger surface.

26. An assembly according to claim 21, further comprising means for cold forming at least a portion of at least one of the outer socket surface, the first socket surface, and the second socket surface.

27. An assembly according to claim 21, further comprising means for cold forming at least a portion of at least one of the outer lifter surface, the first lifter cavity, and the second lifter cavity.

28. An assembly according to claim 21, further comprising means for cold forming at least a portion of at least one of the lash adjuster opening, the outer lash adjuster surface, and the lash adjuster cavity.

29. An assembly according to claim 21, further comprising means for machining at least a portion of at least one of the socket, leakdown plunger, the valve lifter body, and the lash adjuster body.

30. An assembly according to claim 29, wherein said means for machining comprises at least one of a grinding machine and a grinding wheel.

31. An assembly according to claim 21, further comprising means cold forming the first plunger opening and means for machining the second plunger opening.

* * * * *